US009302801B2

(12) United States Patent
Matsumura et al.

(10) Patent No.: US 9,302,801 B2
(45) Date of Patent: Apr. 5, 2016

(54) DEVELOPER ACCOMMODATING UNIT, MANUFACTURING METHOD THEREOF, PROCESS CARTRIDGE AND IMAGE FORMING APPARATUS

(71) Applicant: CANON KABUSHIKI KAISHA, Tokyo (JP)

(72) Inventors: Junichi Matsumura, Numazu (JP); Masaaki Matsushita, Yokohama (JP); Koji Yamaguchi, Numazu (JP); Tetsuo Uesugi, Yokohama (JP); Tatsuo Fujisaki, Yokohama (JP); Kojiro Yasui, Numazu (JP); Masatomi Yoshida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/624,765

(22) Filed: Feb. 18, 2015

(65) Prior Publication Data

US 2015/0234319 A1 Aug. 20, 2015

(30) Foreign Application Priority Data

Feb. 18, 2014 (JP) ..... 2014-028137

(51) Int. Cl.
*G03G 15/08* (2006.01)
*B65B 51/10* (2006.01)

(52) U.S. Cl.
CPC ..... *B65B 51/10* (2013.01); *G03G 15/0874* (2013.01)

(58) Field of Classification Search
CPC ..... G03G 15/0877; G03G 15/0841; G03G 15/0843; G03G 15/0874; B65B 3/04; B65B 7/00; B65B 7/06; B65B 7/08; B65B 51/04; B65B 51/10
USPC ..... 399/109, 262
See application file for complete search history.

(56) References Cited

U.S. PATENT DOCUMENTS

| | | | | |
|---|---|---|---|---|
| 4,522,487 | A * | 6/1985 | Misawa | 399/102 |
| 6,128,462 | A | 10/2000 | Kato et al. | |
| 6,169,869 | B1 | 1/2001 | Inami et al. | |
| 6,175,703 | B1 | 1/2001 | Nakazono et al. | |
| 6,337,964 | B2 | 1/2002 | Inami et al. | |
| 6,539,190 | B2 | 3/2003 | Oba et al. | |
| 6,681,088 | B2 | 1/2004 | Kanno et al. | |
| 6,782,219 | B2 | 8/2004 | Yoshino et al. | |
| 6,834,173 | B2 | 12/2004 | Yamaguchi et al. | |
| 6,859,629 | B2 | 2/2005 | Miura et al. | |
| 6,898,401 | B2 | 5/2005 | Okano et al. | |
| 6,915,092 | B2 | 7/2005 | Yamaguchi et al. | |
| 6,947,687 | B2 | 9/2005 | Yamaguchi et al. | |
| 6,961,528 | B2 | 11/2005 | Yamaguchi et al. | |

(Continued)

FOREIGN PATENT DOCUMENTS

| | | | |
|---|---|---|---|
| JP | 01-128351 | U | 9/1989 |
| JP | H04-166963 | A | 6/1992 |
| JP | 2008-134483 | A | 6/2008 |

*Primary Examiner* — Sophia S Chen
(74) *Attorney, Agent, or Firm* — Fitzpatrick, Cella, Harper & Scinto

(57) ABSTRACT

A developer accommodating unit includes: a developer bag in which a developer is incorporated. The developer bag includes: a filling port for filling the developer; a filling region where the developer is filled; a non-filling region, provided outside the filling region, where the developer is not filled, and a folded portion formed by folding the filling region and the non-filling region. The folded portion includes a welding portion.

15 Claims, 29 Drawing Sheets

(56) References Cited

U.S. PATENT DOCUMENTS

| | | | | |
|---|---|---|---|---|
| 6,963,706 | B2 | 11/2005 | Morioka et al. | |
| 6,978,100 | B2 | 12/2005 | Yasui et al. | |
| 6,983,115 | B2 | 1/2006 | Isobe et al. | |
| 7,016,626 | B2 | 3/2006 | Yokomori et al. | |
| 7,068,965 | B2 | 6/2006 | Yoshino et al. | |
| 7,085,516 | B2 | 8/2006 | Kawai et al. | |
| 7,116,925 | B2 | 10/2006 | Yamaguchi | |
| 7,136,604 | B2 | 11/2006 | Chadani et al. | |
| 7,155,137 | B2 | 12/2006 | Yasui et al. | |
| 7,184,687 | B2 | 2/2007 | Yamaguchi et al. | |
| 7,194,225 | B2 | 3/2007 | Yamaguchi | |
| 7,319,834 | B2 | 1/2008 | Yamaguchi | |
| 7,398,040 | B2 | 7/2008 | Yoshida | |
| 7,477,865 | B2 | 1/2009 | Yamaguchi | |
| 7,519,310 | B2 | 4/2009 | Yamaguchi et al. | |
| 7,792,460 | B2 | 9/2010 | Yamaguchi et al. | |
| 8,121,519 | B2 | 2/2012 | Yamaguchi et al. | |
| 8,577,252 | B2 | 11/2013 | Anan et al. | |
| 8,867,955 | B2 | 10/2014 | Yamaguchi et al. | |
| 8,918,017 | B2 | 12/2014 | Matsushita et al. | |
| 2004/0101216 | A1* | 5/2004 | Ichikawa | 383/119 |
| 2011/0020031 | A1 | 1/2011 | Sato et al. | |
| 2012/0027457 | A1 | 2/2012 | Yamaguchi et al. | |
| 2013/0039678 | A1* | 2/2013 | Yoshida et al. | 399/262 |
| 2013/0136489 | A1* | 5/2013 | Yamaguchi et al. | 399/106 |
| 2013/0164039 | A1 | 6/2013 | Matsushita et al. | |
| 2013/0164040 | A1 | 6/2013 | Matsushita et al. | |
| 2013/0336679 | A1 | 12/2013 | Furutani et al. | |
| 2013/0343785 | A1 | 12/2013 | Matsuzaki et al. | |
| 2014/0016961 | A1 | 1/2014 | Yasui et al. | |
| 2014/0029974 | A1 | 1/2014 | Uesugi et al. | |
| 2014/0064793 | A1 | 3/2014 | Matsuzaki et al. | |
| 2014/0072329 | A1 | 3/2014 | Uesugi et al. | |
| 2014/0072330 | A1 | 3/2014 | Yoshida et al. | |
| 2014/0072331 | A1 | 3/2014 | Matsushita et al. | |
| 2014/0072345 | A1 | 3/2014 | Matsunaga et al. | |
| 2014/0072346 | A1 | 3/2014 | Furutani et al. | |
| 2014/0072347 | A1 | 3/2014 | Furutani et al. | |
| 2014/0079432 | A1 | 3/2014 | Matsuzaki et al. | |
| 2014/0126928 | A1 | 5/2014 | Batch et al. | |
| 2014/0199092 | A1 | 7/2014 | Matsushita et al. | |
| 2014/0199093 | A1 | 7/2014 | Yoshida et al. | |
| 2014/0199094 | A1 | 7/2014 | Matsuzaki et al. | |
| 2014/0199096 | A1 | 7/2014 | Yoshida et al. | |
| 2014/0363196 | A1 | 12/2014 | Wada et al. | |
| 2015/0003865 | A1 | 1/2015 | Baton et al. | |
| 2015/0093153 | A1 | 4/2015 | Ogino et al. | |

* cited by examiner

DEVELOPER ACCOMMODATING UNIT, MANUFACTURING METHOD THEREOF, PROCESS CARTRIDGE AND IMAGE FORMING APPARATUS

FIELD OF THE INVENTION AND RELATED ART

The present invention relates to a developer accommodating unit for being provided in an image forming apparatus, a manufacturing method of the developer accommodating unit, a process cartridge and the image forming apparatus.

An electrophotographic image forming apparatus forms an image on a recording material by using an electrophotographic image forming process. Examples of the image forming apparatus may include an electrophotographic copying machine, an electrophotographic printer such as LED (light emitting diode) printer or a laser beam printer, an electrophotographic facsimile machine, an electrophotographic word processor, and the like.

The process cartridge refers to a cartridge, prepared by integrally assembling at least a developing means and the developer accommodating unit accommodating the developer into a unit, detachably mountable to a main assembly of the image forming apparatus or the cartridge. The developer accommodating unit includes at least a flexible container for accommodating the developer.

In a conventional electrophotographic image forming apparatus using the electrophotographic image forming process, a process cartridge type in which an electrophotographic photosensitive member and process means actable thereon are integrally assembled into a cartridge and the cartridge is made detachably mountable to an electrophotographic image forming apparatus main assembly has been employed.

In such a process cartridge, a type such that an opening provided in a developer accommodating frame for accommodating the developer (a toner, a carrier and the like) is sealed with a sealing member and at the time of use, the sealing member is peeled off to open the opening thereby to permit supply of the developer has been widely used.

As an example of the sealing member, there is a type in which a sheet-shaped sealing member is (thermally) welded by heat seal or the like at a periphery of the opening of the developer accommodating frame. A constitution in which a free end of the sealing member is folded back and then is capable of being pulled in an opposite direction to a fold-back portion in order to reduce a load of a user when a welding portion formed by the welding has been widely used.

Further, a constitution in which a developer-incorporated unit separable from and mountable to a process cartridge main assembly is provided and the developer is supplied by peeling off a sheet member or the like has been proposed (Japanese Laid-Open Patent Application (JP-A) Hei 04-166963, Japanese Utility-Model Application (JP-U) Hei 01-128351 and JP-A 2008-134483). Of these, in the constitution of JP-A Hei 04-166963, the user pulls an end of a bag-shaped sheet film accommodating the developer, so that the bag is opened and thus the developer can be supplied. In the constitution of JP-U Hei 01-128351, a sheet blocking an opening for discharge of the developer is wound up by a rotatable member, whereby supply of the developer is started automatically. The constitution of JP-A 2008-134483 is principally directed to prevention of agglomeration of the developer, and a stirring sheet blocks an opening of a hopper accommodating the developer and performs the function of stirring the developer after the opening is opened.

However, even when these constitutions were employed, there was a problem such that it is difficult to seal a filling port by welding or the like when the developer is scattered and deposited at a periphery of the filling port after the developer is filled in a developer container (developer bag) through the filling port.

SUMMARY OF THE INVENTION

The present invention has solved the above-described problem, and a principal object of the present invention is to provide a developer accommodating unit in which a filling port can be easily sealed even when a developer is scattered and deposited at a periphery of the filling port after the developer is filled in a developer bag through the filling port.

According to an aspect of the present invention, there is provided a developer accommodating unit comprising: a developer bag in which a developer is incorporated, wherein the developer bag includes: a filling port for filling the developer; a filling region where the developer is filled; a non-filling region, provided outside the filling region, where the developer is not filled, and a folded portion formed by folding the filling region and the non-filling region, wherein the folded portion includes a welding portion.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

In FIG. 15, (d) to (f) are sectional illustrations, as seen from a non-filling region side, for illustrating a sealing state including a folding step of folding a developer bag and a fixing step of fixing a fixing member by causing the fixing member to penetrate through a non-filling region of a folded portion in Twentieth Embodiment.

In FIG. 16, (d) and (e) are sectional illustrations, as seen from a non-filling region side, for illustrating a sealing state including a folding step of folding a developer bag and a fixing step of fixing a fixing member by causing the fixing member to penetrate through a non-filling region of a folded portion in Twenty-first Embodiment.

In FIG. 17, (c) is a front illustration for illustrating a sealing step including a folding step of folding a developer bag of a developer accommodating unit according to the present invention and a fixing step of fixing a fixing member by causing the fixing member to penetrate through a non-filling region of a folded portion in Twenty-second Embodiment.

In FIG. 18, (c) is a front illustration for illustrating a sealing step including a folding step of folding a developer bag of a developer accommodating unit according to the present invention and a fixing step of fixing a fixing member by causing the fixing member to penetrate through a non-filling region of a folded portion in Twenty-third Embodiment.

In FIG. 19, (c) and (d) are sectional illustrations, as seen from the non-filling region side, for illustrating a sealing state including a folding step of folding a developer bag of a developer accommodating unit according to the present invention and a fixing step of fixing a fixing member by causing the fixing member to penetrate through a non-filling region of a folded portion in Eleventh Embodiment.

In FIG. 21, (d) to (f) are sectional illustrations, as seen from the non-filling region side, for illustrating the sealing state including the folding step of folding the developer bag and a fixing step of fixing a fixing member by causing the fixing member to penetrate through a non-filling region of a folded portion in Twelfth Embodiment.

In FIG. 22, (b) is a sectional illustration, for illustrating a sealing state including a folding step of folding a developer bag of a developer accommodating unit according to the present invention and a fixing step of fixing a fixing member by causing the fixing member to penetrate through a non-filling region of a folded portion in Fourteenth Embodiment.

In FIG. 28, (b) is a front illustration for illustrating a sealing step including a folding step of folding a developer bag of a developer accommodating unit according to the present invention and a fixing step of fixing a fixing member by causing the fixing member to penetrate through a non-filling region of a folded portion in Nineteenth Embodiment.

DESCRIPTION OF THE PREFERRED EMBODIMENTS

Embodiments of an image forming apparatus to which a process cartridge including a developer accommodating unit according to the present invention is detachably mountable will be specifically described with reference to the drawings.

First Embodiment

First, with reference to FIGS. 1 to 6, a constitution of the image forming apparatus, to which the process cartridge including the developer accommodating unit according to the present invention is detachably mountable in First Embodiment will be described.

Figure 2:
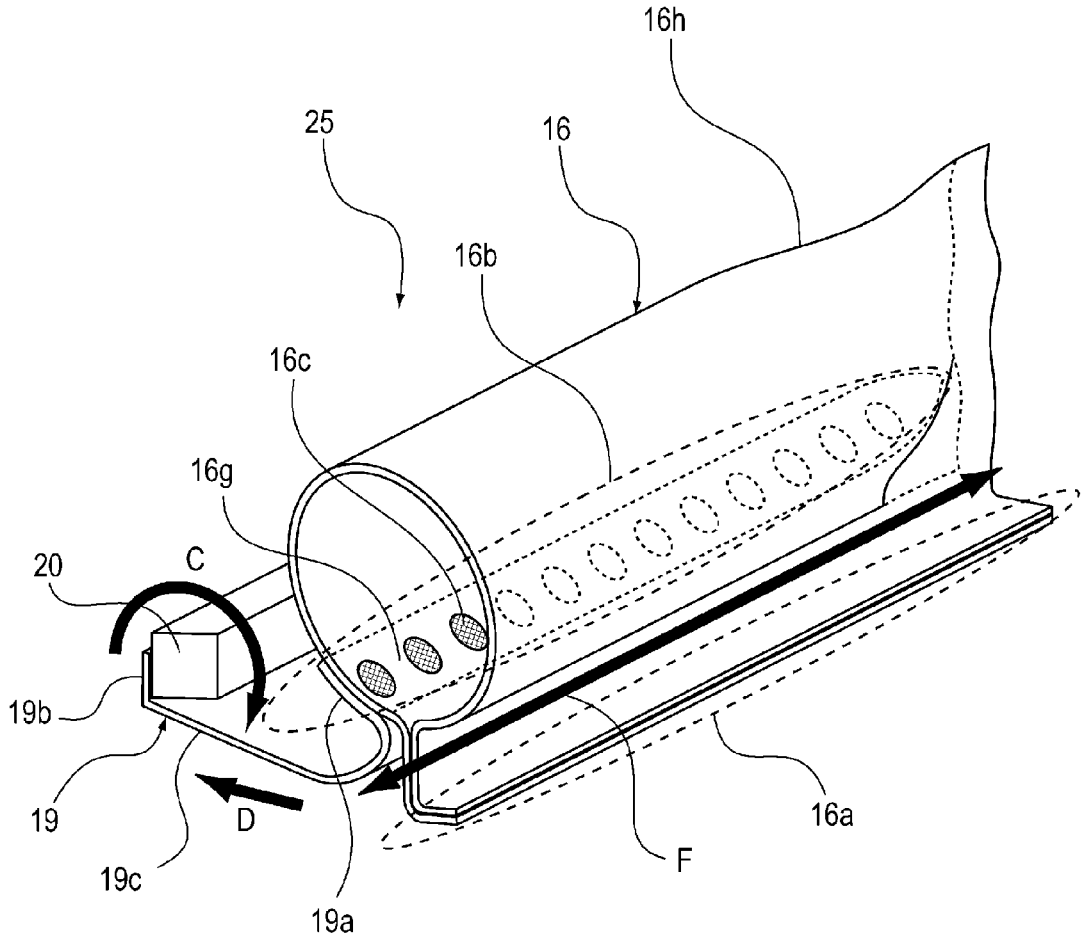
FIG. 2 is a perspective illustration showing a part of a developer bag, a sealing member and an unsealing member in the developer accommodating unit.

FIG. 2 is a sectional illustration showing a structure of the image forming apparatus to which the process cartridge including the developer accommodating unit according to the present invention is detachably mountable.

<Process Cartridge>

Figure 1:
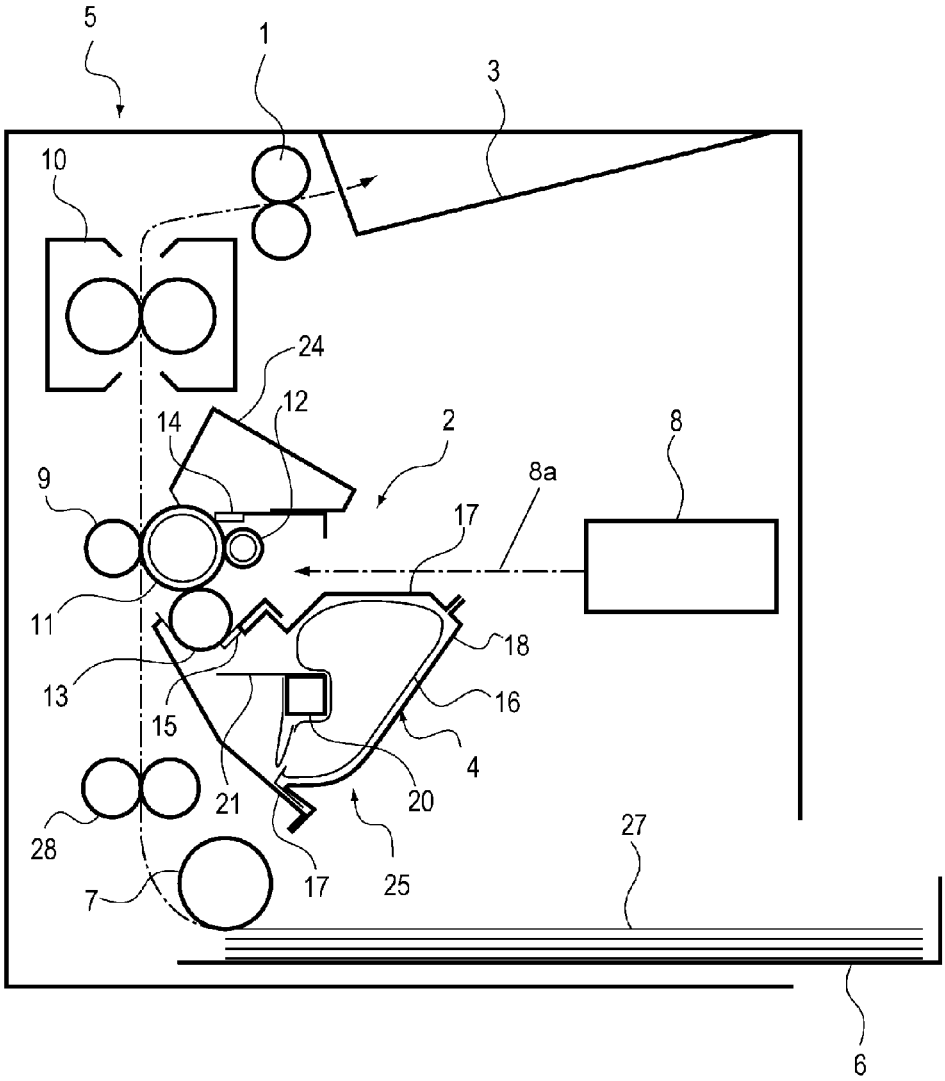
FIG. 1 is a sectional illustration showing a structure of an image forming apparatus to which a process cartridge including a developer accommodating unit according to the present invention is detachably mountable.

A process cartridge 2 shown in FIG. 1 includes a photosensitive drum 11 as an image bearing member for bearing an electrostatic latent image and includes an image forming process means actable on the surface of the photosensitive drum 11. Here, as the image forming process means, e.g., a charging roller 12 as a charging means for electrically charging the surface of the photosensitive drum 11 is used. Further, a developing device 4 as a developing means for forming a toner image on the surface of the photosensitive drum 11 and a cleaner unit 24 as a cleaning means for removing a developer (containing a toner, a carrier and the like) remaining on the surface of the photosensitive drum 11 are used.

The process cartridge 2 in this embodiment includes, as shown in FIG. 1, at a periphery of the photosensitive drum 11, the charging roller 12 as the charging means and the cleaning unit 24 as the cleaning means including a cleaning blade 14 having elasticity. Further, the process cartridge 2 includes the developing device 4 including a developing roller 13 and a developing blade 15. Further, the process cartridge 2 includes a developer accommodating unit 25 including frames 17 and 18 for supporting a developer bag 16 in which a toner 22 is accommodated, the developing roller 13 and the developing blade 15.

The cleaner unit 24 and the developer accommodating unit 25 are integrally assembled into the process cartridge 2, and the process cartridge 2 is, as shown in FIG. 1, constituted so as to be detachably mountable to a main assembly of the image forming apparatus 5.

<Image Forming Apparatus>

The process cartridge 2 is mounted in the main assembly of the image forming apparatus 5 as shown in FIG. 1 and then is used for image formation. In image formation, a sheet 27 as a recording material is fed, by a feeding roller 7, from a sheet cassette 6 mounted at a lower portion of the image forming apparatus 5. Further, oblique movement of the sheet 27 is corrected by a registration roller pair 28, and the sheet 27 is fed at predetermined timing to a transfer nip between the photosensitive drum 11 and a transfer roller 9 as a transfer means. In synchronism with a feeding operation of the sheet 27, the surface of the photosensitive drum 11 is subjected to selective exposure to laser light 8*a* emitted from a laser scanner 8 as an image exposure means, so that the electrostatic latent image is formed.

Thereafter, the toner 22 is carried in a thin layer on the surface of the developing roller 13 as a developer carrying member by the developing blade 15.

Then, by applying a developing bias voltage to the developing roller 13, the toner 22 is supplied depending on the electrostatic latent image formed on the surface of the photosensitive drum 11, so that a toner image is formed.

Then, by applying a transfer bias voltage to the transfer roller 9, the toner image formed on the surface of the photosensitive drum 11 is transferred onto the sheet 27 fed to the transfer nip between the photosensitive drum 11 and the transfer roller 9. The sheet 27 on which the toner image is transferred is fed into a fixing device 10 as a fixing means, in which the toner image is fixed on the sheet 27 under application of heat and pressure. The sheet 27 is discharged, by a discharging roller pair 1, onto a discharge portion 3 provided at an upper portion of the image forming apparatus 5.

<Developer Bag>

Figure 3:
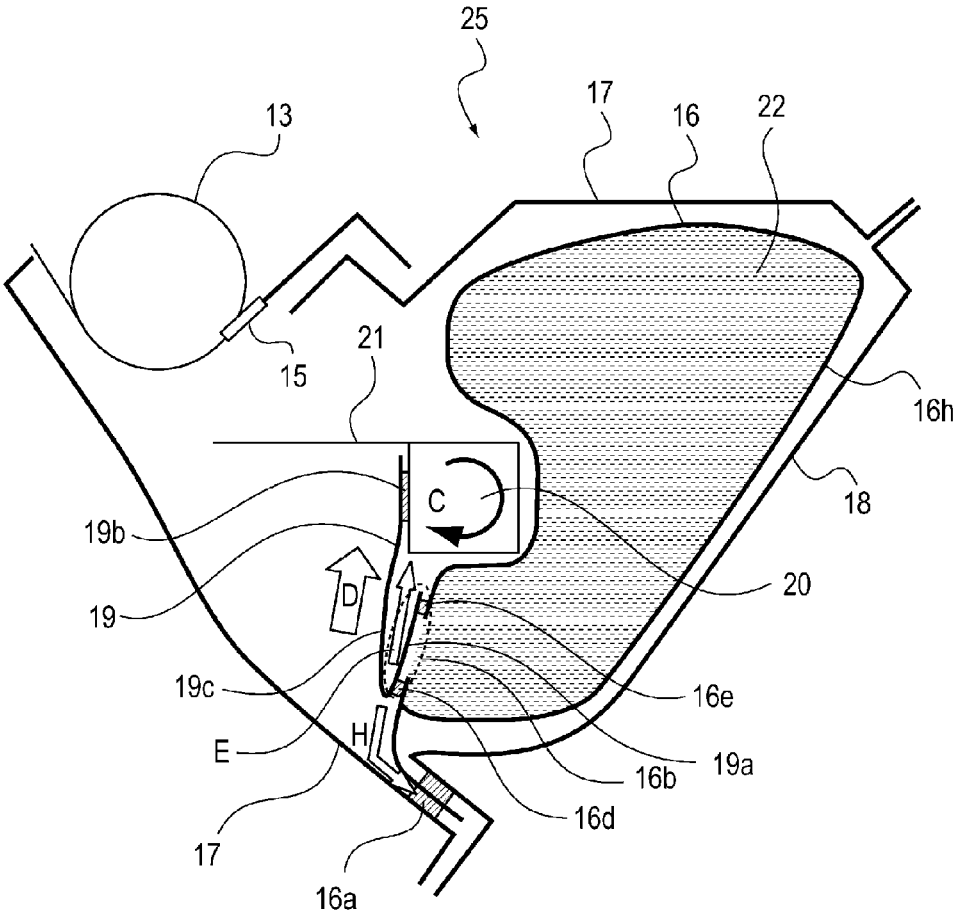
FIG. 3 is a sectional illustration of the developer accommodating unit.

Next, with reference to FIGS. 2 and 3, a constitution of the developer bag 16 and an unsealing operation of an opening 16*c* as a discharge opening through which the developer is to be discharged will be described. FIG. 3 is a perspective illustration showing a part of the developing bag 16, a sealing member covering the opening 16*c*, and an unsealing member 20 for unsealing the sealing member 19. FIG. 3 is a sectional illustration of the developer accommodating unit 25.

The developer bag 16 includes a discharge portion 16*b* for discharging the toner 22 accommodated therein. Further, the discharge portion 16*b* includes a plurality of openings 16*c* and connecting portions defining the openings 16*c* with respect to an arrow F direction of FIG. 2 substantially perpendicular to an arrow E direction in FIG. 3 in which unsealing advances.

As shown in FIG. 3, the sealing member 19 includes a sealing portion 19*a* covering the discharge portion 16*b*, a fixing portion 19*b* held by the unsealing member 20, and a connecting portion 19*c* connecting the sealing portion 19*a* and the fixing portion 19*b*. Further, as shown in FIG. 3, the connecting portion 19*c* is folded back and is bonded to a sealing portion 16*f* provided at a periphery of the openings 16*c* to seal the developer bag 16.

Next, fixing between the unsealing member 20 and the sealing member 19 and between the sealing member 19 and the developer bag 16 at respective portions will be described. As a fixing means at the respective portions, (thermal) welding, ultrasonic welding, bonding, pseudo bonding, and the like may be used. The fixing portion 19*b* of the sealing member 19 is fixed on the unsealing member 20. As the fixing means, in addition to the welding, the ultrasonic welding, the bonding, the pseudo bonding, and the like, it is possible to use clamping using a clip shape, hooking using a hole and a projection, and the like.

The developer bag 16, the sealing member 19 and the unsealing member 20 are accommodated in the frame 17 and are covered with the frame 18. The frames 17 and 18 are bonded by the welding, the bonding or the like. The developer bag 16 is provided with the fixing portion 16*a*. The fixing portion 16*a* is fixed on at least one of the frames 17 and 18 by, e.g., a double-side tape, a wedge-shaped member, the welding, the ultrasonic welding, the bonding or the like.

Next, with reference to FIGS. 2 and 3, the structure of the developer bag 16 will be described. The developer bag 16 is provided with the discharge portion 16*b* having the openings 16*c* as the discharge openings for permitting discharge of the toner 22. The discharge portion 16*b* is blocked by the sealing portion 19*a* of the sealing member 19.

Other sides of the developer bag 16 includes a fold-back portion of a bag member 16*h* and a bag-shaped portion obtained by strongly bonding portions of the bag member 16*h* by the welding, the ultrasonic welding, the bonding or the like.

In order to unseal the developer bag 16 at the openings 16*c*, there is a need to first peel off the discharge portion 16*b*. Accordingly, it is essential that strength of the bonding portion between the sealing member 19 and the developer bag 16, i.e., a peeling force therebetween is weakest. This is true for other portions.

It is essential that the peeling fold between the sealing member 19 and the developer bag 16 is weakest relative to a fixing force between the sealing member 19 and the unsealing member 20, a fixing force between the developer bag 16 and the frame 17 or 18, and the like.

On the other hand, the developer accommodating unit 25 is advantageous, from its function and the viewpoint of a sealing property for accommodating the toner 22 as the developer in the developer bag 16, when the peeling force between the sealing member 19 and the developer bag 16 is large to the possible extent. When the peeling force between the sealing member 19 and the developer bag 16 is large, in the case where an unexpected force (e.g., an impact force during drop or the like) is exerted, it is possible to obviate a state in which the sealing member 19 is unsealed (removed) in a state other than an intended state (in which the developer accommodating unit 25 is set in the main assembly of the image forming apparatus 5). From the above, there is a need to set the peeling force between the sealing member 19 and the developer bag 16 so as to be a desired value.

Next, a method of setting the peeling force between the sealing member 19 and the developer bag 16 at the desired value will be described. In this embodiment, in order to set the peeling force between the sealing member 19 and the developer bag 16 at the desired value (a minimum force within a range in which the toner sealing property can be maintained), two methods are principally employed.

In a first method, as the sealing member 19, a laminate material having a special sealant layer which exhibits an easy-peeling property (peeling strength of about 3N/15 mm in testing methods for heat sealed flexible packages according to JIS-Z0238) is applied. Further, the first method is a method in which the easy-peeling property is exhibited at the peeling portion between the sealing member 19 and the developer bag 16 by using, as the material (member) for the bag member 16*h* constituting the developer bag 16, a sheet material (of, e.g., polyethylene or polypropylene) which is weldable with the special sealant layer and which has flexibility. By changing a combination of formulation of the special sealant layer with the material to be bonded, the peeling force between the sealing member 19 and the developer bag 16 can be reduced.

A second method is a method in which as shown in FIG. 3, the discharge portion 16*b* of the developer bag 16 is placed in a state in which the sealing member 19 is folded back with respect to an unsealing direction (arrow E direction in FIG. 3. For example, in the state shown in FIG. 3, the sealing member 19 is pulled in an arrow D direction in FIG. 3 by rotating the unsealing member 20 in an arrow C direction in FIG. 3, whereby the developer bag 16 and the unsealing member 19 establish a positional relationship of inclination peeling (90-180 deg. peeling) as shown in FIG. 3.

It has been known that the peeling force required for peeling the sealing member 19 from the developer bag 16 can be reduced by performing the inclination peeling as described above. Accordingly, as shown in FIG. 3, by placing the sealing member 19 in the fold-back state at the discharge portion 16*b* of the developer bag 16 with respect to the arrow E direction which is the unsealing direction, it is possible to reduce the peeling force between the sealing member 19 and the developer bag 16.

Next, an effect obtained by this embodiment will be described. A shape of the bonding portion between the developer bag 16 and the sealing member 19 is devised and the laminate material having the special sealant layer which exhibits the easy-peeling property is used, whereby the developer bag 16 can be unsealed with a small peeling force (about 3N/15 mm at a portion to be unsealed).

<Manufacturing Method of Developer Bag and Sealing Member>

Figure 4:
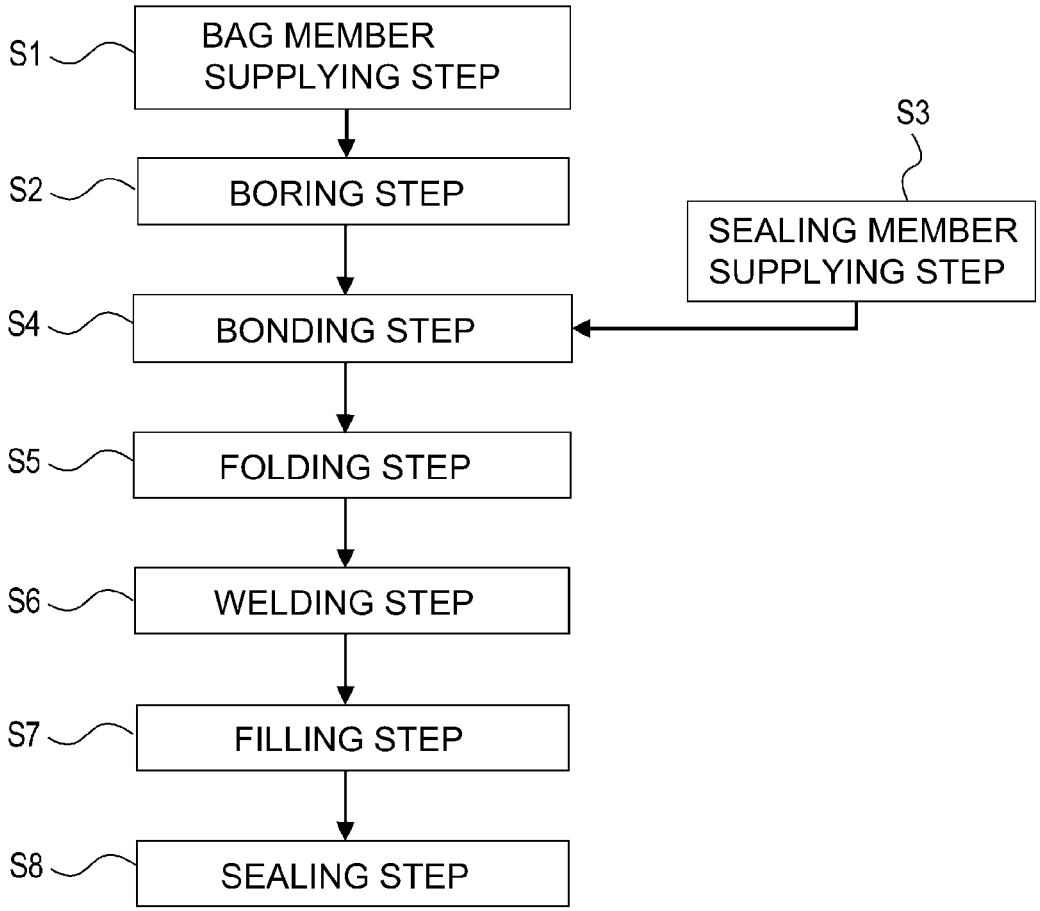
FIG. 4 is a flowchart showing a manufacturing method of the developer accommodating unit in First Embodiment.
Figure 15:
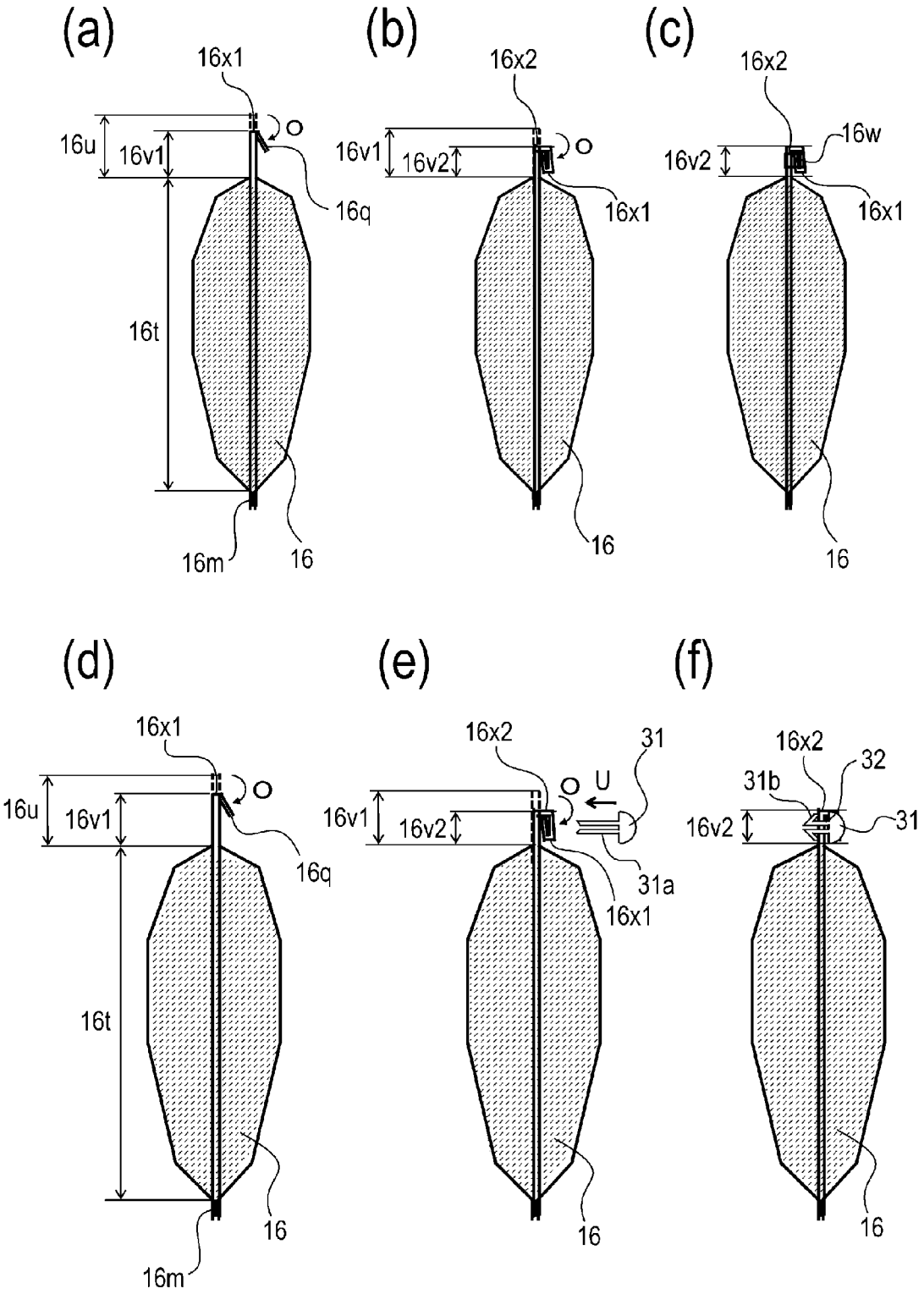
In FIG. 15, (a) to (c) are sectional illustrations, as seen from a non-filling region side, for illustrating the sealing step including the folding step of folding the developer bag and the welding step of welding the non-filling region of the folded portion in Sixth Embodiment.

FIG. 4 is a flowchart showing a procedure of a manufacturing method of the developer bag 16 and the sealing member 19 shown in FIGS. 2 and 3. Manufacturing steps of the developer bag 16 and the sealing member 19 shown in steps S1 to S5 in FIG. 4 will be described with reference to FIGS. 5 and 6. In FIG. 15, (a) to (e) are front illustrations for illustrating the manufacturing steps of the developer bag 16 and the sealing member 19. In FIG. 6, (a) to (f) are sectional illustrations showing the developer bag including one opening 16*c* of the plurality of openings 16*c*, as seen from a filling port 16*q* side where the toner 22 as the developer is to be filled, in the manufacturing steps shown in FIG. 5.

Figure 5:
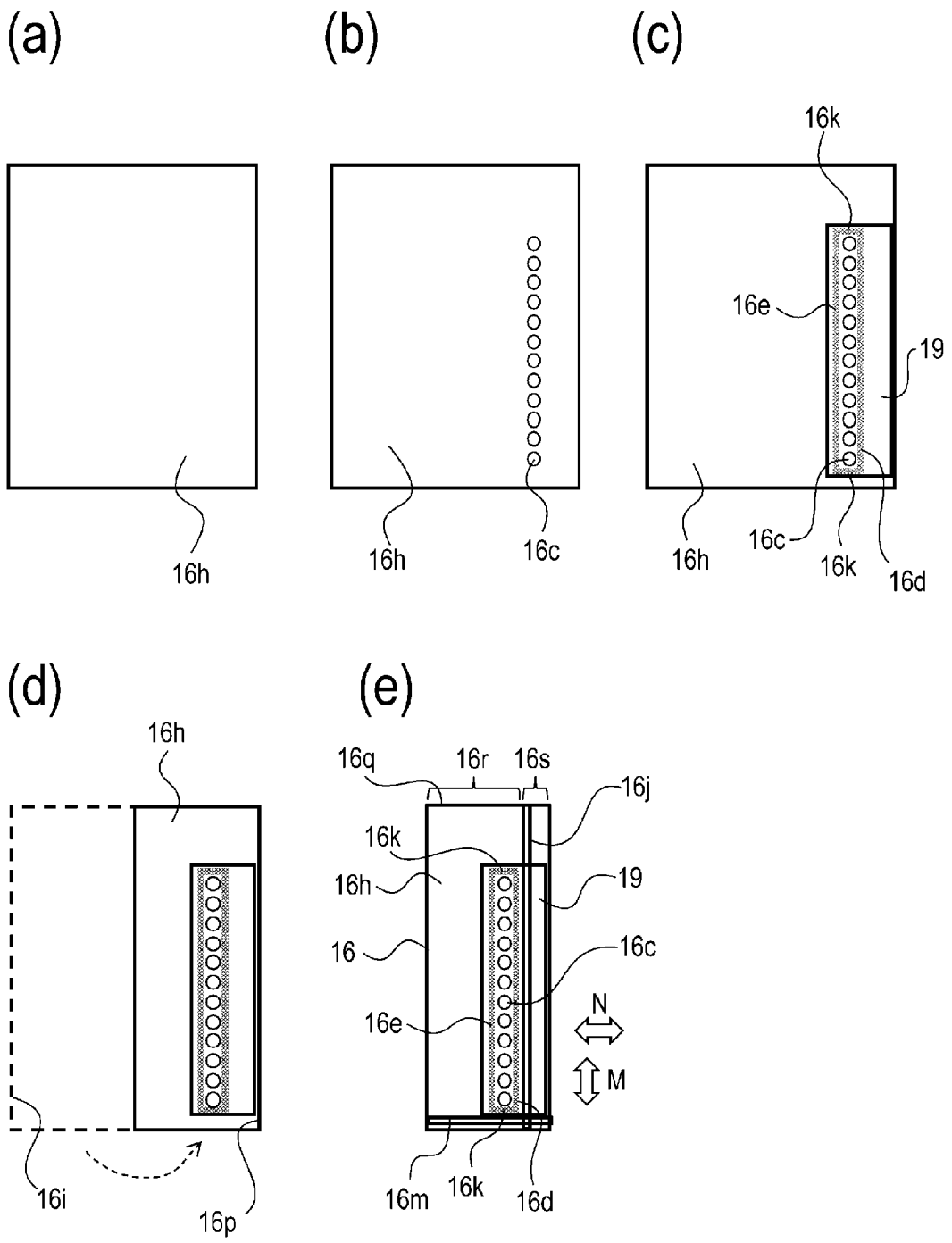
In FIG. 5, (a) to (e) are front illustrations showing the manufacturing method of a developer accommodating unit in First Embodiment.
Figure 6:
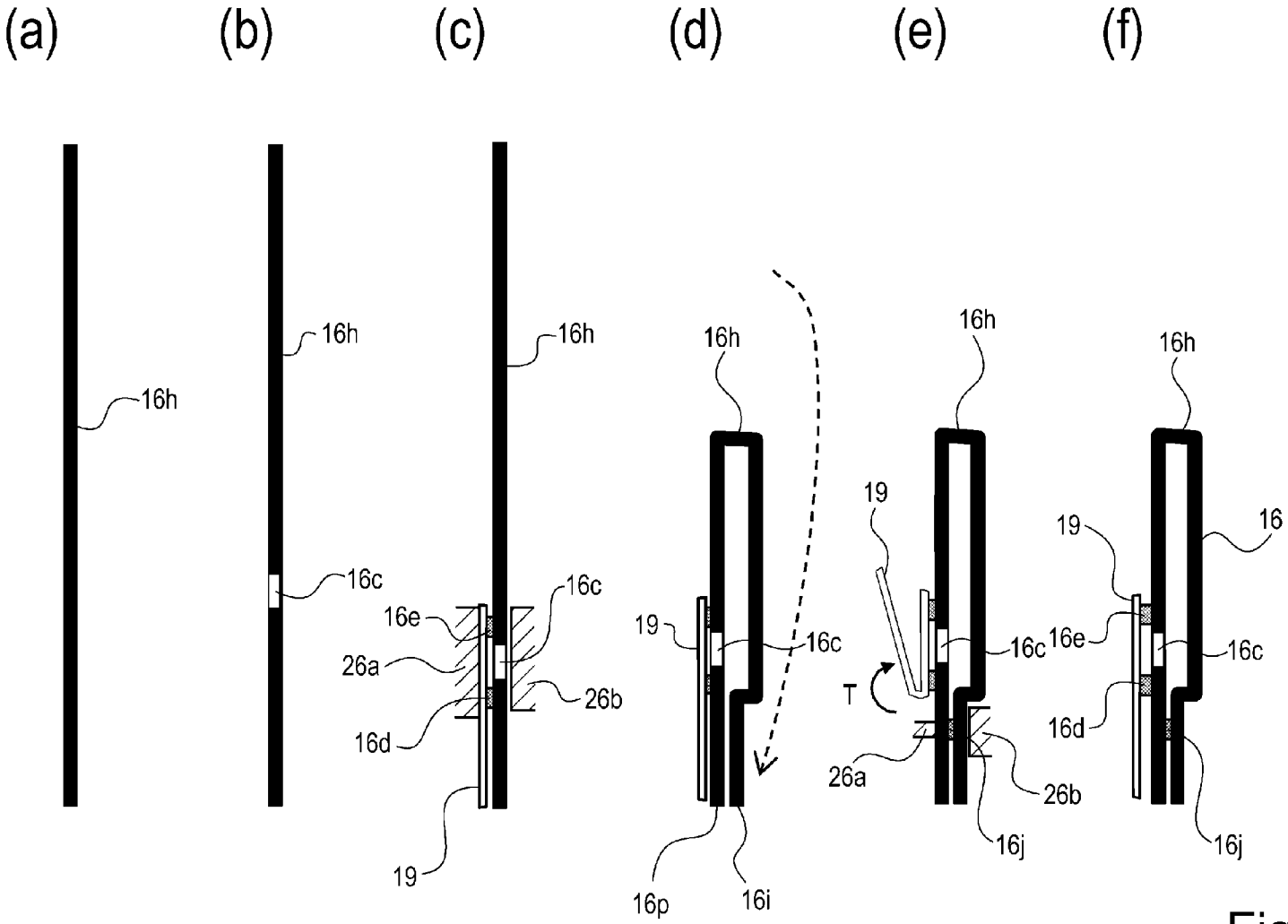
In FIG. 6, (a) to (f) are sectional illustrations of the developer accommodating unit including a single opening as seen from a filling port side.

In a bag member supplying step shown in the step S1 in FIG. 4, the bag member 16*h* shown in (a) of FIG. 5 and (a) of FIG. 6 is supplied to an unshown boring machine. The bag member 16*h* shown in (a) of FIG. 5 and (a) of FIG. 6 is a sheet-shaped member before being formed in a bag shape of the developer bag 16.

Then, in a boring step for openings shown in the step S2 in FIG. 4, the boring of the bag member 16*h* is made as shown in (b) of FIG. 5 and (b) of FIG. 6 by the unshown boring machine, so that the openings 16*c* are formed.

Then, in a sealing member supplying step shown in the step S3 in FIG. 4, the sealing member 19 shown in (c) of FIG. 5 and (c) of FIG. 6 is supplied by an unshown supplying device. The sealing member 16 supplied by the unshown supplying device is, as shown in (c) of FIG. 5 and (c) of FIG. 6, positionally aligned with the bag member 16*h* by an unshown positional alignment device.

Then, in a sealing member bonding (applying) step shown in the step S4 in FIG. 4, a heating (thermal) head 26*a* as a heating means increased in temperature up to a predetermined temperature is provided on the surface of the sealing member 19 in an opposite side from the developer bag 16*h*. Further, a receiving table 26*b* is provided in an opposite side from the sealing member 19 with respect to the developer bag 16*h*.

Then, the heating head 26*a* is pressed toward the receiving table 26*b* in a state in which the bag member 16*h* and the sealing member 19 are disposed therebetween, and predetermined pressure is applied for a predetermined time at a predetermined temperature, whereby the bag member 16*h* and the sealing member 19 are (thermally) welded to each other. As a result, the developer bag 16 includes a first welding portion 16*d* as a bonding portion where the unsealing is first performed, a second welding portion 16*e* as a bonding portion where the unsealing is performed later than the first welding portion 16*d*, and short-side welding portions 16*k* each connecting the first welding portion 16*d* and the second welding portion 16*e* outside the plurality of openings 16*c* provided at predetermined pitch with respect to the arrow F direction in FIG. 2.

Then, in a bag member folding step shown in the step S5 in FIG. 4, as shown in (d) of FIG. 5 and (d) of FIG. 6, the bag member 16*h* is folded back by an unshown folding device so that a fold-back edge portion 16*i* is disposed to extend in the same direction as another edge portion 16*p*. At this time, the bag member 16*h* is folded back so that the fold-back edge portion 16*i* and another edge portion 16*p* are positionally aligned so as to be coincide with each other.

Then, in a bag member welding step shown in step S6 in FIG. 4, as shown in (e) of FIG. 5 and (e) and (f) of FIG. 6, the bag member 16*h* folded back as shown in (d) of FIG. 6 is bonded by welding, and thus is formed in a bag shape. As shown in (e) of FIG. 6, by an unshown folding device, the sealing member 19 is folded back in an arrow T direction which is a fold-back direction from the first welding portion 16*d* toward the second welding portion 16*e*.

Then, similarly as in the sealing member bonding step described above with reference to (c) of FIG. 6, the heating head 26*a* is pressed toward the receiving table 26*b* in a state in which the fold-back bag member 16*h* is disposed therebetween and apply predetermined pressure to the bag member 16*h* for a predetermined time at a predetermined temperature, so that portions of the bag member 16*h* are welded to each other.

At this time, bonding portions 16*j* and 16*m* shown in (e) of FIG. 5 are formed. The bonding portion 16*j* shown in FIG. 5 is formed along an arrow M direction in (e) of FIG. 5. The arrow M direction in (e) of FIG. 5 is a longitudinal direction of the developer bag 16. The bonding portion 16*m* shown in (e) of FIG. 5 is formed along an arrow N direction which is a short direction of the developer bag 16 perpendicular to the longitudinal direction of the developer bag 16.

By the formation of the bonding portions 16*j* and 16*m* shown in (e) of FIG. 5, the sheet-shaped bag member 16*h* is formed in a bag shape. In this embodiment, the bonding portion 16*j* extending in the longitudinal direction of the developer bag 16 and the bonding portion 16*m* extending in the short direction of the developer bag 16 cross with each other in a cross-shape as shown in (e) of FIG. 5. The bonding portions 16*j* and 16*m* may also be constituted in a continuous L-shape. Further, the welding of the bonding portion 16*j* extending in the longitudinal direction of the developer bag 16 and the welding of the bonding portion 16*m* extending in the short direction may also be performed in separate steps.

Figure 16:
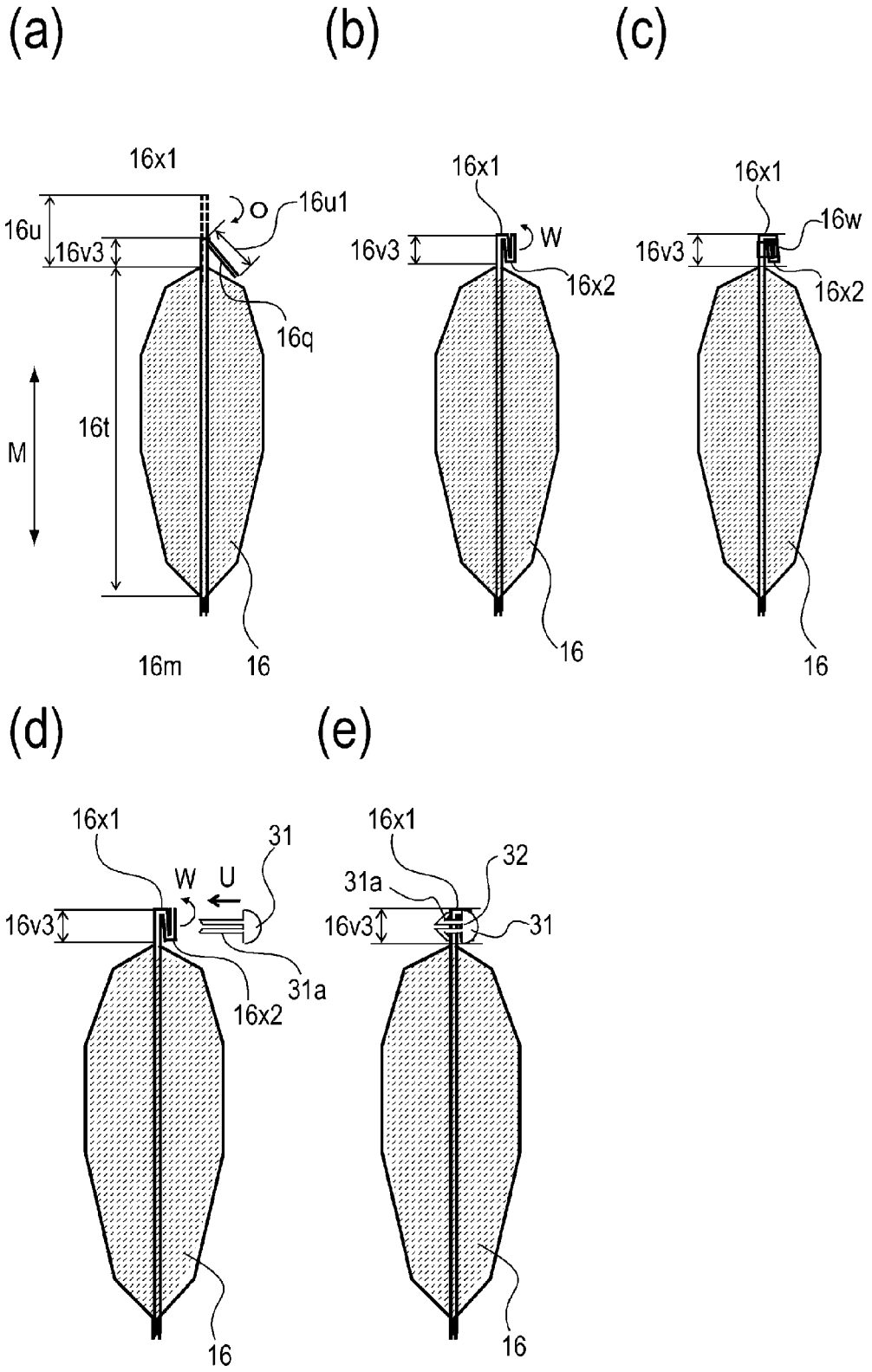
In FIG. 16, (a) to (c) are sectional illustrations, as seen from a non-filling region side, for illustrating the sealing step including a folding step of folding a developer bag of a developer accommodating unit according to the present invention and a welding step of welding a non-filling region of a folded portion in Seventh Embodiment.

The bonding portion 16*m* is provided at a longitudinal end portion of the developer bag 16, formed in the bag shape, with respect to the arrow M direction of (e) of FIG. 16. The bonding portion 16*m* is formed along the short direction, of the developer bag 16, which is the arrow N direction shown in (e) of FIG. 5. A filling port 16*q* formed in a side opposite from the bonding portion 16*m* is an opening for filling the toner 22 as the developer into the developer bag 16 in a developer filling port step shown in a step S7 in FIG. 4.

As shown in (e) of FIG. 5, the developer bag 16 includes, with the bonding portion 16*j* as a boundary, a filling region 16*r* in which the toner 22 is filled and a non-filling region 16*s*, provided outside the filling region 16*r*, in which the toner 22 is not filled.

The filling region 16*r* is a region in a left side, with respect to the short direction of the developer bag 16 which is the arrow N direction shown in (e) of FIG. 5, of the bonding portion 16*j* formed along the longitudinal direction of the developer bag 16 which is the arrow M direction shown in (e) of FIG. 5, and in the filling region 16*r*, the filling port 16*q* is formed. Further, the filling region 16*r* is a region in an upper side, with respect to the longitudinal direction of the developer bag 16 which is the arrow M direction shown in (e) of FIG. 5, of the bonding portion 16*m* formed along the short direction of the developer bag 16 which is the arrow N direction shown in (e) of FIG. 5, and in the upper side, the filling port 16*q* is formed.

Further, the non-filling region 16*s* extends in the short direction of the developer bag 16 which is the arrow N direction shown in (e) of FIG. 5, and includes the bonding portion 16*j* formed along the longitudinal direction of the developer bag 16 which is the arrow M direction shown in (e) of FIG. 5. Further, the non-filling region 16*s* is a region outside (in the right side in (e) of FIG. 5) the filling region 16*r* with respect to the short direction of the developer bag 16 which is the arrow N direction shown in (e) of FIG. 5.

Further, the non-filling region 16*s* extends in the longitudinal direction of the developer bag 16 which is the arrow M direction shown in (e) of FIG. 5, and includes the bonding portion 16*m* formed along the short direction of the developer bag 16 which is the arrow N direction shown in (e) of FIG. 5. Further, the non-filling region 16*s* is a region outside (in the lower side in (e) of FIG. 5) the filling region 16*r* with respect to the longitudinal direction of the developer bag 16 which is the arrow N direction shown in (e) of FIG. 5. The non-filling region 16*s* includes the bonding portion 16*j* as the second welding portion for forming the filling port 16*r*.

In this way, the developer bag 16 including the filling region 16*r* having the filling port 16*q* and the non-filling region 16*s* is formed. The thus-manufactured developer bag 16 is freely deformed using flexibility of the bag member 16*h*, and thus is capable of having an inside space. For this reason, the toner 22 can be accommodated inside the developer bag 16.

<Filling Step of Developer into Developer Bag>

Figure 7:
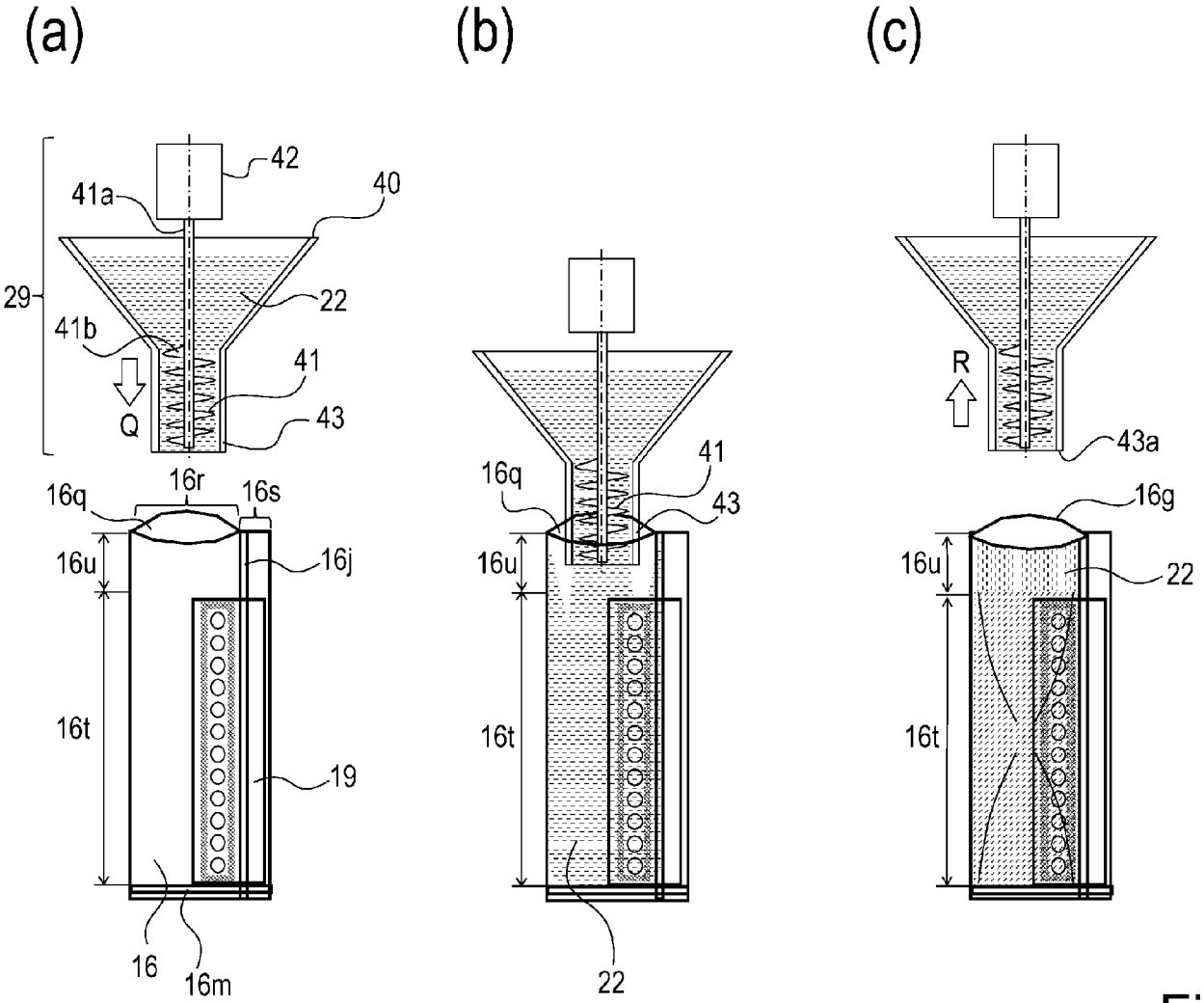
In FIG. 7, (a) to (c) are front illustrations for illustrating a developer filling step of filling the developer into the developer bag.

Next, with reference to FIG. 7, a developer filling step into the developer bag 16 shown in step S7 in FIG. 4. In FIG. 7, (a) to (c) are schematic views for illustrating the developer filling step in which the toner 22 as the developer is filled in the developer bag 16 through the filling port 16*q*.

The developer bag 16 formed in the bag shape in the bag member welding step shown in the step S6 of FIG. 4 is raised and opened as shown in (a) of FIG. 7, and then the toner 22 as the developer is filled in the filling region 16*r*. For the filling of the toner 22, a well-known screw filling device 29 shown in FIG. 7 is used.

The screw filling device 29 includes, as shown in (a) of FIG. 7, a hopper 40 and a screw 41 having a helical blade 41*b* formed on an outer peripheral surface of the rotation shaft 41*a*. Further, the screw filling device 29 is constituted by including a motor 42 for rotating the screw 41 and a casing 43 which is connected with the hopper 40 and which surrounds an outer periphery of the screw 41.

The toner 22 is, after being placed in the hopper 40, pushed out through an opening 43*a* of the casing 43, mounted on the bottom of the hopper 40, by rotation of the screw 41. At this time, with respect to a filling amount of the toner 22, a total number of rotation of the screw is controlled by controlling the number of rotation of the motor 42, so that the toner 22 in a certain amount can be filled (accommodated) in the developer bag 16.

As shown in (a) of FIG. 7, the developer bag 16 is set at a filling position immediately below the casing 43 of the screw filling device 29. In a state in which the filling port 16*q* of the developer bag 16 is widely opened, the casing 43 can be inserted into the developer bag 16. The filling port 16*q* of the developer bag 16 can be widely opened in a size larger than an outer diameter of the casing 43, and a spacing for permitting easy insertion of the casing 43 is created.

In (a) of FIG. 7, a shape of the opened filling port 16*q* of the developer bag 16 is a substantially elliptical shape. The shape of the opened casing 43 may only be required to have a diameter in which the casing is insertable into the developer bag 16, and may also be a circular shape or a rectangular shape. As a means for opening (extending) the filling port 16*q* of the developer bag 16, it is possible to use a method of extending the filling port 16*q* by air suction at an outer periphery of the filling port 16*q* or a method of widely opening the filling port 16*q* by mechanically chucking the filling port 16*q*.

Next, as shown in (b) of FIG. 7, the screw filling device 29 is moved in a screw insertion direction shown as an arrow Q direction in (a) of FIG. 7. As a result, the screw 41 and the casing 43 are inserted into the developer bag 16 through the filling port 16*q* of the developer bag 16. After, the screw 41 and the casing 43 are inserted in the developer bag 16, the motor 42 is rotationally driven, so that the screw 41 is rotated. As a result, the toner 22 accommodated in the hopper 40 is pushed out by the screw 41, and thus is filled in the developer bag 16.

When the filling of the toner 22 is made without inserting the screw 41 and the casing 43 into the developer bag 16 through the filling port 16*q*, the toner 22 scatters over the outside of the developer bag 16. As a result, an outer appearance of the developer bag 16 and a periphery of the device are contaminated with the toner 22.

The screw 41 and the casing 43 are inserted into the developer bag 16 through the filling port 16*q*, and then the filling of the toner 22 is made. When the filling of the toner 22 advances and is in a filling completion stage, the surface of the powder of the toner 22 in a filling portion 16*t* becomes high. For this reason, the toner 22 risen up during the filling is liable to issue from the filling port 16*q*.

In this embodiment, the filling region 16*r* of the developer bag 16 includes a filling portion 16*t* where the toner 22 is actually filled and a folding margin portion 16*u* having a predetermined length outside the filling portion 16*t* in the filling port 16*q* side.

For that reason, it is possible to suppress the issuing, from the filling port 16*q*, of the toner 22 filled in the filling portion 16*t*. At this time, between the outer peripheral surface of the casing 43 and the inner peripheral surface of the filling port 16*q*, the spacing for permitting easy insertion of the casing 43 is provided. For this reason, the toner 22 risen up when being filled in the filling portion 16*t* is deposited on the inner peripheral surface of the fold margin portion 16*u* in no small amount.

Figure 9:
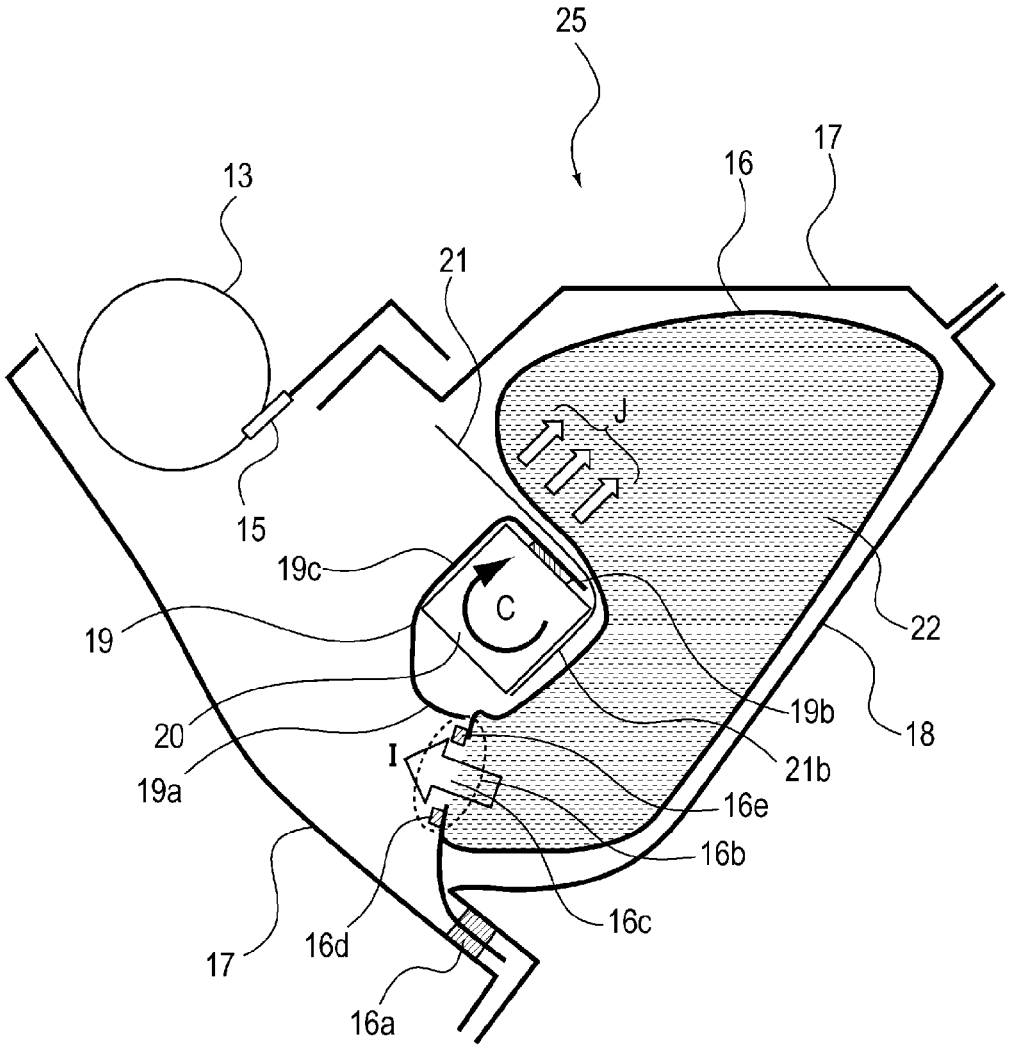
FIG. 9 is a sectional illustration of the developer accommodating unit.

As shown in (c) of FIG. 9, the toner 22 is filled in the filling portion 16*t* while leaving the folding margin portion 16*u*. After the filling of the toner 22, the screw filling device 29 is moved and retracted in a screw pulling-out direction shown as an arrow R direction in (c) of FIG. 17. Then, the developer filling step of filling the toner 22 in the developer bag 16 through the filling port 16*q* of the developer bag 16 in the step S7 shown in FIG. 4 is completed.

In this embodiment, the filling of the toner 22 through the filling port 16*q* of the developer bag 16 was made using the well-known screw filling device 29. Another method having a similar function may also be employed. Further, when the screw 41 and the casing 43 were inserted into the developer bag 16 through the filling port 16*q*, the screw filling device 29 was moved relative to the developer bag 16. Another method of, e.g., moving the developer bag 16 relative to the screw filling device 29 may also be used.

<Filling Port Sealing Step of Developer Bag>

In the developer filling step shown in FIG. 7, when the toner 22 is filled in the filling portion 16*t*, as shown in (c) of FIG. 7, the toner 22 risen up is deposited on the inner peripheral surface of the folding margin portion 16*u* in no small amount. If the toner 22 is not deposited on the inner peripheral surface of the folding margin portion 16*u*, the filling port 16*q* can be sealed up by subjecting the folding margin portion 16*u* to welding similarly as in the bag member welding step shown as the step S6 in FIG. 4 under a condition of a predetermined temperature, a predetermined pressure and a predetermined time.

However, the toner 22 deposits on the inner peripheral surface of the folding margin portion 16*u*, and therefore the toner 22 is interposed between the bonded portions (e.g., between polyethylene portions or between polypropylene portions) of the developer bag 16, so that a welding performance is remarkably inhibited.

Further, when the welding of the folding margin portion 16*u* is made in a state in which the toner 22 deposits on the inner peripheral surface of the folding margin portion 16*u*, the toner 22 is melted, and thus particles of the toner 22 are agglomerated. Further, when the agglomerated toner enters the filling portion 16*t* of the developer bag 16, as described later, when image formation is effected after unsealing of the developer bag 16 is made, image defect generates due to the agglomerated toner in some cases.

An example of the case where the image defect generates due to the agglomerated toner will be described. In recent years, particle size reduction of the toner 22 advances, so that high-definition image formation is achieved. When the particles of the toner 22 are melted and agglomerated, the agglomerated toner has a size which is many times larger than the original size of the toner 22. The toner 22 distributed averagely in a small size is carried in a thin layer on the surface of the developing roller 13 by the developing blade 15. At this time, when the agglomeration toner is mixed with the small-sized toner 22, the agglomerated toner has an irregular shape and a large particle size, and therefore clogs between the developing roller 13 and the developing blade 15 which regulates a layer thickness of the toner 22. When such a phenomenon occurs, a stripe generates with respect to a circumferential direction (rotational direction) of the developing roller 13, so that an image defect which is called a development stripe generates.

Figure 8:
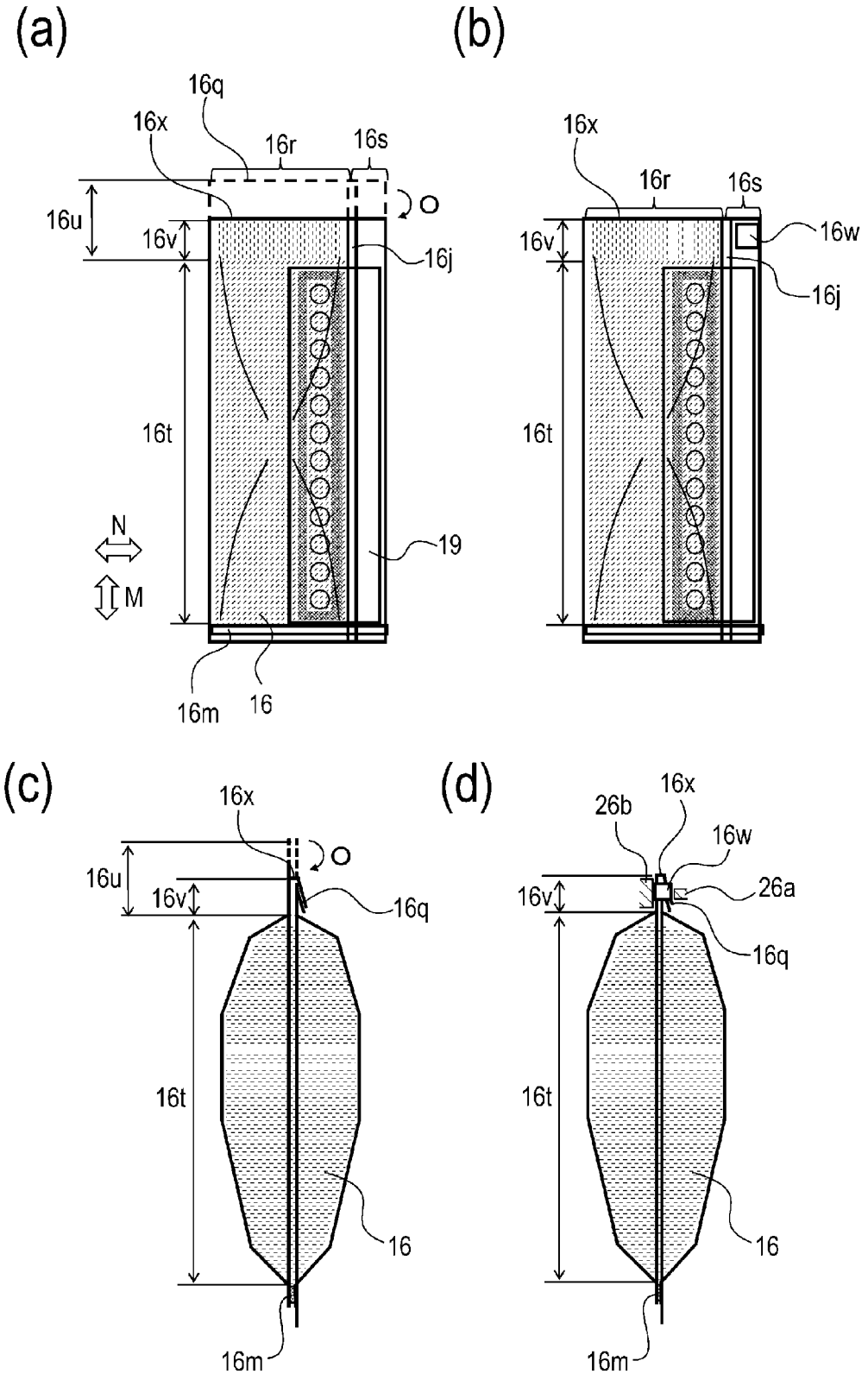
In FIG. 8, (a) and (b) are front illustrations for illustrating a sealing step including a folding step of folding the developer bag and a welding step of welding a non-filling region of a folded portion in First Embodiment, and (c) and (d) are sectional illustrations, as seen from a non-filling region side, for illustrating the sealing step including the folding step of folding the developer bag and the welding step of welding the non-filling region of the folded portion in First Embodiment.

Therefore, in this embodiment, as shown in FIG. 8, a folded portion 16*v* formed by folding the filling region 16*r* and the non-filling region 16*s* of the developer bag 16 along the same fold 16*x* is provided. Further, in the non-filling region 16*s* of the folded portion 16*v*, a welding portion 16*w* is provided. As a result, the sealing of the filling port 16*q* is made.

First, with reference to FIG. 8, a filling port sealing step of sealing the filling port 16*q* of the developer bag 16 shown in the step S8 of FIG. 4 will be described. In FIG. 8, (a) and (b) are front illustrations for illustrating the sealing step of the filling port 16*q* of the developer bag 16, and (c) and (d) are sectional illustrations of the developer bag 16 as seen from the non-filling region 16*s* side.

In (a) and (c) of FIG. 8, a folding step of forming the folded portion 16*v* by folding the folding margin portion 16*u* in the filling region 16*r* of the developer bag 16 in which the toner 22 is filled in the developer filling step shown in the step S7 of FIG. 4 is shown. In the folding step, the folded portion 18*v* is formed by integrally folding the folding margin portion 16*u* in the filling region 16*r* and the folding margin portion 16*u* in the non-filling region 16*s* along the fold 16*x* in a folding direction shown as an arrow O direction in (a) and (c) of FIG. 8.

The developer bag 16 is formed of the flexible sheet material, and therefore is capable of being easily folded. With respect to a vertical length of the folded portion 16*v* in FIG. 8, the folding margin portion 16*u* is folded so that the vertical length of the folded portion 16*v* is about ½ of the vertical length of the folding margin portion 16*u* in FIG. 8 with respect to the folding direction shown in as the arrow O direction in (a) and (c) of FIG. 8.

In (b) and (d) of FIG. 8, a welding step of forming the welding portion 16*w* by welding the folded portion 16*v* in the non-filling region 16*s* where the toner 22 is not interposed between opposing portions of the inner peripheral surface of the folded portion 16*v* folded in the above-described folding step is shown.

By manufacturing the developer bag 16 in the above-described manner, a shape of the folded portion 16*v* can be maintained, so that the filling port 16*q* can be sealed up.

The welding for forming the welding portion 16*w* is made, as shown in (d) of FIG. 8, in a manner such that the folded portion 16*v* is sandwiched between the heating head 26*a* increased in temperature up to the predetermined temperature and the receiving table 26*b*, and then both of the head 26*a* and the table 26*b* are pressed toward each other for a predetermined time at predetermined pressure. At this time, the welding is made in the non-filling region 16*s* of the folded portion 16*v*, and therefore the toner 22 does not deposit between opposing surfaces to be welded, so that the welding portion 16*w* can be formed without melting the toner 22.

Further, in this embodiment, the welding portion 16*w* is subjected to the welding at a position outside the bonding portion 16*j* extending along the longitudinal direction (vertical direction of (b) of FIG. 8) of the developer bag 16 which is the welding portion for forming the non-filling region 16*s*. As a result, between the filling region 16*r* and the welding portion 16*w*, the spacing including the bonding portion 16*j* is provided. By this spacing, during the welding performed by pressing the heating head 26*a* and the receiving table 26*b* toward each other, it is possible to suppress temperature rise of the toner 22 in the filling region 16*r* due to heat conduction between air and the sheet material constituting the developer bag 16.

As shown in FIG. 8, the folded portion 16*v* is folded so that a free end portion of the folding margin portion 16*u* is folded back about 180 degrees to provide the fold 16*x*. As a result, rigidity (stiffness) of the folded portion 16*v* is increased, so that a shape of the folded portion 16*v* is easily maintained by the welding portion 16*w*.

The folded portion 16*v* is held in a shape such that the free end portion of the folding margin portion 16*u* is folded back about 180 degrees to provide the fold 16*x*. By folding back the folding margin portion 16*u*, an inside space of the folding margin portion 16*u* is divided into a plurality of spaces, so that a labyrinth-like space is formed as a non-contact sealing space. As a result, it is possible to prevent the issuing of the toner 22, from the filling port 16*q*, accommodated in the filling portion 16*t* of the developer bag 16.

<Unsealing Operation of Developer Bag>

Next, with reference to FIGS. 2, 3 and 9, unsealing of the developer bag will be described. An unsealing member 20 is rotated in an arrow C direction of FIGS. 2 and 3 by an unshown driving means such as a motor. With the rotation of the unsealing member 20, the sealing member 19 fixed on the unsealing member 20 is pulled in an arrow D direction of FIGS. 2 and 3. On the other hand, the developer bag 16 is fixed in the frames 17 and 18 at the fixing portion 16*a*.

For this reason, first, a force in an arrow H direction of FIG. 3 is exerted on the first welding portion 16*d* provided in an upstream side of an unsealing direction of the sealing member 19 and the developer bag 16, so that unsealing of the discharge portion 16*b* is started. With advance of the rotation of the unsealing member 20 in the arrow C direction of FIG. 3, the unsealing advances in the arrow E direction of FIG. 3 and thus the opening 16*c* is exposed, and finally the second welding portion 16*e* in a downstream side of the unsealing direction is peeled off to complete the unsealing. The toner 22 accommodated inside the developer bag 16 is discharged through the opening 16*c* of the discharge portion 16*b* in the arrow I direction.

<Connecting Portion>

A constitution of the connecting portions 16*g*, defining the opening 16*c*, performing a large function in the unsealing operation of the developer bag 16 will be described. The discharge portion 16*b* includes a plurality of openings 16*c* with a predetermined pitch along the arrow F direction of FIG. 2 with is a direction substantially perpendicular to the arrow E direction of FIG. 3 in which the unsealing of the sealing member 19 advances. For that reason, also a plurality of connecting portions 16*g*, as portions other than the openings 16*c* of the discharge portion 16*b*, defining the openings 16*c* are disposed with a predetermined pitch along the arrow F direction of FIG. 2.

As a result, the plurality of connecting portions 16*g* connect the first welding portion 16*d* and the second welding portion 16*e* with respect to the arrow E direction in which the unsealing of the discharge portion 16*b*. For that reason, in a state in which the unsealing of the first welding portion 16*d* is ended, a peeling force for peeling the unsealing member 20 from the developer bag 16 at the second welding portion 16*e* can be transmitted. For that reason, also the second welding portion 16*e* can be unsealed.

For example, the case where it becomes difficult to unseal the sealing member 19 in a constitution of a comparison example in which there is no connecting portion 16*g* and a single opening 16*c* is provided will be described. After peeling of the first welding portion 16*d* is ended, the unsealing member 20 rotates in the arrow C direction of FIG. 3, so that the sealing member 19 is pulled in the arrow D direction of FIG. 3 as a direction of pulling the sealing member 19.

In this case, a pulling force acting on the second welding portion 16*e* does not provide a positional relationship of inclination peeling (90°-180° peeling) as shown in FIG. 3, and provides shearing peeling (approximately 0° peeling). For this reason, it becomes difficult to peel off the second welding portion 16*e*.

For that reason, in the neighborhood of a longitudinal central portion of the second welding portion 16*e*, the singly opening 16*c* is largely open. As a result, a part of the developer bag 16 having the second welding portion 16*e* is wound about the unsealing member 20 and thus the unsealing cannot be performed in some cases.

<Unsealing Means>

The unsealing member 20 as an unsealing means is constituted in a shaft shape such that the unsealing member 20 is rotatably supported by the frame 17. The unsealing member 20 in this embodiment has the shaft shape which is rectangular in cross-section. The fixing portion 19*b* is fixed on one side (surface) of the rectangular shaft, and a flexible sheet-shaped urging member 21 for urging the developer bag 16 is fixed on another side (surface) of the rectangular shaft. The urging member 21 functions not only as a stirring means for stirring the toner 22 discharged through the openings 16*c* of the developer bag 16 but also as a feeding means for feeding the toner 22 toward the developing roller 13.

<Discharging Operation of Developer from Developer Bag>

After the unsealing of the sealing member, when the unsealing member 20 further rotates in the arrow C direction of FIG. 9, also the urging member 21 for urging (pushing) the developer bag 16 fixed to the unsealing member 20 rotates about the unsealing member 20. Then, the sealing member 19 slides on the surface of the developer bag 16 and is wound around the outer peripheral surface of the unsealing member 20 by being pushed toward the unsealing member 20 by an elastic restoring force of the developer bag 16.

The urging member 21 has elasticity, and therefore as shown in FIG. 9, the urging member 21 slides on the surface of the developer bag 16 and pushes the surface of the developer bag 16 in an arrow J direction so as to be restored to an original shape while being pushed toward the unsealing member 20. For that reason, the developer bag 16 is pushed in the arrow J direction of FIG. 9 by the unsealing member 2, and an inside volume thereof decreases, so that the toner 22 accommodated inside the developer bag 16 is pushed out through the openings 16*c* and is discharged in the arrow I direction of FIG. 9.

Then, when the unsealing member 20 further rotates in the arrow C direction of FIG. 9, the urging member 21 is spaced from the developer bag 16. At this time, the developer bag 16 has elasticity, and therefore the developer bag 16 expands so as to be restored to a state before being urged by the urging member 21. When the unsealing member 20 further rotates in the arrow C direction of FIG. 9, also the urging member 21 integrally rotates, and urges the developer bag 16 again, so that the toner 22 is discharged through the openings 16*c*. By repeating such a cycle, the toner 22 accommodated inside the developer bag 16 is discharged through the openings 16*c*.

In this embodiment, only by pulling the sealing member 19 in one direction (arrow D direction of FIG. 3), the unsealing can be performed, so that the developer bag 16 can be stably opened with reliability. Further, the sealing member 19 can be unsealed by being pulled in a short direction (arrow D direction of FIG. 3) of the process cartridge 2. For this reason, as described above in the conventional example, a peeling distance which is about 2 times a full longitudinal length of the process cartridge can be remarkably shortened.

Further, the sealing member 19 is fixed on the unsealing member 20 after being unsealed, so that the sealing member 19 can be unsealed without generating a waste material. Further, by the urging member 21, also the discharge of the toner 22 from the inside of the developer bag 16 is made with reliability.

Further, the sealing member 19 after being unsealed can rotate together with the unsealing member 20. For this reason, a stirring effect of the toner 22 in the process cartridge 2 can be expected.

Further, the developer bag 16 has the bag shape, and therefore the developer bag 16 accommodating the toner 22 therein can be treated as a single unit. For this reason, the developer filling step of filling the toner 22 in the developer bag 16 can be separated from an assembling step of the process cartridge 2.

Further, in the weldable developer bag 16, the filling port 16*q* can be sealed up without causing the agglomeration of the particles of the toner 22.

Second Embodiment

Next, with reference to FIGS. 10 and 11, a constitution of Second Embodiment of an image forming apparatus to which a process cartridge including a developer accommodating unit according to the present invention is detachably mountable will be described. Constituent elements similar to those in First Embodiment will be omitted from illustration by adding the same reference numerals or symbols or adding the same member names even when the reference numerals or symbols are different.

In First Embodiment, as shown in FIG. 5, the folding margin portion 16*u* provided at a periphery of the filling port 16*q* of the developer bag 16 formed in a bag shape by folding a single sheet-shaped bag member 16*h* is folded back along the fold 16*x*. Then, a constitution in which the welding portion 16*w* is provided in the non-filling region 16*s* of the folded portion 16*v* and thus the filling port 16*q* is sealed up was described.

Figure 11:
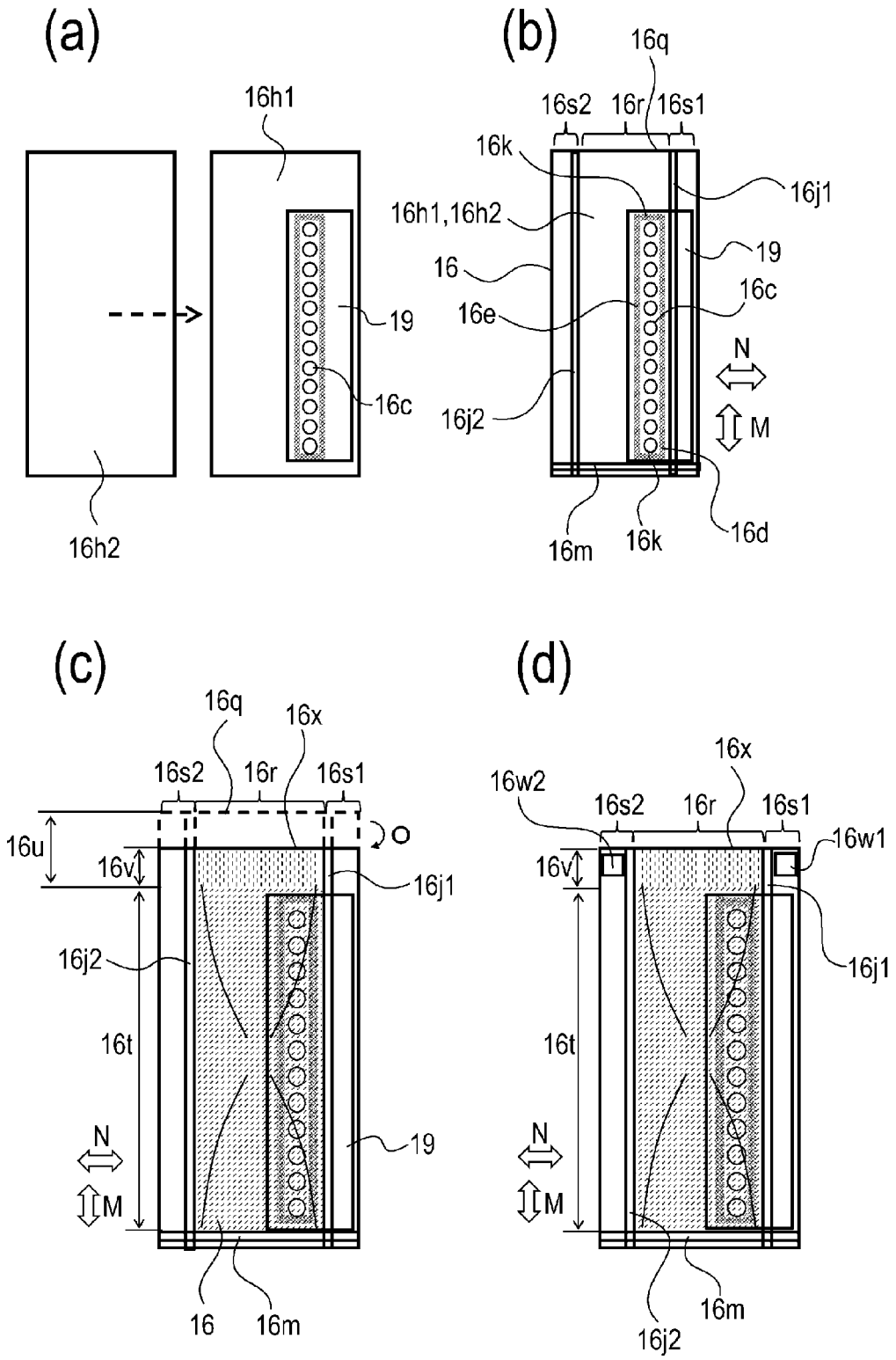
In FIG. 11, (a) to (d) are Second Embodiment illustrations showing a manufacturing method of a developer accommodating unit in Second Embodiment.

In this embodiment, as shown in FIG. 11, two sheets (a plurality of sheets) of sheet-shaped bag members 16*h*1 and 16*h*2 are bonded to each other to constitute the developer bag 16 and then the folding margin portion 16*u* provided at a periphery of the filling port 16*q* of the thus-constituted developer bag 16 is folded back along the fold 16*x*. Then, welding portions 16*w*1 and 16*w*2 are provided in non-filling regions 16*s*1 and 16*s*2 provided at end portions of the filling port 16*q* of the folded portion 16*v* and thus the filling port 16*q* is sealed up.

Figure 10:
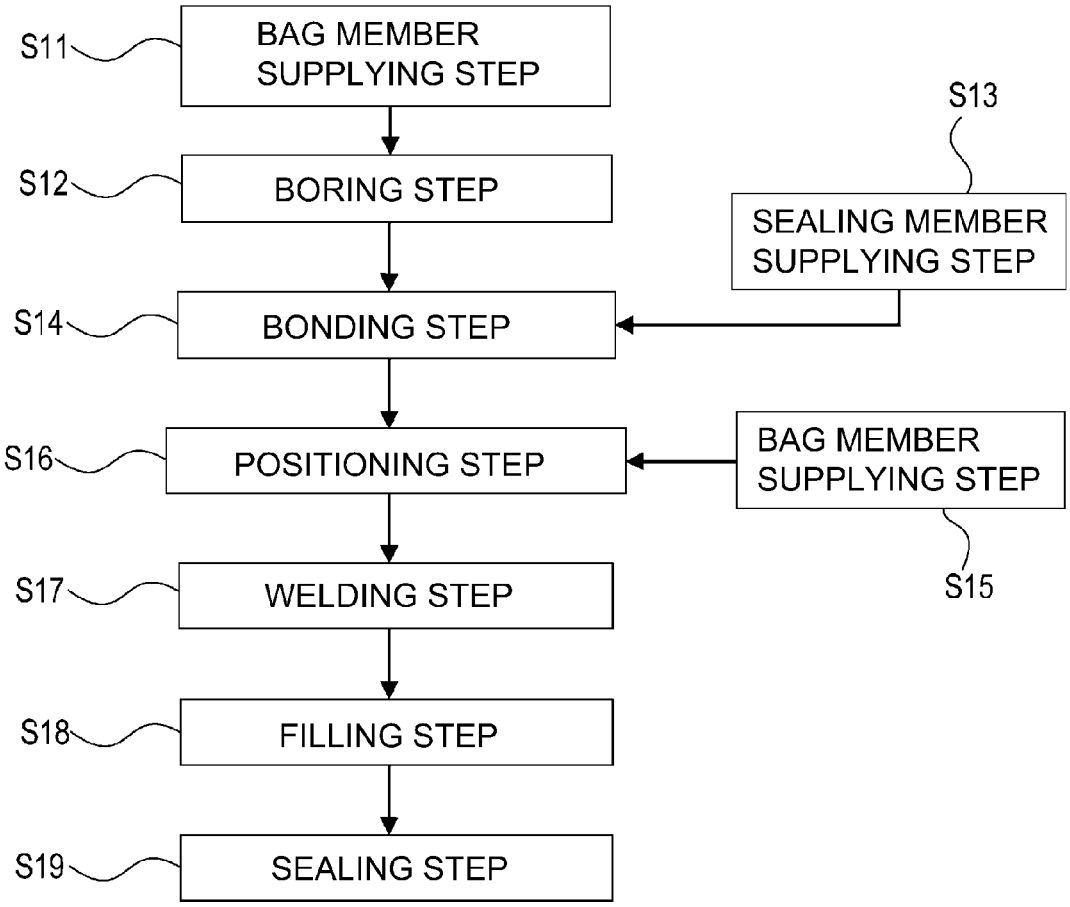
FIG. 10 is a flowchart showing a manufacturing method of the developer accommodating unit in Second Embodiment.

A procedure of a manufacturing method of the developer bag 16 and the sealing member 19 in this embodiment is shown in FIG. 10. In FIG. 10, steps S11 to S14 are substantially similar to the steps S1 to S4 in FIG. 4, and therefore will be omitted from redundant description. Further, with reference to FIG. 11, the manufacturing method of the developer bag 16 constituted by bonding the two bag members 16*h*1 and 16*h*2 to each other and a sealing method of the filling port 16*q* will be described. In FIG. 11, (a) and (b) are schematic views for illustrating a manufacturing process of the developer bag 16, constituted by the two bag members 16*h*1 and 16*h*2, and the sealing member 19, and (c) and (d) are schematic views for illustrating a filling port sealing step, shown as the step S19 in FIG. 10, of sealing the filling port 16*q* of the developer bag 16.

In FIG. 11, (a) shows the bag member 16*h*1 which has a sheet shape before the developer bag 16 is formed in a bag shape. In a bag member supplying step shown as step S11 in FIG. 10, the bag member 16*h*1 shown in (a) of FIG. 11 is supplied to an unshown boring machine. Then, in an opening boring step shown as step S12 in FIG. 10, boring of the bag member 16*h*1 is made, so that openings 16*c* are formed.

Next, in a sealing member supplying step shown as step S13 in FIG. 10, the sealing member 19 shown in (a) of FIG. 11 is supplied by an unshown supplying device. As shown in (a) of FIG. 11, the bag member 16*h*1 is positionally aligned with the sealing member 19. Then, in the sealing member bonding step shown as the step S4 in FIG. 4 in First Embodiment, the sealing member bonding step is carried out similarly as described above with reference to (c) of FIG. 5 and (c) of FIG. 6.

In the sealing member bonding step shown as the step S14 in FIG. 10, the bag member 16*h*1 and the sealing member 19 are welded using the heating head 26*a* and the receiving table 26*b*. Then, the first welding portion 16*d*, the second welding portion 16*e* and the pair of short welding portions 16*k* connecting these welding portions 16*d* and 16*e* are formed.

Next, in a bag member supplying step shown as step S15 in FIG. 10, as shown in (a) of FIG. 11, another one sheet-shaped bag member 16*h*2 for being bonded to the bag member 16*h*1 to form the bag member 16 in the bag shape is supplied to an opposite side from the side where the bag member 16*h*1 and the sealing member 19 are welded. Then, in a developing step of a plurality of bag members shown as step S17 in FIG. 10, as shown in (b) of FIG. 11, the bag member welding step is carried out similarly as described above with reference to (e) of FIG. 6 in the bag member welding step shown as the step S6 in FIG. 4 in First Embodiment. Thus the bag members 16*h*1 and 16*h*2 are bonded to each other and are formed in the bag shape. At this time, as shown in (b) of FIG. 11, the two bag members 16*h*1 and 16*h*2 are welded, so that bonding portions 16*j*1 and 16*j*2 and a bonding portion 16*m* are formed.

In this embodiment, the bonding portions 16*j*1 and 16*j*2 are provided in both sides of the filling region 16*r* along the longitudinal direction (arrow M direction in (b) of FIG. 11) of the developer bag 16. The bonding portion 16*m* is formed, so as to cross the bonding portions 16*j*1 and 16*j*2 at an end portion opposite from the filling port 16*q*, along the short direction (arrow N direction in (b) of FIG. 11) of the developer bag 16 which is a direction perpendicular to the longitudinal direction (arrow M direction in (b) of FIG. 11) of the developer bag 16.

Through the filling port 16*q* formed at the end portion in the opposite side from the bonding portion 16*m* with respect to the longitudinal direction (arrow M direction in (b) of FIG. 11) of the developer bag 16 formed in the bag shape, the toner 22 is filled in the filling portion 16*t* in the filling region 16*r* in the developer filling step shown as step S18 in FIG. 10.

In this embodiment, a central portion surrounded by the bonding portions 16*j*1 and 16*j*2 and the bonding portion 16*m* of the developer bag 16 shown in (b) of FIG. 11 constitutes the filling region 16*r*. Further, portions outside the central portion surrounded by the bonding portions 16*j*1 and 16*j*2 and the bonding portion 16*m* of the developer bag 16 shown in FIG. 11 constitute non-filling regions 16*s*1 and 16*s*2 which are provided at outer peripheral portions of the filling region 16*r* and in which the toner 22 is not filled. The non-filling regions 16*s*1 and 16*s*2 include the bonding portions 16*j*1 and 16*j*2 and 16*m* which are the second welding portion for forming the filling region 16*r*.

Further, the toner 22 is filled in the filling portion 16*t* of the developer bag 16 through the filling port 16*q* of the developer bag 16 similarly as described above with reference to FIG. 7 in the developer filling step as shown as the step S7 in FIG. 4 in First Embodiment.

Next, in a filling port sealing step shown as step S19 in FIG. 10, as shown in (c) of FIG. 11, the filling port sealing step is carried out similarly as described above in the filling port sealing step shown as the step S8 in FIG. 4 in First Embodiment. The folded portion 16*v* is formed by folding the folding margin portion 16*u*, provided at a periphery of the filling port 16*q*, in the folding direction shown as the arrow O direction shown in (c) of FIG. 11 along the fold 16*x*. That is, the folding step of folding the filling region 16*r* and the non-filling regions 16*s*1 and 16*s*2 of the developer bag 16, in which the toner 22 is filled in the developer filling step shown as the step S18 in FIG. 10, along the same fold 16*x*.

Further, as shown in (d) of FIG. 11, the non-filling regions 16*s*1 and 16*s*2 of the folded portion 16*v* are welded, so that welding portions 16*w*1 and 16*w*2 are formed, respectively. That is, the welding of welding each of the non-filling regions 16*s*1 and 16*s*2 of the folded portion 16*v* folded in the folding step described above is carried out.

As shown in FIG. 11, the folded portion 16*v* is folded back about 180 degrees along the fold 16*x* at a free end portion in the filling port 16*q* side, so that the sealing of the filling port 16*q* is carried out by the formation of the labyrinth described above. By maintaining the shape of the folded portion 16*v* by the welding portions 16*w*1 and 16*w*2, the issuing of the toner 22 from the filling port 16*t* is prevented, so that the filling port 16*q* is sealed up. As a result, it is possible to maintain the shape of the folded portion 16*v* with high reliability without melting the toner 22.

Also in the constitution using the developer bag 16 constituted by the plurality of bag members 16*h*1 and 16*h*2 as in this embodiment, it is possible to obtain an effect similar to that in First Embodiment. The welding portions 16*w*1 and 16*w*2 are formed in the non-filling regions including the bonding portions 16*j*1 and 16*j*2 as the second welding portion for forming the filling region 16*r*. As a result, the effect similar to that in First Embodiment can be obtained. Other constitutions are similar to those in First Embodiment, and a similar effect can be obtained.

Third Embodiment

Next, with reference to FIG. 12, a constitution of Third Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Second Embodiment, the folding margin portion 16*u* provided at a periphery of the filling port 16*q* of the developer bag 16 constituted by bonding the two sheet-shaped bag members 16*h*1 and 16*h*2 is folded back along the fold 16*x*. Then, a constitution in which the welding portion 16*w* and 16*w*2 are provided in the non-filling regions 16*s*1 and 16*s*2, provided at end portions of the filling port 16*q*, of the folded portion 16*v* and thus the filling port 16*q* is sealed up was described.

In this embodiment, three sheet-shaped bag members 16*h*1, 16*h*2 and 16*h*3 are bonded to each other to constitute the developer bag 16 and then the folding margin portion 16*u* provided at a periphery of the filling port 16*q* of the thus-constituted developer bag 16 is folded back along the fold 16*x*. Then, welding portions 16*w*1 and 16*w*2 are provided in non-filling regions 16*s*1 and 16*s*2 provided at end portions of the filling port 16*q* of the folded portion 16*v* and thus the filling port 16*q* is sealed up.

Figure 12:
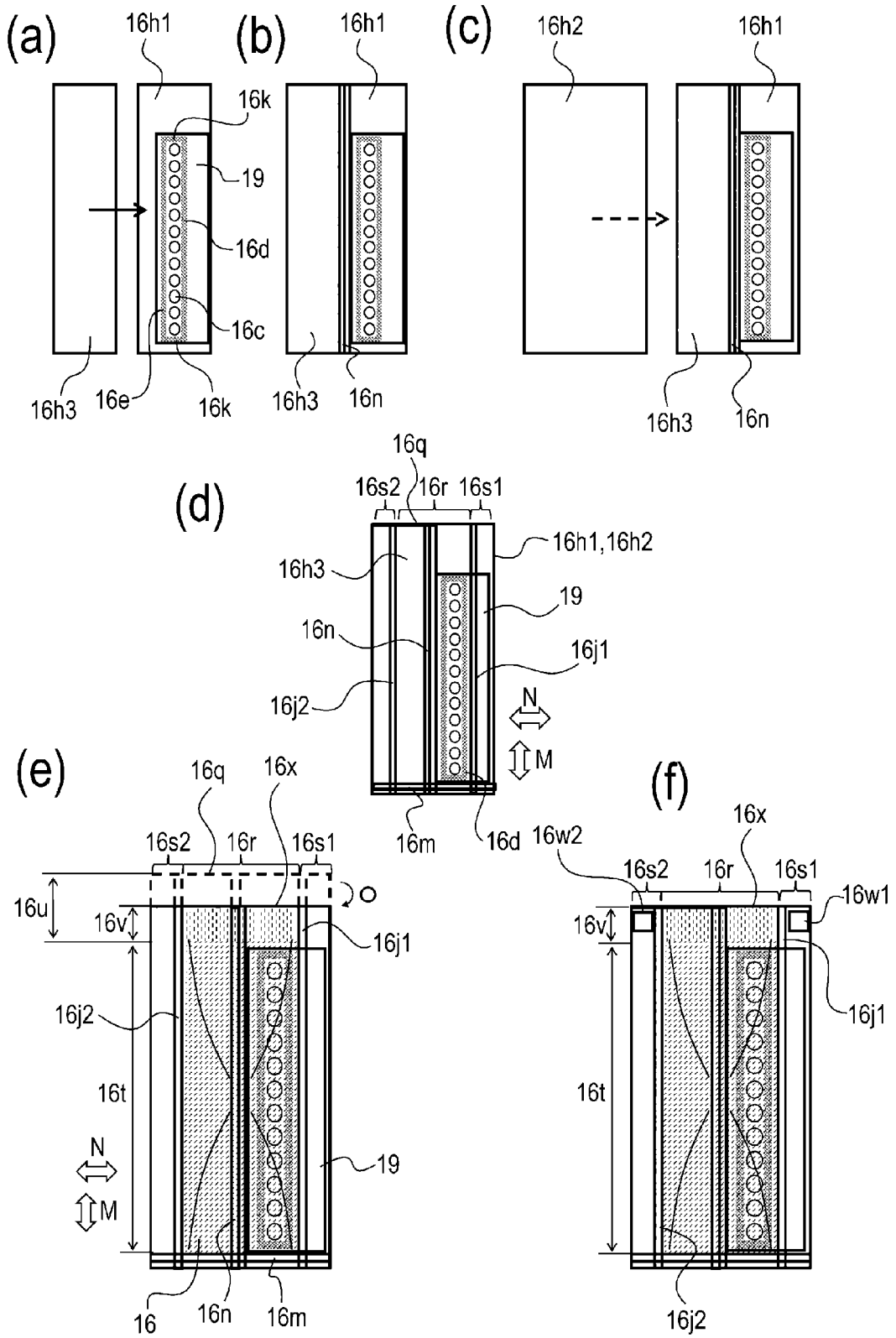
In FIG. 12, (a) to (f) are front illustrations showing a manufacturing method of a developer accommodating unit in Third Embodiment.

In FIG. 12, (a) shows the bag member 16*h*1 which has a sheet shape before the developer bag 16 is formed in a bag shape. Similarly as in the bag member supplying step shown as step S11 in FIG. 10 in Second Embodiment, the bag member 16*h*1 shown in (a) of FIG. 12 is supplied to an unshown boring machine. Then, similarly as in the opening boring step shown as step S12 in FIG. 10 in Second Embodiment, boring of the bag member 16*h*1 is made, so that openings 16*c* are formed as shown in (a) of FIG. 12.

Next, similarly as in the sealing member supplying step shown as step S13 in FIG. 10 in Second Embodiment, the sealing member 19 shown in (a) of FIG. 12 is supplied by an unshown supplying device. As shown in (a) of FIG. 12, the bag member 16*h*1 is positionally aligned with the sealing member 19. Then, in the sealing member bonding step shown as the step S4 in FIG. 4 in First Embodiment, the sealing member bonding step is carried out similarly as described above with reference to (c) of FIG. 5 and (c) of FIG. 6.

Similarly as in the sealing member bonding step shown as the step S14 in FIG. 10, the bag member 16*h*1 and the sealing member 19 are welded using the heating head 26*a* and the receiving table 26*b*. Then, the first welding portion 16*d*, the second welding portion 16*e* and the pair of short welding portions 16*k* connecting these welding portions 16*d* and 16*e* are formed.

Next, similarly as in the bag member supplying step shown as the step S15 in FIG. 10 of Second Embodiment, the bag member supplying step is carried out. As shown in (a) of FIG. 12, another sheet-shaped bag member 16*h*2 for being bonded to the bag member 16*h*1 to be formed in the bag shape is supplied by an unshown supplying device.

Then, the bag member 16*h*3 is supplied to a position, where the sealing member 19 is not welded at a side end portion of the bag member 16*h*1 welded to the sealing member 19, so as to overlap with the bag member 16*h*1. Then, similarly as in the positioning step of the plurality of bag members shown as the step S16 in FIG. 10 in Second Embodiment, positional alignment between the bag members 16*h*3 and 16*h*1 is effected.

Further, similarly as in the bag member welding step shown as the step S17 in FIG. 10 in Second Embodiment, the bag member welding step is carried out. As shown in (b) of FIG. 12, the bag members 16*h*1 and 16*h*3 positionally aligned similarly as described above with reference to (e) of FIG. 6 in the bag member welding step shown as the step S6 in FIG. 4 in First Embodiment are bonded to each other. At this time as shown in (b) of FIG. 12, the bonding portion 16*n* is formed by welding the two bag members 16*h*1 and 16*h*2.

Next, similarly as in the bag member supplying step shown as the step S15 in FIG. 10 of Second Embodiment, the bag member supplying step is carried out. As shown in (c) of FIG. 12, another sheet-shaped bag member 16*h*3 for being bonded to the above-bonded bag members 16*h*1 and 16*h*3 to be formed in the bag shape is supplied by the unshown supplying device to a side opposite from the side where the sealing member 19 of the bag member h1 is bonded. Then, similarly as in the positioning step of the plurality of bag members shown as the step S16 in FIG. 10 in Second Embodiment, positional alignment of the bag member 16*h*2 with the bag members 16*h*1 and 16*h*3, which are bonded to each other in advance, is effected.

Further, similarly as in the bag member welding step shown as the step S17 in FIG. 10 in Second Embodiment, the bag member welding step is carried out. As shown in (d) of FIG. 12, the bag member 16*h*2 and the bag members 16*h*1 and 16*h*3 which are positionally aligned similarly as described above with reference to (e) of FIG. 6 in the bag member welding step shown as the step S6 in FIG. 4 in First Embodiment are bonded to each other to be formed in the bag shape. At this time as shown in (d) of FIG. 12, the bonding portions 16*j*1, 16*j*2 and 16*n* are formed by welding the three bag members 16*h*1, 16*h*2 and 16*h*3.

In this embodiment, the bonding portions 16*j*1 and 16*j*2 are provided in both sides of the filling region 16*r* along the longitudinal direction (arrow M direction in (d) of FIG. 12) of the developer bag 16. The bonding portion 16*m* is formed, so as to cross the bonding portions 16*j*1, 16*j*2 and 16*n* at an end portion opposite from the filling port 16*q*, along the short direction (arrow N direction in (b) of FIG. 11) of the developer bag 16 which is a direction perpendicular to the longitudinal direction (arrow M direction in (d) of FIG. 12) of the developer bag 16.

The filling port 16*q* is formed at the end portion in the opposite side from the bonding portion 16*m* with respect to the longitudinal direction (arrow M direction in (d) of FIG. 12) of the developer bag 16 formed in the bag shape. Through the filling port 16*q*, the toner 22 is filled in the filling portion 16*t* in the filling region 16*r* similarly as in the developer filling step shown as step S18 in FIG. 10 in Second Embodiment.

In this embodiment, a central portion surrounded by the bonding portions 16*j*1 and 16*j*2 and the bonding portion 16*m* of the developer bag 16 shown in (d) of FIG. 12 constitutes the filling region 16*r*. Further, portions outside the central portion surrounded by the bonding portions 16*j*1 and 16*j*2 and the bonding portion 16*m* of the developer bag 16 shown in (d) FIG. 12 constitute non-filling regions 16*s*1 and 16*s*2 which are provided at outer peripheral portions of the filling region 16*r* and in which the toner 22 is not filled. The non-filling regions 16*s*1 and 16*s*2 include the bonding portions 16*j*1 and 16*j*2 and 16*m* which are the second welding portion for forming the filling region 16*r*.

Further, the toner 22 is filled in the filling portion 16*t* of the developer bag 16 through the filling port 16*q* of the developer bag 16 similarly as described above with reference to FIG. 7 in the developer filling step as shown as the step S7 in FIG. 4 in First Embodiment.

Next, similarly as in the filling port sealing step shown as step S19 in FIG. 10, the filling port sealing step is carried out. As shown in (e) of FIG. 12, the filling port sealing step is carried out similarly as described above in the filling port sealing step shown as the step S8 in FIG. 4 in First Embodiment.

In this filling port sealing step, the folded portion 16*v* is formed by folding the folding margin portion 16*u*, provided at a periphery of the filling port 16*q*, in the folding direction shown as the arrow O direction shown in (e) of FIG. 12 along the fold 16*x*. That is, the folding step of folding the filling region 16*r* and the non-filling regions 16*s*1 and 16*s*2 of the developer bag 16, in which the toner 22 is filled similarly as in the developer filling step shown as the step S18 in FIG. 10 in Second Embodiment, along the same fold 16*x*.

Further, as shown in (d) of FIG. 12, the non-filling regions 16*s*1 and 16*s*2 of the folded portion 16*v* are welded, so that welding portions 16*w*1 and 16*w*2 are formed, respectively. That is, the welding of welding each of the non-filling regions 16*s*1 and 16*s*2 of the folded portion 16*v* folded in the folding step described above is carried out.

As shown in (e) and (f) of FIG. 12, the folded portion 16*v* is folded back about 180 degrees along the fold 16*x* at a free end portion in the filling port 16*q* side, so that the sealing of the filling port 16*q* is carried out by the formation of the labyrinth described above. By maintaining the shape of the folded portion 16*v* by the welding portions 16*w*1 and 16*w*2, the issuing of the toner 22 from the filling port 16*t* is prevented, so that the filling port 16*q* is sealed up. As a result, it is possible to maintain the shape of the folded portion 16*v* with high reliability without melting the toner 22.

Also in the constitution using the developer bag 16 constituted by the plurality of bag members 16*h*1, 16*h*2 and 16*h*3 as in this embodiment, it is possible to obtain an effect similar to those in the above-described embodiments. The welding portions 16*w*1 and 16*w*2 are formed in the non-filling regions including the bonding portions 16*j*1 and 16*j*2 as the second welding portion for forming the filling region 16*r*. As a result, the effect similar to those in the above-described embodiments can be obtained. Incidentally, a constitution in which the bag-shaped developer bag 16 is formed by bonding four or more bag members 16*h* to each other may also be employed. Other constitutions are similar to those in the above-described embodiments, and a similar effect can be obtained.

Fourth Embodiment

Next, with reference to (a) of FIG. 13, a constitution of Fourth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In the above-described embodiments, an example in which the welding portion 16*w* is formed by welding the outside portions, of the bonding portion 16*j* or the bonding portions 16*j*1 and 16*j*2, which are the second welding portion for forming the filling region 16*r* is shown.

Figure 13:
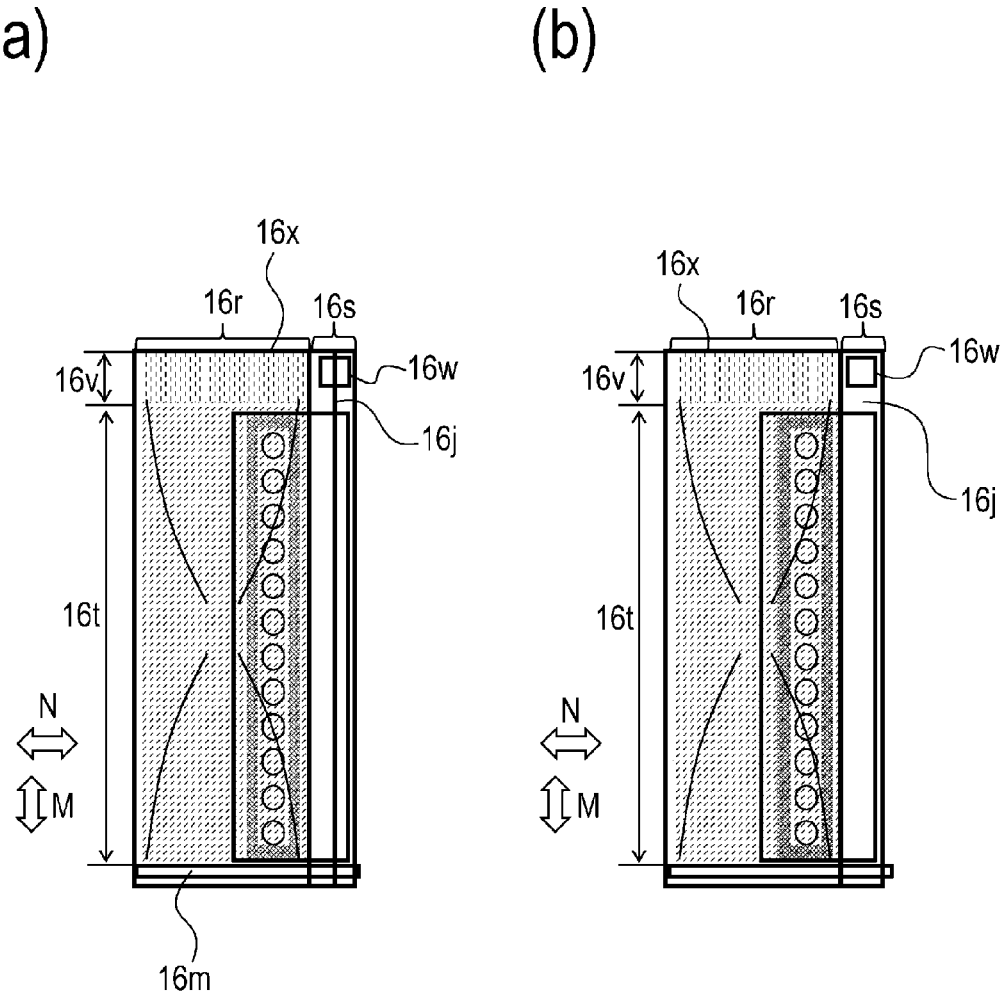
In FIG. 13, (a) and (b) are front illustrations for showing manufacturing methods of developer accommodating units in Fourth Embodiment and Fifth Embodiment, respectively.

In this embodiment, as shown in (a) of FIG. 13, the welding portion 16*w* is formed so as to include at least a part of the bonding portion 16*j* in the non-filling region 16*s* of the developer bag 16. By employing also such a constitution, it is possible to seal the filling port 16*q* without melting the toner 22 similarly as in the above-described embodiments. Other constitutions are similar to those in the above-described embodiments, and a similar effect can be obtained.

Fifth Embodiment

Next, with reference to (b) of FIG. 13, a constitution of Fifth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Fourth Embodiment, as shown in (a) of FIG. 13, the welding portion 16*w* is formed so as to include at least a part of the bonding portion 16*j* in the non-filling region 16*s* of the developer bag 16.

In this embodiment, as shown in (b) of FIG. 13, the bonding portion 16*j* is formed in a substantially entire area of the non-filling region 16*s* of the developer bag 16, and the welding portion 16*w* is formed in a range of the bonding portion 16*j*.

By broadening a welding width of the bonding portion 16*j* extending in the longitudinal direction of the developer bag 16 shown as the arrow M direction in (b) of FIG. 13, the welding portion 16*w* can be formed at the bonding portion 16*j*. By employing such a constitution, an accommodation amount of the toner 22 can be increased by narrowing a width of the non-filling region 16*s*, so that similarly as in the above-described embodiments, it is possible to seal the filling port 16*q* without melting the toner 22.

Further, the welding width of each of the bonding portions 16*j*1 and 16*j*2 is broadened similarly also in the case where the non-filling regions 16*s*1 and 16*s*2 are formed in both sides of the filling region 16*r* with respect to the short direction (arrow N direction in FIG. 11) of the filling region 16*r* similarly as described above with reference to FIG. 11 in Second Embodiment. As a result, the welding portions 16*w*1 and 16*w*2 can be formed at the bonding portions 16*j*1 and 16*j*2, respectively. Other constitutions are similar to those in the above-described embodiments, and a similar effect can be obtained.

Sixth Embodiment

Next, with reference to FIG. 14 and (a) to (c) of FIG. 15, a constitution of Sixth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In the above-described embodiments, e.g., as shown in FIG. 8, the folded portion 16*v* was formed by folding once the folding margin portion 16*u* provided at the periphery of the filling port 16*q* of the developer bag 16 in which the toner 22 is filled. Specifically, the folding margin portion 16*u* in the filling region 16*r* and the folding margin portion 16*u* in the non-filling region 16*s* were integrally folded once in the folding direction shown as the arrow O direction in (a) and (c) of FIG. 8 along the fold 16*x*, so that the folded portion 16*v* was formed.

Figure 14:
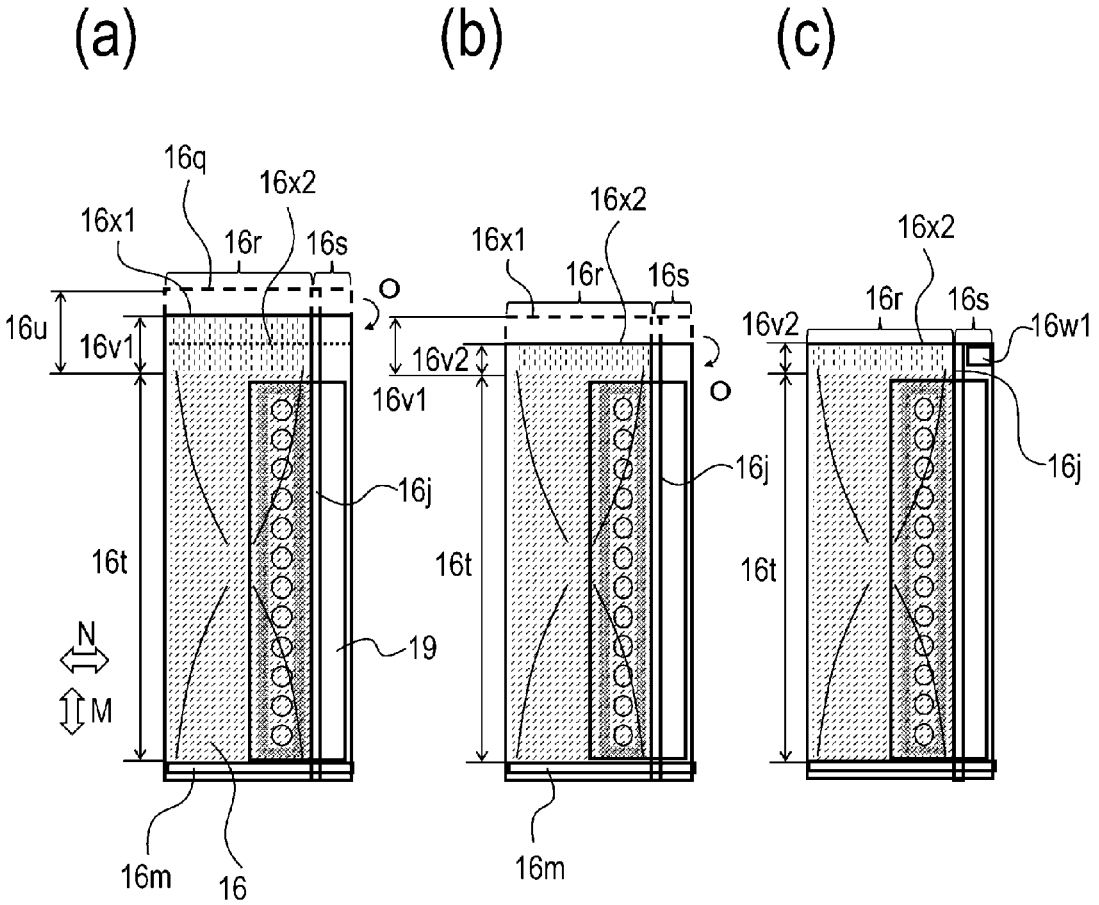
In FIG. 14, (a) to (c) are front illustrations for illustrating a sealing step including a folding step of folding a developer bag of a developer accommodating unit according to the present invention and a welding step of welding a non-filling region of a folded portion in Sixth Embodiment.

In this embodiments, as shown in FIG. 14 and (a) to (c) of FIG. 15, a second folded portion 16*v*2 was formed by folding twice the folding margin portion 16*u* provided at the periphery of the filling port 16*q* of the developer bag 16 in which the toner 22 is filled. Specifically, the folding margin portion 16*u* in the filling region 16*r* and the folding margin portion 16*u* in the non-filling region 16*s* were integrally folded once in the folding direction shown as the arrow O direction in (a) of FIG. 14 and (a) of FIG. 15 along a first fold 16*x*1, so that a first folded portion 16*v*1 was formed. Thereafter, along a second fold 16*x*2, the folding margin portions 16*u* are integrally folded in the folding direction (arrow O direction) as shown in (b) of FIG. 14 and (b) of FIG. 15, so that the second folded portion 16*v*2 is formed.

In FIG. 14, (a) to (c) are front illustrations for illustrating the filling port sealing of the developer bag 16 including the folded portion 16*v*2 formed by folding twice the folding margin portion 16*u* provided at the periphery of the filling port 16*q* of the developer bag 16 in which the toner 22 is filled. In FIG. 15, (a) to (c) are sectional illustrations of the developer bag 16 shown in FIG. 14, as seen from the non-filling region 16*s* side.

In (a) of FIG. 14 and (a) of FIG. 15, the folding margin portions 16*u*, of the filling region 16*r* and the non-filling region 16*s*, which are provided at the periphery of the filling port 16*q* of the developer bag 16 in which the toner 22 is filled are folded along the same fold 16*x*1, so that the first folded portion 16*v*1 is formed. The folding margin portions 16*u* are folded along the first fold 16*x*1 in the folding direction shown as the arrow O direction as shown in (a) of FIG. 14 and (a) of FIG. 15, so that the first folded portion 16*v*1 is formed.

The developer bag 16 is formed of the flexible sheet material. For this reason, the developer bag 16 can be folded. A length of the first folded portion 16*v*1 with respect to the arrow M direction in (a) of FIG. 14 is as follows. With respect to a length of the folding margin portion 16*u* with respect to the arrow M direction in (a) of FIG. 14, the folding margin portion 16*u* is folded so that the length of the first folded portion 16*v*1 is about ⅔ of the length of the folding margin portion 16*u* with respect to the folding direction shown as the arrow O direction in (a) of FIG. 14 and (a) of FIG. 15.

Then, as shown in (b) of FIG. 14 and (b) of FIG. 15, the folding margin portions 16*u* are further folded along the second fold 16*x*2 in the folding direction shown as the arrow O direction as shown in (b) of FIG. 14 and (b) of FIG. 15, so that the second folded portion 16*v*2 is formed.

A length of the second folded portion 16*v*2 with respect to the arrow M direction in (b) of FIG. 14 is as follows. With respect to a length of the folding margin portion 16*u* with respect to the arrow M direction in (b) of FIG. 14, the folding margin portion 16*u* is folded so that the length of the second folded portion 16*v*2 is about ⅓ of the length of the folding margin portion 16*u* with respect to the folding direction shown as the arrow O direction in (b) of FIG. 14 and (b) of FIG. 15.

Thereafter, as shown in (c) of FIG. 14 and (c) of FIG. 15, the welding portion 16*w* is formed by welding the non-filling region 16*s* of the second folded portion 16*v*2, so that the shape of the second folded portion 16*v*2 is maintained.

By employing such a constitution, similarly as in the above-described embodiments, the issuing of the toner 22 from the filling port 16*t* can be prevented without melting the toner 22, so that the filling port 16*q* can be sealed up.

In this embodiment, the folding margin portion 16*u* provided at the periphery of the filling port 16*q* of the developer bag 16 is folded twice along the first and second folds 16*x*1 and 16*x*2, so that the second folded portion 16*v*2 is formed. As a result, the shape folded back about 180 degrees is formed at two positions and is held by the welding portion 16*w* provided in the non-filling region 16*s*, so that a further complicated labyrinth is formed and thus the issuing of the toner 22 can be prevented with high reliability. The labyrinth may also be formed by folding three times or more (plural times) the folding margin portion 16*u*. Other constitutions are similar to those in the above-described embodiments, and a similar effect can be obtained.

Seventh Embodiment

Next, with reference to (a) to (c) of FIG. 16, a constitution of Seventh Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Sixth embodiment, as shown in FIG. 14 and (a) to (c) of FIG. 15, the folding margin portion 16*u* provided at the periphery of the filling port 16*q* of the developer bag 16 is folded twice along the first fold 16*x*1 and the second fold 16*x*2 in this order from the filling port 16*q* side. As a result, the second folded portion 16*v*2 is formed. Such an example is shown.

In this embodiment, as shown in (a) to (c) of FIG. 16, the folding margin portion 16*u* provided at the periphery of the filling port 16*q* of the developer bag 16 is folded twice along the first fold 16*x*1 and the second fold 16*x*2 in this order from the filling port 16*q* side while changing the folding direction. The case where a second folded portion 16*v*2 is formed in such a manner will be described.

In FIG. 16, (a) to (c) are sectional illustrations for illustrating the filling port sealing step of the developer bag 16 including the second folded portion 16*v*3 formed by folding twice the folding margin portion 16*u* while changing the folding direction. As shown in (a) of FIG. 16, in order to form the folded portion 16*v*3, a length of the folded portion 16*v*3 of the developer bag 16 with respect to the arrow M direction in (a) of FIG. 16 is as follows. With respect to a length of the folding margin portion 16*u* with respect to the arrow M direction in (a) of FIG. 16, the folding margin portion 16*u* is folded so that the length of the first folded portion 16*v*1 is about ⅓ of the length of the folding margin portion 16*u* with respect to the folding direction shown as the arrow O direction in (a) of FIG. 16.

By folding the folding margin portion 16*u* in this way, a folding margin portion 16*u*1 having a length which is about ⅔ of the length of the folding margin portion 16*u* with respect to the arrow M direction in (a) of FIG. 16 is formed. Then, as shown in (b) of FIG. 16, the folding margin portion 16*u*1 is folded in a second folding direction shown as an arrow W direction in (b) of FIG. 16 to provide the second fold 16*x*2 so that the length of the resultant folded portion is about ½ of the length of the folded portion 16*u*1 with respect to the arrow M direction.

In this way, the folding margin portion 16*u* provided at the periphery of the filling port 16*q* of the developer bag 16 is folded twice along the first fold 16*x*1 and the second fold 16*x*2 in this order from the filling port 16*q* side. As a result, the folded portion 16*v*3 is folded so as to have the length of about ⅓ of the length of the folding margin portion 16*u* with respect to the folding direction shown as the arrow O direction in (a) of FIG. 16.

Then, as shown in (c) of FIG. 16, the welding portion 16*w* is formed by welding the non-filling region 16*s* of the folded portion 16*v*3, so that the shape of the second folded portion 16*v*2 is maintained.

Even when such a constitution is employed, similarly as in the above-described embodiments, the shape of the folded portion 16*v*3 can be held further reliably without melting the toner 22.

In this embodiment, the folded portion 16*v*3 is formed by folding twice the folding margin portion 16*u* similarly as in Sixth Embodiment. As a result, the shape folded back about 180 degrees is formed at two positions and is held by the welding portion 16*w*, so that a further complicated labyrinth is formed. As a result, the issuing of the toner 22 from the filling portion 16*t* can be prevented with high reliability. Other constitutions are similar to those in the above-described embodiments, and a similar effect can be obtained.

Eighth Embodiment

Next, with reference to (a) and (b) of FIG. 17, a constitution of Eighth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In the above-described embodiments, e.g., as shown in FIG. 8, an example in which the filling port 16*q* of the developer bag 16 was formed at the longitudinal end portion of the developer bag 16 with respect to the arrow M direction in FIG. 8 was described.

Figure 17:
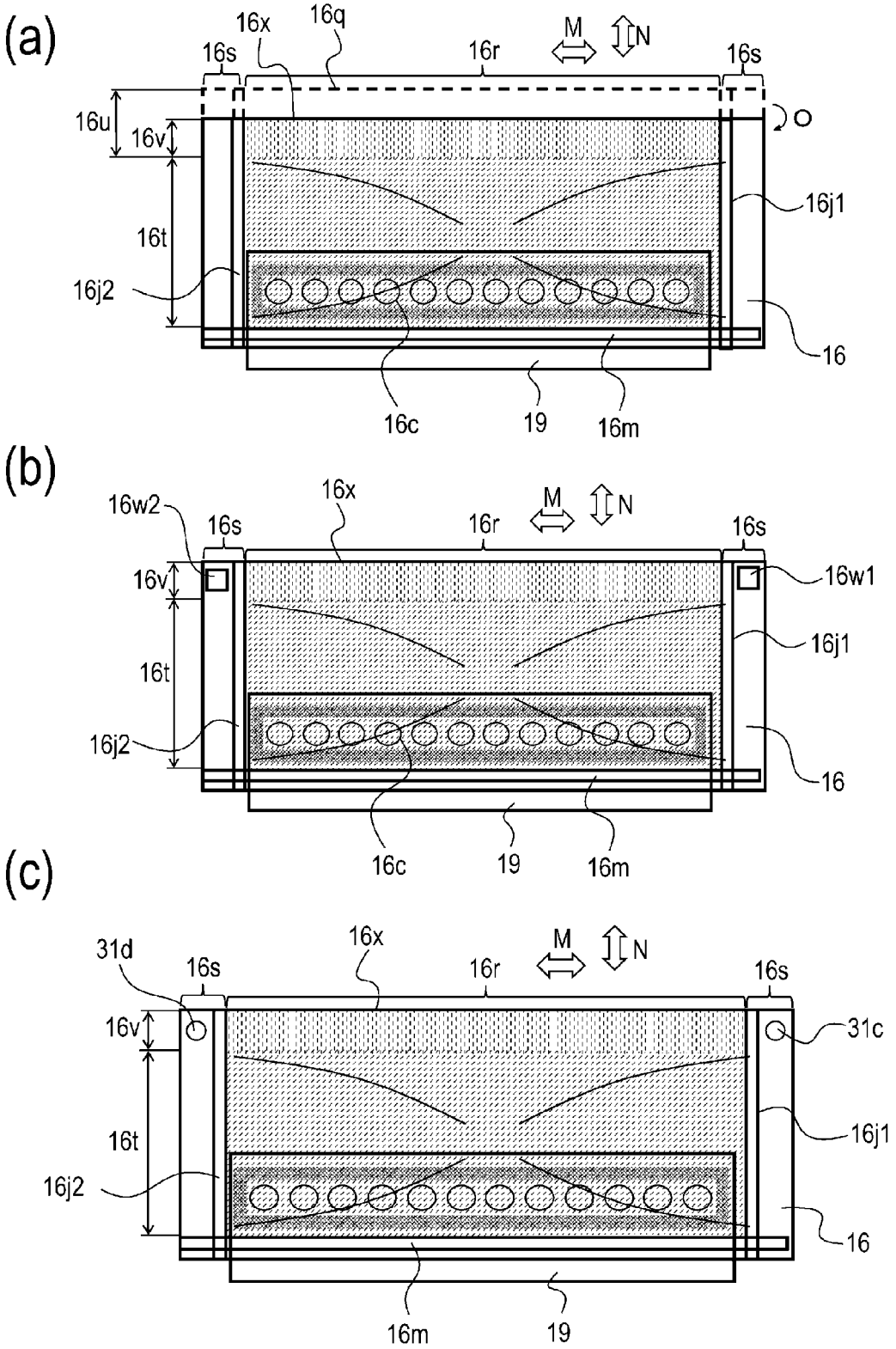
In FIG. 17, (a) and (b) are front illustrations for illustrating a sealing step including a folding step of folding a developer bag of a developer accommodating unit according to the present invention and a welding step of welding a non-filling region of a folded portion in Eighth Embodiment.

In this embodiment, an elongated filling port 16*q* of the toner 22 is formed, in a length corresponding to a substantially full length of the longitudinal direction of the developer bag 16 with respect to the arrow M direction in (a) and (b) of FIG. 17, at an end portion of the developer bag 16 with respect to the short direction shown as the arrow N direction in (a) and (b) of FIG. 17.

In this embodiment, the non-filling regions 16*s* are constituted by including the bonding portions 16*j*1 and 16*j*2 which are the second welding portion for forming the filling region 16*r*.

In the non-filling regions 16*s* provided in both sides of the filling region 16*r* of the folded portion 16*v*, the welding portions 16*w*1 and 16*w*2 are formed. Even in the case of the developer bag 16 employing also such a constitution, it is possible to prevent the issuing of the toner 22 from the filling portion 16*t* and to seal the filling port 16*q* without melting the toner 22 similarly as in the above-described embodiments.

Other constitutions are similar to those in the above-described embodiments, and a similar effect can be obtained.

Ninth Embodiment

Next, with reference to (a) and (b) of FIG. 18, a constitution of Ninth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Eighth Embodiment, the example in which the elongated filling port 16*q* was formed along the longitudinal direction of the developer bag 16 as shown in (a) and (b) of FIG. 17 was described. In this embodiment, as shown in (a) and (b) of FIG. 18, a filling port 16*q* is formed, to the extent such that the screw 41 and the casing 43 of the screw filling device 29 described above with reference to FIG. 7 are insertable into the developer bag 16, at a substantially longitudinal central portion of the developer bag 16 as shown in (a) and (b) of FIG. 18. The developer bag 16 is formed in a projected shape in cross-section.

Figure 18:
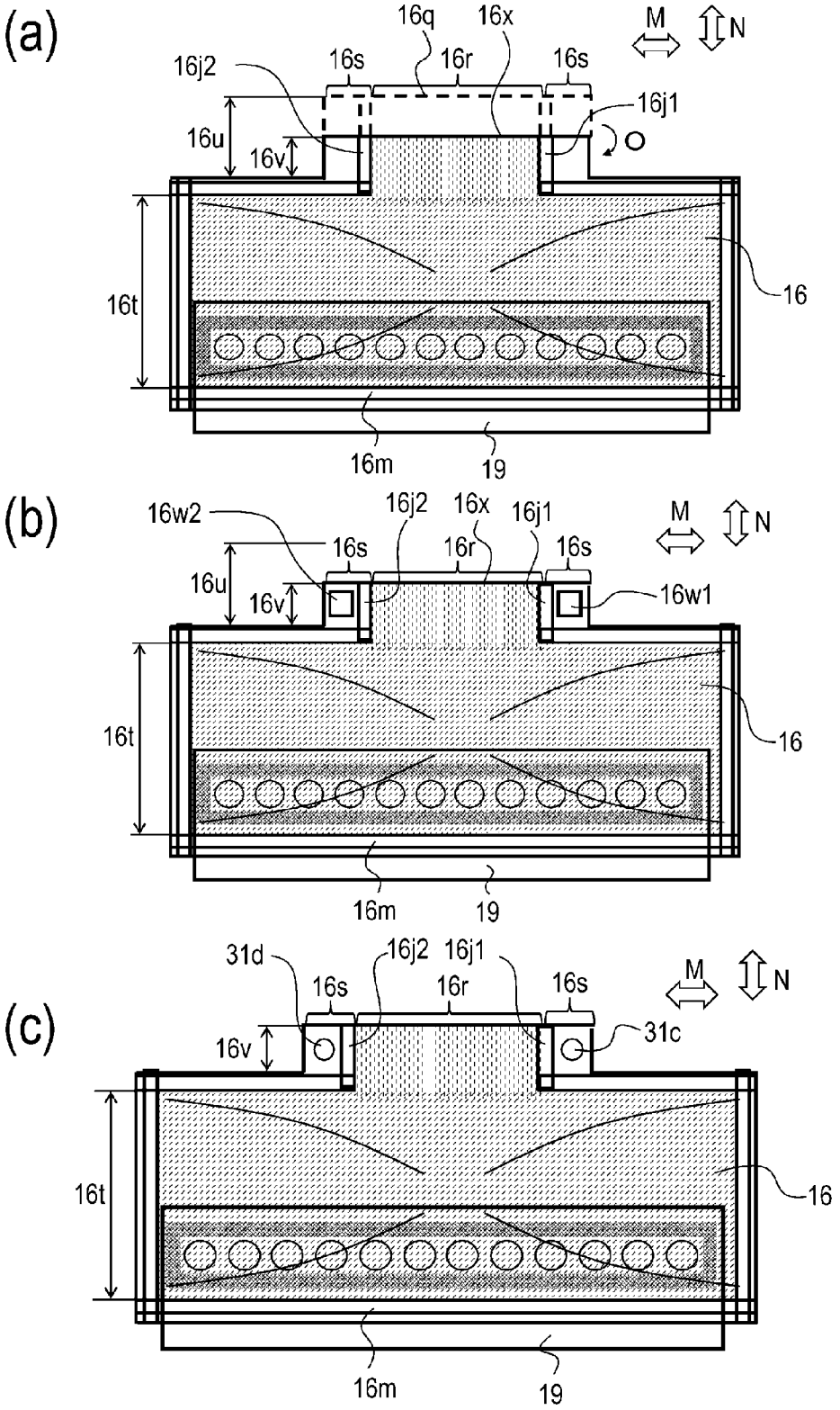
In FIG. 18, (a) and (b) are front illustrations for illustrating a sealing step including a folding step of folding a developer bag of a developer accommodating unit according to the present invention and a welding step of welding a non-filling region of a folded portion in Ninth Embodiment.

As shown in (a) and (b) of FIG. 18, the filling port 16*q* through which the toner 22 is filled is adjusted to have an opening corresponding to a diameter in which the screw 41 and the casing 43 of the screw filling device 29 shown in FIG. 7 is insertable. The filling port 16*q* is partly formed with respect to the longitudinal direction of the developer bag 16 shown as the arrow M direction in (a) and (b) of FIG. 18. Then, in the non-filling regions 16*s* provided in both sides of the filling region 16*r* of the folded portion 16*v*, the welding portions 16*w*1 and 16*w*2 are formed.

By employing also such a constitution, it is possible to maintain the shape of the folded portion 16*v* with high reliability. Further, it is possible to prevent the issuing of the toner 22 from the filling portion 16*t* and to seal the filling port 16*q* without melting the toner 22 similarly as in the above-described embodiments. Other constitutions are similar to those in the above-described embodiments, and a similar effect can be obtained.

Tenth Embodiment

Next, with reference to (a) and (b) of FIG. 19, a constitution of Tenth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In the above-described embodiments, the example in which the filling port 16*q* is sealed by providing the welding portion 16*w* in the non-filling region 16*s* of the folded portion 16*v* obtained by folding, along the fold 16*x*, the folding margin portion 16*u* provided at the periphery of the filling port 16*q* of the developer bag 16 was described.

In this embodiment, a constitution in which the filling port 16*q* is sealed by fixing a fixing member 31 in a cutting manner such that the fixing member 31 is penetrated through the non-filling region 16*s* of the folded portion 16*v* obtained by folding the folding margin portion 16*u* provided at the periphery of the filling port 16*q* of the developer bag 16 will be described.

With reference to (a) and (b) of FIG. 19, the filling port sealing step of sealing the filling port 16*q* of the developer bag 16 in this embodiment will be described. Also in this embodiment, the developer filling step (step S7 in FIG. 4) of filling the toner 22 in the developer bag 16 through the filling port 16*q* of the developer bag 16 is performed. The folding step of folding the filling region 16*r* and the non-filling region 16*s*, along the same fold 16*x*, of the developer bag 16 in which the toner 22 is filled in the developer filling step (step S7 in FIG. 4) is similar to that in First Embodiment, and therefore will be omitted from redundant description.

Figure 19:
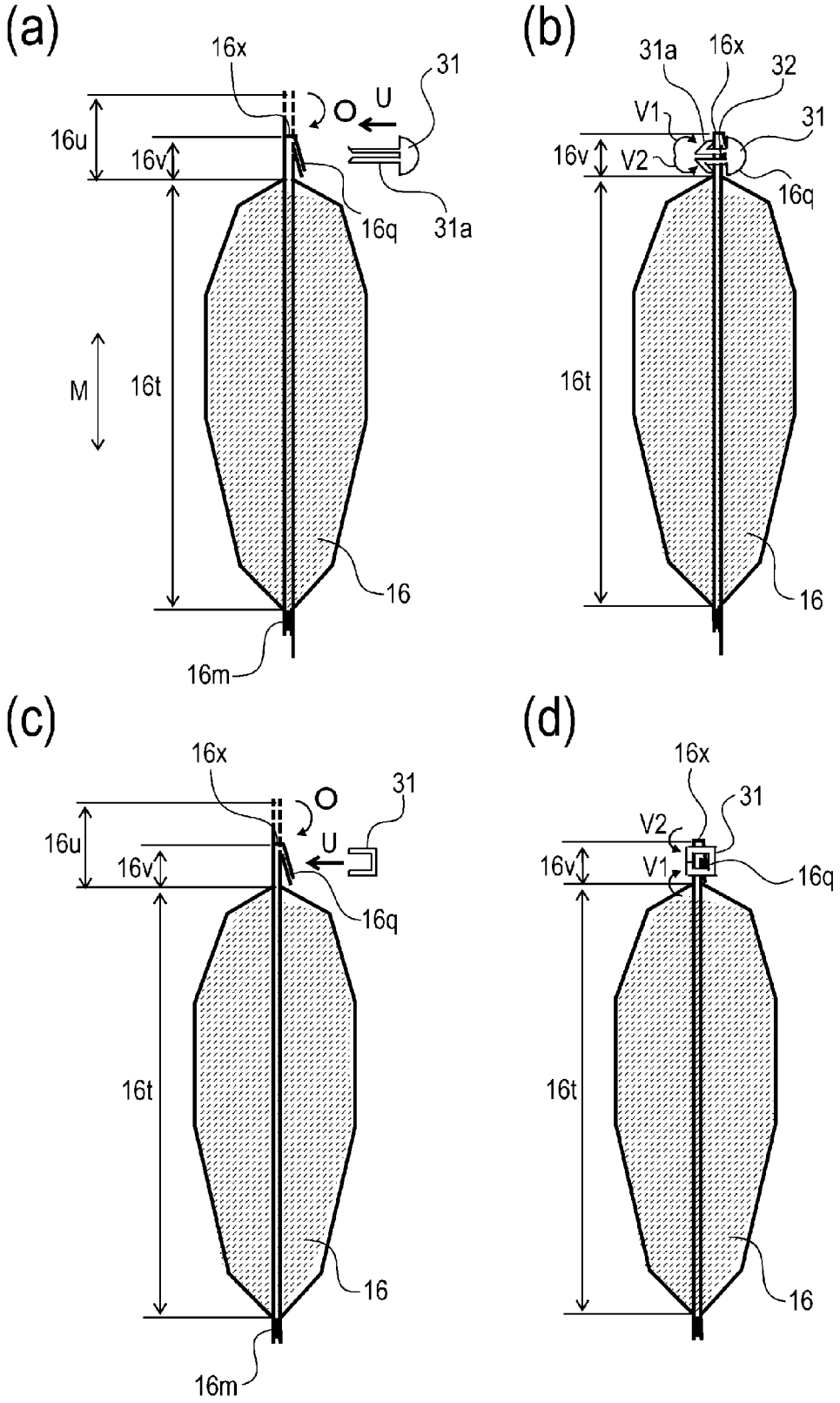
In FIG. 19, (a) and (b) are sectional illustrations, as seen from a non-filling region side, for illustrating the sealing step including a folding step of folding a developer bag of a developer accommodating unit according to the present invention and a fixing step of fixing a fixing member by causing the fixing member to penetrate through a non-filling region of a folded portion in Tenth Embodiment.

In this embodiment, as shown in (a) and (b) of FIG. 19, at least one fixing member 31 which cuts and penetrates through the non-filling region 16*s* of the folded portion 16*v* is provided. For fixing the fixing member 31, a through hole 32 penetrating through the non-filling region 16*s* of the folded portion 16*v* is provided in advance. Then, the fixing member 31 may also be inserted into the through hole 32 and thus may be fixed. As another method, a through hole 32 penetrating through the non-filling region 16*s* of the folded portion 16*v* is formed in a cutting manner using the fixing member 31, and thus the fixing member 31 may also be fixed.

In the above-described embodiments, as shown in (a) of FIG. 19, the folded portion 16*v* was formed by folding the folding margin portion 16*u* provided at the periphery of the filling port 16*q* of the developer bag 16 in which the toner 22 is filled. Specifically, the folding margin portion 16*u* in the filling region 16*r* and the folding margin portion 16*u* in the non-filling region 16*s* are integrally folded in the folding direction shown as the arrow O direction in (a) of FIG. 9 along the fold 16*x*, so that the folded portion 16*v* is formed.

The developer bag 16 is formed of the flexible sheet material. For this reason, the developer bag 16 can be folded. A length of the first folded portion 16*v*1 with respect to the arrow M direction in (a) of FIG. 19 is as follows. With respect to a length of the folding margin portion 16*u* with respect to the arrow M direction in (a) of FIG. 19, the folding margin portion 16*u* is folded so that the length of the first folded portion 16*v*1 is about ½ of the length of the folding margin portion 16*u* with respect to the folding direction shown as the arrow O direction in (a) of FIG. 14 and (a) of FIG. 15.

Then, as shown in (b) of FIG. 19, the fixing member 31 is inserted in an arrow U direction from the right side of (a) of FIG. 19 so as to cut and penetrate the non-filling region 16*s* of the folded portion 16*v* to be mounted, so that a fixing step of fixing the fixing member 31 is performed.

With respect to the insertion direction of the fixing member 31, the fixing member 31 may also be mounted by causing the fixing member 31 to cut and penetrate the non-filling region 16*s* of the folded portion 16*v* from the left side of (a) of FIG. 19 in an opposite direction to the arrow U direction. As a result, the shape of the second folded portion 16*v* can be maintained.

As described above, similarly as in the above-described embodiments, the issuing of the toner 22 from the filling port 16*t* can be prevented without melting the toner 22, so that the filling port 16*q* can be sealed up.

The fixing member 31 in this embodiment is constituted by including a rivet-shaped portion 31*a* using a material such as metal (e.g., iron or the like). The rivet-shaped portion 31*a* of the fixing member 31 has a sharp shape at a free end portion in a side (left side in (a) of FIG. 19) toward the mounting direction shown as the arrow U direction in (a) of FIG. 19 as shown in (a) of FIG. 19. For this reason, the free end portion of the rivet-shaped portion of the fixing member 31 can cut and penetrate through the folded portion 16*v*, so that the fixing member 31 can be fixed. As a material for the fixing member 31, other than the metal, a resin material may also be used so long as the resin material can cut and penetrate through the folded portion 16*v*.

After the rivet-shaped portion 31*a* of the fixing member 31 is caused to cut and penetrate through the folded portion 16*v*, as shown in (b) of FIG. 19, the free end portion of the rivet-shaped portion 31*a* is bent in arrow V1 and V2 directions as a retaining direction of the fixing member 31. As a result, the fixing member 31 can be fixed at the folded portion 16*v* of the developer bag 16.

At this time, the fixing member 31 is mounted so as to cut and penetrate through the non-filling region 16*s* of the folded portion 16*v*, and therefore the toner 22 is not deposited on the inner peripheral surface of a penetrating portion. As a result, the toner 22 is prevented from leaking out through the through hole 32 formed by causing the free end portion of the rivet-shaped portion 31*a* of the fixing member 31 to cut and penetrate through the folded portion 16*v*.

The fixing member 31 is mounted outside the bonding portion 16*j* as the second welding portion for forming the non-filling region 16*s*. For this reason, a spacing including the bonding portion 16*j* is provided between the filling region 16*r* and the through hole 32, shown in (b) of FIG. 19, formed by mounting the fixing member 31. By this spacing, also after the developer bag 16 is mounted, the toner 22 is not leaked out through the filling portion 16*t*. Also in this embodiment, the welding is not used as the method of sealing the filling port 16*q*, and therefore the filling port 16*q*, and therefore the filling port 16*q* can be sealed up without melting the toner 22. Other constitutions are similar to those in the above-described embodiments, and a similar effect can be obtained.

Eleventh Embodiment

Next, with reference to (c) and (d) of FIG. 19, a constitution of Eleventh Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Tenth Embodiment, the example of the constitution in which the fixing member 31 includes the rivet-shaped portion 31*a* was shown. The fixing member 31 in this embodiment is an example in which the fixing member 31 is, as shown in (c) and (d) of FIG. 19, constituted so that an elongated cylindrical member having a sharp shape at a free end portion thereof in a mounting direction side with respect to an arrow U direction in (c) of FIG. 19 is bent in a U-shape.

In the case where the fixing member 31 as in this embodiment is used, the fixing member 31 is mounted so as to cut and penetrate the non-filling region 16*s* of the folded portion 16*v* at two positions. Then, the fixing member 31 is bent in arrow V1 and V2 directions of (d) of FIG. 19 as a retaining direction. As a result, the fixing member 31 can be fixed to the folded portion 16*v* of the developer bag 16.

By employing also such a constitution, it is possible to prevent the leakage of the toner 22 and to seal the filling port 16*q* without melting the toner 22 similarly as in the above-described embodiments. Other constitutions are similar to those in the above-described embodiments, and a similar effect can be obtained.

Twelfth Embodiment

Next, with reference to FIGS. 20 and 21, a constitution of Twelfth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Tenth and Eleventh Embodiments, a constitution in which the sharp shape provided at the free end portion of the fixing member 31 is penetrated through the non-filling region 16*s* of the folded portion 16*v* was employed. In this embodiment, a through hole forming step of forming a through hole 32 in the non-filling region 16*s* of the filling port 16*v* in advance is provided in the manufacturing process of the developer bag 16.

The fixing member 31 shown in Tenth and Eleventh Embodiments has the sharp shape at the free end portion in the mounting direction side with respect to the arrow U direction in (a) and (c) of FIG. 19, and is caused to cut and penetrate the folded portion 16*v* by the sharp shape, so that the fixing member 31 is mounted at the folded portion 16*v*. Then, the free end portion of the fixing member 31 is bent, and thus the fixing member 31 is fixed to the folded portion 16*v*.

However, in some cases, it is difficult to mount the fixing member 31 by causing the fixing member 31 to cut and penetrate the folded portion 16*v* depending on the sheet material (e.g., polyethylene or polypropylene) or the thickness of the bag member 16*h*. Further, in some cases, it is difficult to mount the fixing member 31 depending on the material or the shape of the fixing member 31.

Figure 20:
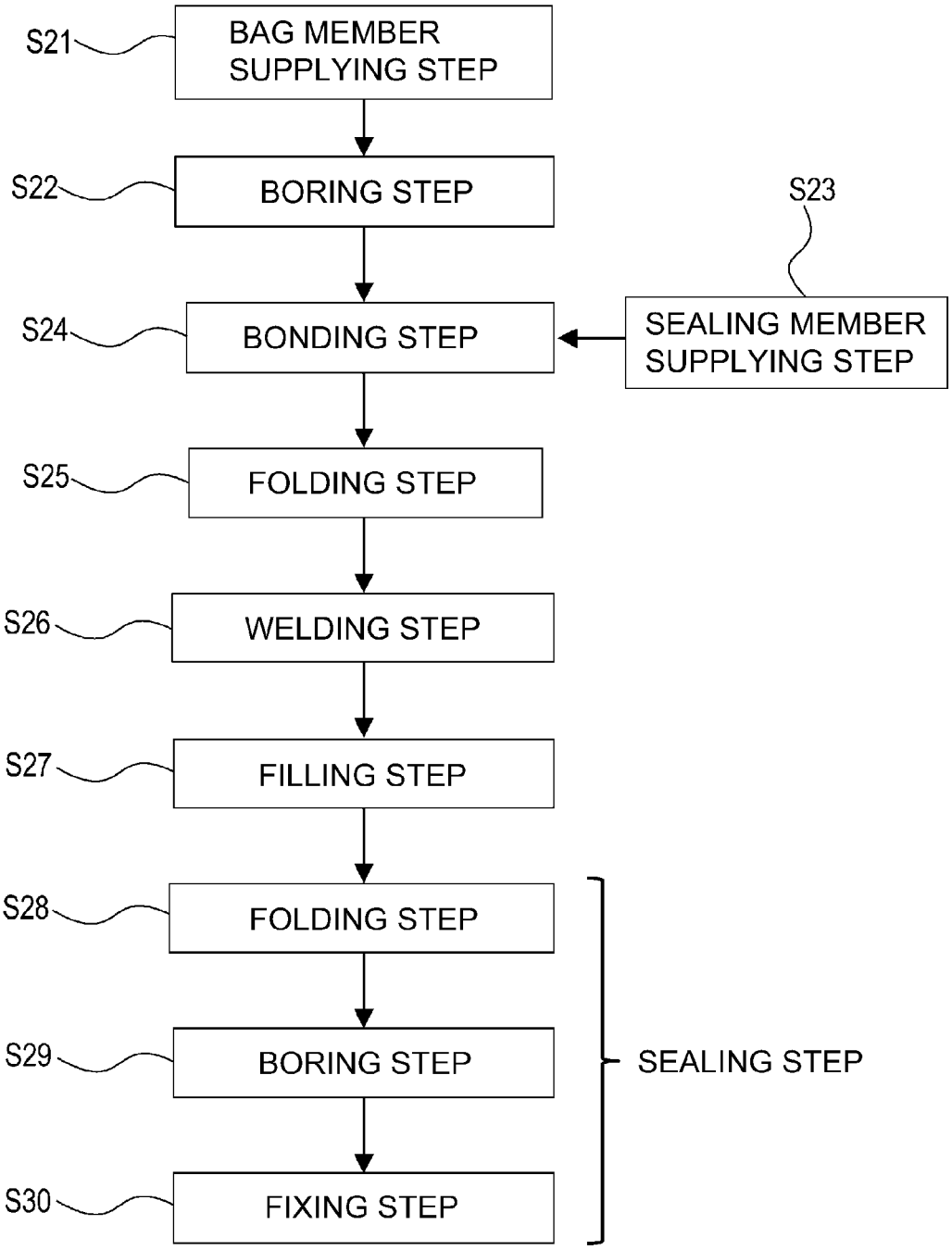
FIG. 20 is a flow chart showing a manufacturing method of a developer accommodating unit according to the present invention in Twelfth Embodiment.

In this embodiment, in the filling port folding step shown as the step S28 in FIG. 20, a folded portion boring step shown as step S29 in FIG. 20 is carried out in the non-filling region 16*s* of the folded portion 16*v* of the developer bag 16. In this folded portion boring step, by an unshown press boring machine, the through hole forming step of forming the through hole 32 penetrating through the non-filling region 16*s* of the folded portion 16*v* is performed. Incidentally, steps S21 to S27 in FIG. 20 are substantially similar to the steps S1 to S7 described above with reference to FIG. 4 in First Embodiment, and therefore will be omitted from redundant description.

In this way, the filling port 16*q* can be sealed up also by forming the through hole 32 in the non-filling region 16*s* of the folded portion 16*v* of the developer bag 16 by the boring performed in advance and then by inserting and mounting the fixing member 31 into the through hole 32 to fix the folded portion 16*v*.

FIG. 20 is a flowchart showing a procedure of the manufacturing method of the developer bag 16 and the sealing member 19 in this embodiment. Then, with reference to FIG. 21, the manufacturing method of the developer bag 16 constituted by the single sheet-shaped bag member 16*h* and the sealing method of the filling port 16*q* will be described.

Figure 21:
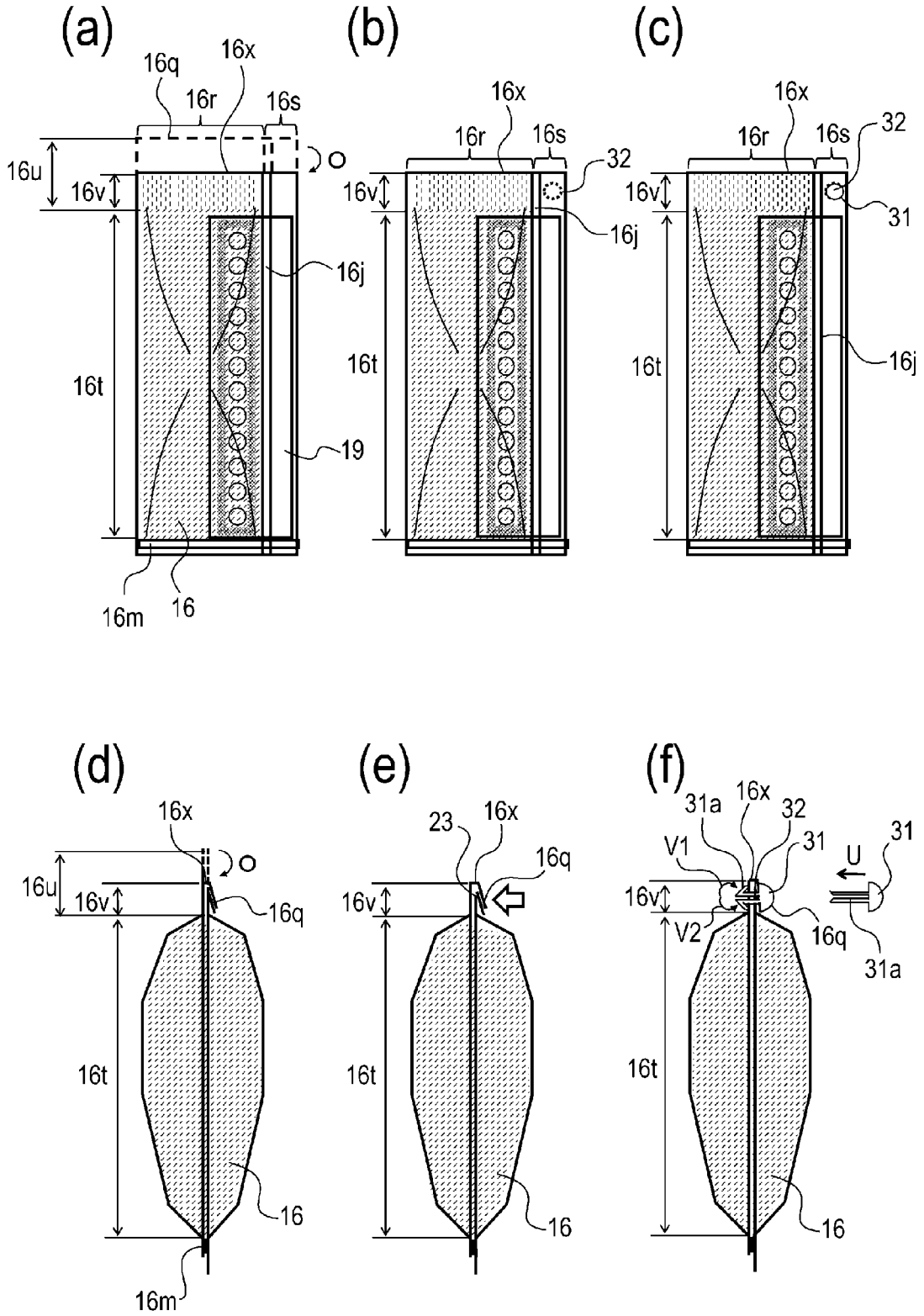
In FIG. 21, (a) to (c) are front illustrations, for illustrating the sealing step including a folding step of folding a developer bag of a developer accommodating unit according to the present invention and a fixing step of fixing a fixing member by causing the fixing member to penetrate through a non-filling region of a folded portion in Twelfth Embodiment.

In FIG. 21, (a) to (c) are front illustrations for illustrating the manufacturing method of the developer bag 16 and the sealing member 19, and (d) to (f) are sectional illustrations for illustrating the sealing step of the filling port 16*q* of the developer bag 16 as seen from the non-filling region 16*s* side in (a) to (c) of FIG. 21. In the filling port folding step shown as the step S28 in FIG. 20, as shown in (a) and (d) of FIG. 21, the folded portion 16*v* is formed by folding the folding margin portion 16*u* provided at the periphery of the filling port 16*q* of the developer bag 16 in which the toner 22 is filled as shown in (d) of FIG. 21. The folded portion 18*v* is formed by integrally folding the folding margin portion 16*u* in the filling region 16*r* and the folding margin portion 16*u* in the non-filling region 16*s* along the fold 16*x* in a folding direction shown as an arrow O direction in (a) and (d) of FIG. 21.

Next, in the folded portion boring step shown as the step S29 in FIG. 20, as shown in (b) and (e) of FIG. 21, the boring is made by the unshown boring machine, so that the through hole 32 is formed in the non-filling region 16*s* of the folded portion 16*v*.

Then, in the folded portion fixing step shown as step S30 in FIG. 20, at least one fixing member 31 is penetrated through the through hole 32 formed in the through hole forming step, and thus is fixed. In this embodiment, as shown in (c) and (f) of FIG. 21, similarly as in Tenth Embodiment, the fixing member 31 including the rivet-shaped portion 31*a* at the free end portion thereof is inserted into the through hole 32 in the arrow U direction in (f) of FIG. 21.

Then, the rivet-shaped portion 31*a* penetrated through the folded portion 16*v* is bent in arrow V1 and V2 directions of (f) of FIG. 21 as a retaining direction. As a result, the fixing member 31 can be fixed to the folded portion 16*v* of the developer bag 16.

By employing also such a constitution, it is possible to prevent the leakage of the toner 22 and to seal the filling port 16*q* without melting the toner 22 similarly as in the above-described embodiments. Other constitutions are similar to those in the above-described embodiments, and a similar effect can be obtained.

Thirteenth Embodiment

Next, with reference to (a) of FIG. 22, a constitution of Thirteenth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Twelfth Embodiment, the constitution in which the fixing member 31 having the rivet-shaped portion 31*a* is inserted and fixed in the through hole 32 formed in advance in the non-filling region 16*s* of the folded portion 16*v* was employed. In this embodiment, the fixing member 31 includes, as shown in (a) of FIG. 22, a retaining portion 31*b* having a larger diameter than a diameter of the through hole 32 at least at a part thereof. Further, the retaining portion 31*b* is elastically deformable to a diameter of not more than the diameter of the through hole 32 by elastic deformation.

When the retaining portion 31*b* of the fixing member 31 is inserted into the through hole 32 formed in the non-filling region 16*s* of the folded portion 16*v*, the retaining portion 31*b* contacts and slides with an edge portion of the through hole 32 to elastically deform, so that the fixing member 31 can be inserted into the through hole 32. After the retaining portion 31*b* passes through the edge portion of the through hole 32, the retaining portion 31*b* elastically deforms to increase in diameter, so that the shape thereof is restored to the shape having the diameter larger than the diameter of the through hole 32. As a result, by the fixing member 31, the folded portion 16*v* of the developer bag 16 can be fixed.

By employing also such a constitution, it is possible to prevent the leakage of the toner 22 and to seal the filling port 16*q* without melting the toner 22 similarly as in the above-described embodiments. Other constitutions are similar to those in the above-described embodiments, and a similar effect can be obtained.

Fourteenth Embodiment

Next, with reference to (b) of FIG. 22, a constitution of Fourteenth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

Figure 22:
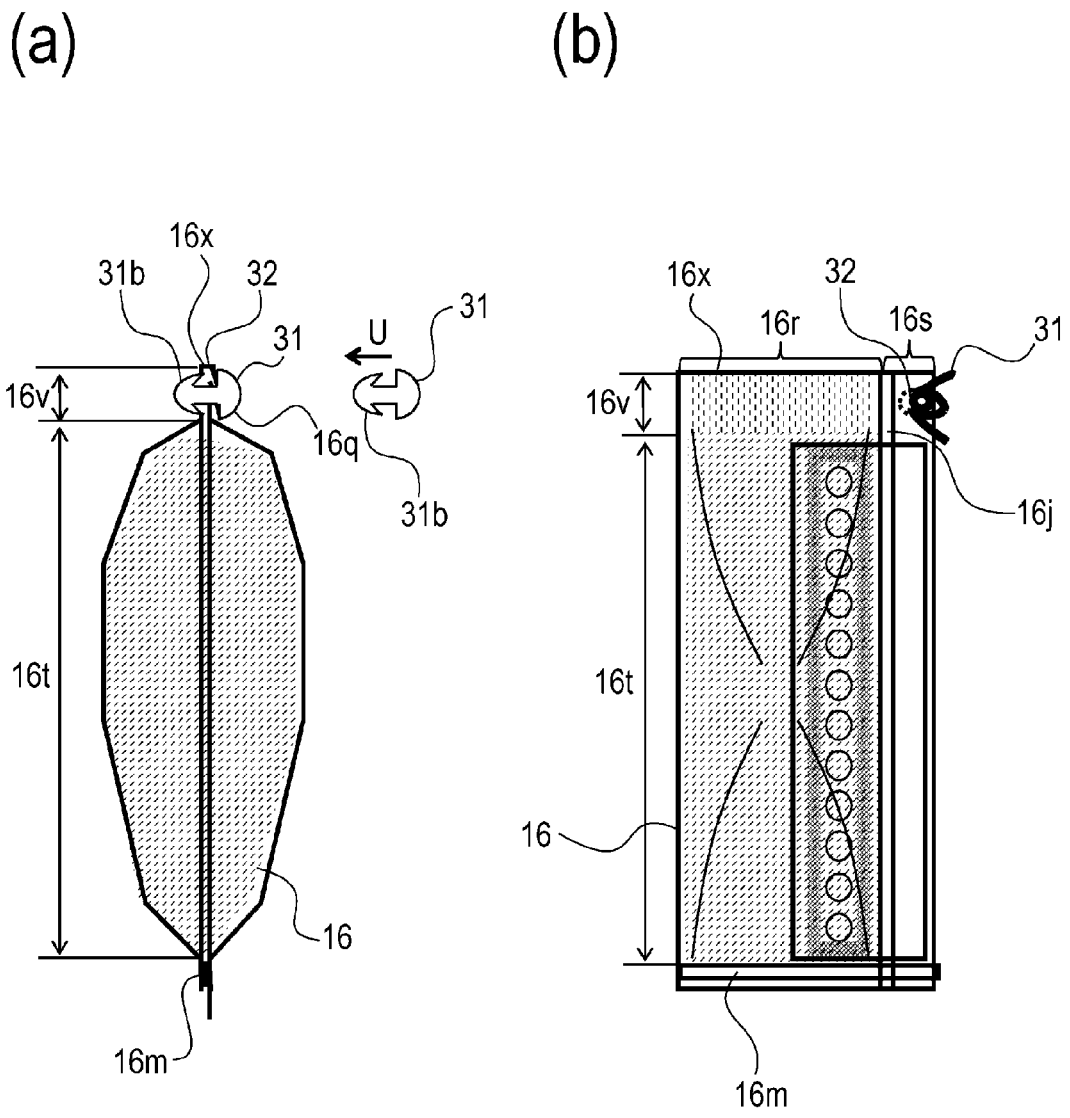
In FIG. 22, (a) is a sectional illustration, as seen from a non-filling region side, for illustrating the sealing step including a folding step of folding a developer bag of a developer accommodating unit according to the present invention and a fixing step of fixing a fixing member by causing the fixing member to penetrate through a non-filling region of a folded portion in Thirteenth Embodiment.

In this embodiment, as shown in (b) of FIG. 22, the fixing member 31 is constituted by a filament member, such as a cord, a thread (yarn), a wire or a bind, having an outer diameter with which the fixing member 31 is insertable into the through hole 32 formed in the non-filling region 16*s* of the folded portion 16*v*. The fixing member 31 is inserted in the through hole 32 formed in the non-filling region 16*s* of the folded portion 16*v*, and then is bound, so that the fixing member 31 is fixed at the folded portion 16*v* of the developer bag 16.

By employing also such a constitution, it is possible to prevent the leakage of the toner 22 and to seal the filling port 16*q* without melting the toner 22 similarly as in the above-described embodiments. Other constitutions are similar to those in the above-described embodiments, and a similar effect can be obtained.

Fifteenth Embodiment

Next, with reference to FIGS. 23 to 25, a constitution of Fifteenth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Eleventh to Fourteenth Embodiments, the folding portion boring step shown as the step S29 was carried out after the filling port folding step shown as the step S28 in FIG. 20. In this embodiment, an example in which after the bag member welding step shown as step S46 in FIG. 23, a folded portion boring step shown as step S47 in FIG. 23 is carried out, and thereafter a developer filling step shown as step S48 in FIG. 23 is carried out will be described. Incidentally, steps S41 to S46 in FIG. 23 are substantially similar to the steps S1 to S6 described above with reference to FIG. 4 in First Embodiment, and therefore will be omitted from redundant description.

Figure 23:
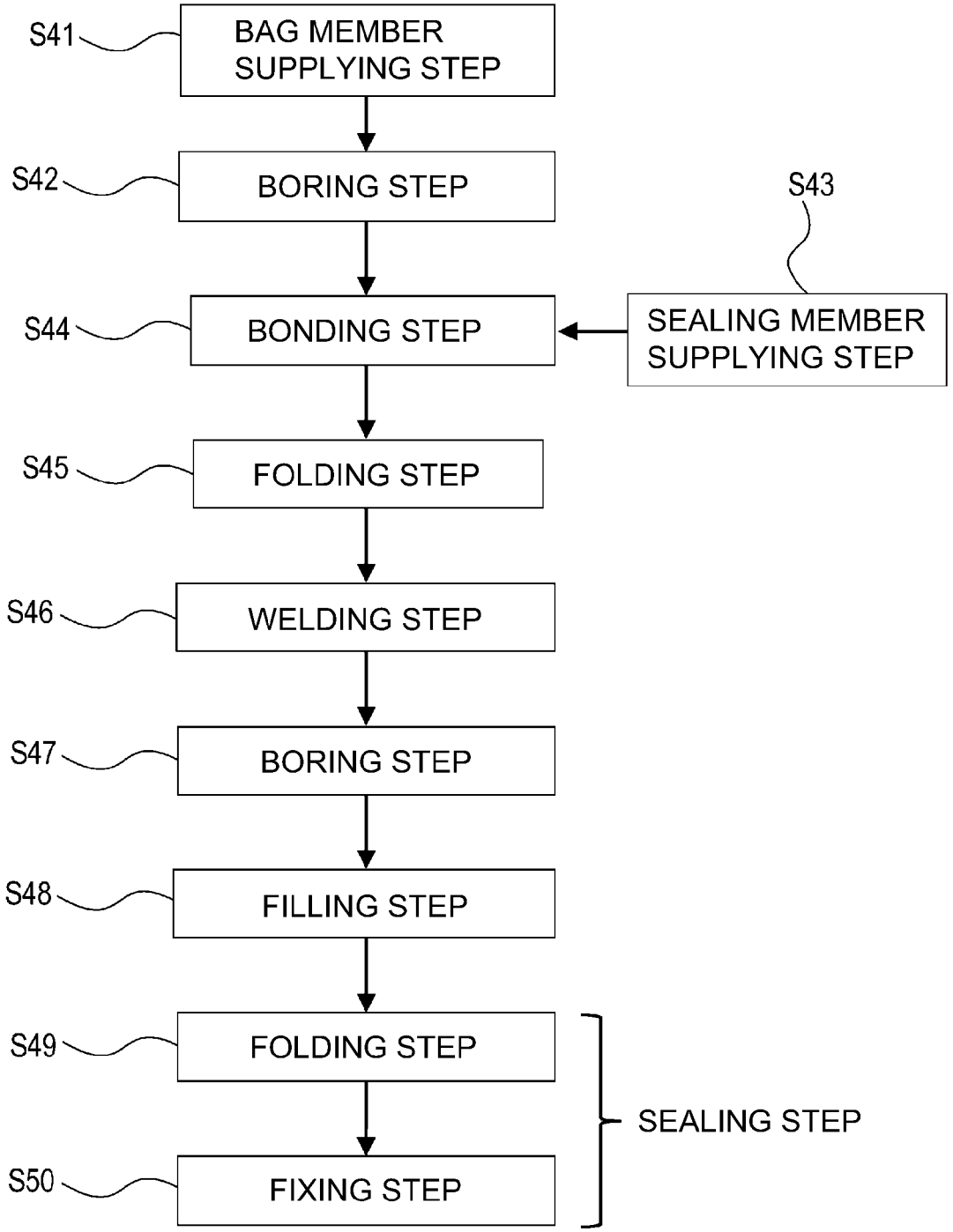
FIG. 23 is a flow chart showing a manufacturing method of a developer accommodating unit according to the present invention in Fifteenth Embodiment.

FIG. 23 is a flowchart showing a procedure of the manufacturing method of the developer bag 16 and the sealing member 19 in this embodiment. In FIG. 24, (a) to (c) are front illustrations for illustrating the filling port sealing step of the developer bag 16 in this embodiment. The folded portion boring step, shown as the step S47 in FIG. 27, of the developer bag 16 formed in the bag shape by welding the single sheet-shaped bag member 16*h* in the bag member welding step shown as the step S46 in FIG. 23 is carried out.

In this folded portion boring step, the folding margin portion 16*u* provided at the periphery of the filling port 16*q* of the developer bag 16 is subjected to the boring using the unshown boring machine. Thus, as shown in (a) of FIG. 24, first and second through holes 32*a* and 32*b* which are symmetrical with respect to the fold 16*x* are formed.

Then, in the developer filling step shown as the step S48 in FIG. 23, the toner 22 is filled in the filling portion 16*t* of the developer bag 16 substantially similarly as in the developer filling step shown as the step S7 in FIG. 4 in First Embodiment described above.

Figure 24:
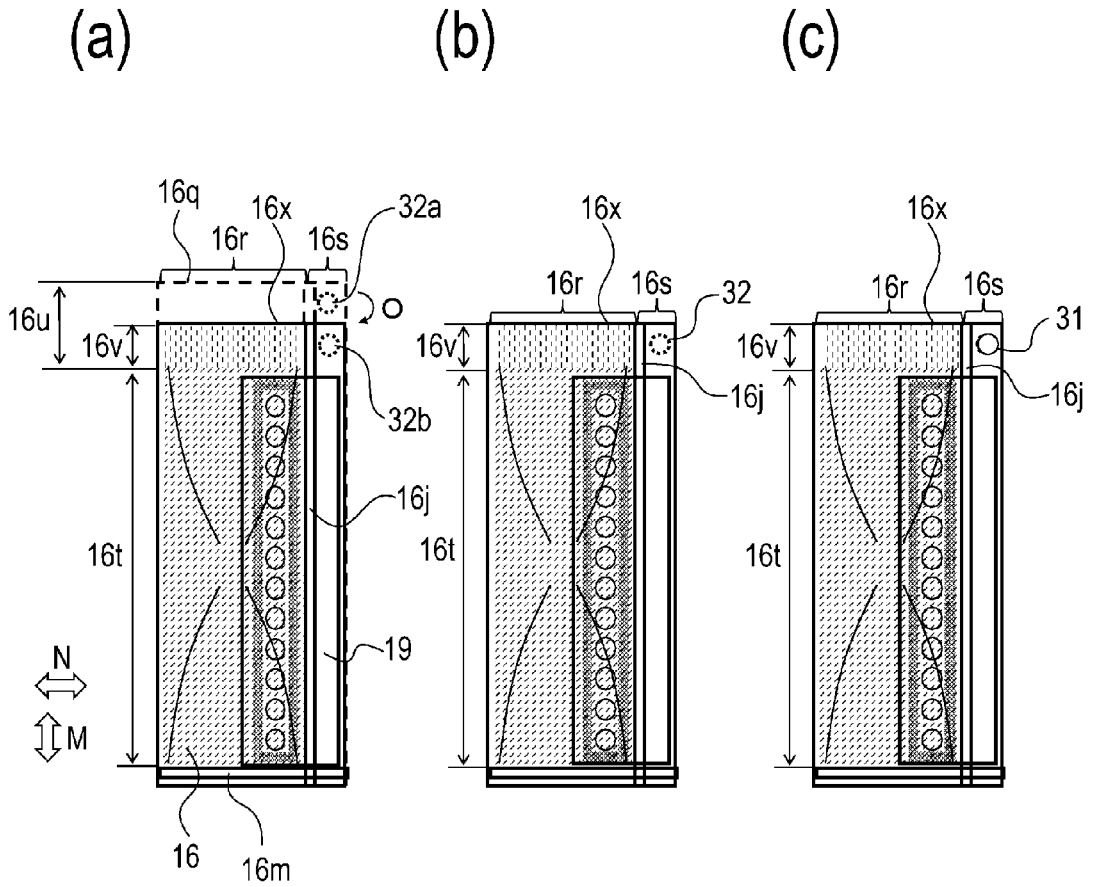
In FIG. 24, (a) to (c) are front illustrations for illustrating a sealing step including a through hole forming step of forming a plurality of through holes penetrating a non-filling region of a developer bag, a folding step of folding a filling port so that the plurality of through holes are aligned with each other, and a fixing step of fixing a fixing member by causing the fixing member to penetrate through the plurality of through holes penetrating through the non-filling region of a folded portion in Fifth Embodiment.

Next, in the filling port folding step shown as step S49 in FIG. 23, as shown in (b) of FIG. 24, the first and second through holes 32*a* and 32*b* formed in the non-filling region 16*s* of the folding margin portion 16*u* provided at the periphery of the filling port 16*q* of the developer bag 16 are caused to overlap with each other to provide the through hole 32.

The folding margin portion 16*u* provided at the periphery of the filling port 16*q* of the developer bag 16 is folded along the fold 16*x* in the folding direction shown as the arrow O direction in (a) of FIG. 24, so that the folded portion 16*v* is formed. At that time, the respective through holes 32*a* and 32*b* are formed at the position where the through hole 32 is formed by the overlapping of the through holes 32*a* and 32*b* formed on the front and back surfaces of the folded portion 16*v*. For that reason, it is possible to form the through hole 32 simultaneously with the formation of the folded portion 16*v*.

Then, in the folded portion fixing step shown as step S50 in FIG. 23, as shown in (c) of FIG. 23, similarly as in Tenth Embodiment, the fixing member 31 including the rivet-shaped portion 31*a* at the free end portion thereof is inserted into the through hole 32. Then, the rivet-shaped portion 31*a* penetrated through the folded portion 16*v* is bent in the retaining direction.

As a result, the fixing member 31 can be fixed to the folded portion 16*v* of the developer bag 16. By employing also such a constitution, it is possible to prevent the leakage of the toner 22 and to seal the filling port 16*q* without melting the toner 22 similarly as in the above-described embodiments. Other constitutions are similar to those in the above-described embodiments, and a similar effect can be obtained.

In this embodiment, the developer bag 16 formed in the bag shape by welding the single sheet-shaped bag member 16*h* in the bag member welding step shown as the step S46 in FIG. 23 is prepared. Then, the boring for forming the first and second through holes 32*a* and 32*b* in the folded portion boring step shown as the step S47 in FIG. 23 is made in the non-filling region 16*s* of the folding margin portion 16*u* provided at the periphery of the filling port 16*q* of the developer bag 16. Such an example was described.

In another method, if the first and second through holes 32*a* and 32*b* can be formed in a step preceding the step of forming the folded portion 16*v*, such a through hole forming step may also be performed in any two consecutive steps in the manufacturing process of the developer bag 16.

Figure 25:
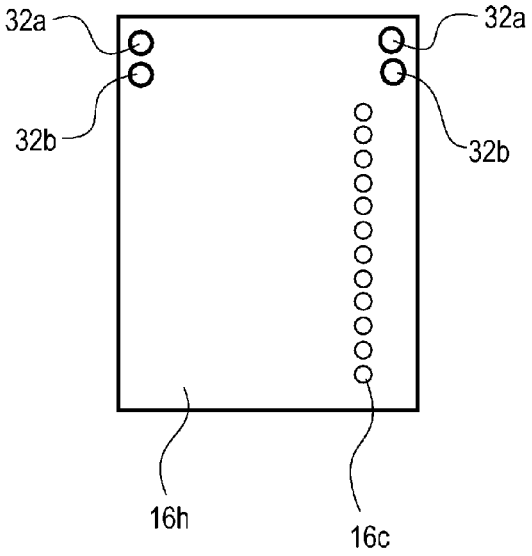
FIG. 25 is a development of the developer bag in Fifth Embodiment.

Referring to FIG. 25, in the opening boring step shown as the step S42 in FIG. 23 which is a step preceding the step of bonding the sealing member 19 to the single sheet-shaped bag member 16*h*, the boring of the bag member 16*h* is made at predetermined positions by the press boring machine. As a result, the openings 16*c* as the discharge opening for permitting the discharge of the toner 22 and the through holes 32*a* and 32*b* formed in the non-filling region 16*s* of the folding margin portion 16*u* provided at the periphery of the filling port 16*q* of the developer bag 16 are formed simultaneously. Such a state is shown in FIG. 25.

In this way, in the opening boring step shown as the step S42 in FIG. 23, the openings 16*c* and the through holes 32*a* and 32*b* are formed at the same time. As a result, the folded portion boring step shown as the step S47 in FIG. 23 can be omitted, so that it is possible to simplify the manufacturing process of the developer bag 16 and to shorten a manufacturing time of the developer bag 16.

In such a manufacturing process, even when the developer bag 16 is manufactured, it is possible to prevent the leakage of the toner 22 and to seal the filling port 16*q* without melting the toner 22 similarly as in the above-described embodiments. Other constitutions are similar to those in the above-described embodiments, and a similar effect can be obtained.

Sixteenth Embodiment

Next, with reference to FIG. 26, a constitution of Sixteenth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Tenth to Fifteenth Embodiments, the constitution in which the filling port 16*q* of the developer bag 16 formed in the bag shape by folding the single sheet-shaped bag member 16*h* is sealed up using the fixing member 31 was described.

In this embodiment, an example of a constitution in which the filling port 16*q* of the developer bag 16 formed by bonding the two (plurality of) sheet-shaped bag members 16*h*1 and 16*h*2 to each other is sealed up using the fixing member 31 will be described. Incidentally, a bonding method of bonding the two sheet-shaped bag members 16*h*1 and 16*h*2 is substantially similar to that described above with reference to FIG. 11 in Second Embodiment, and therefore will be omitted from redundant description.

Figure 26:
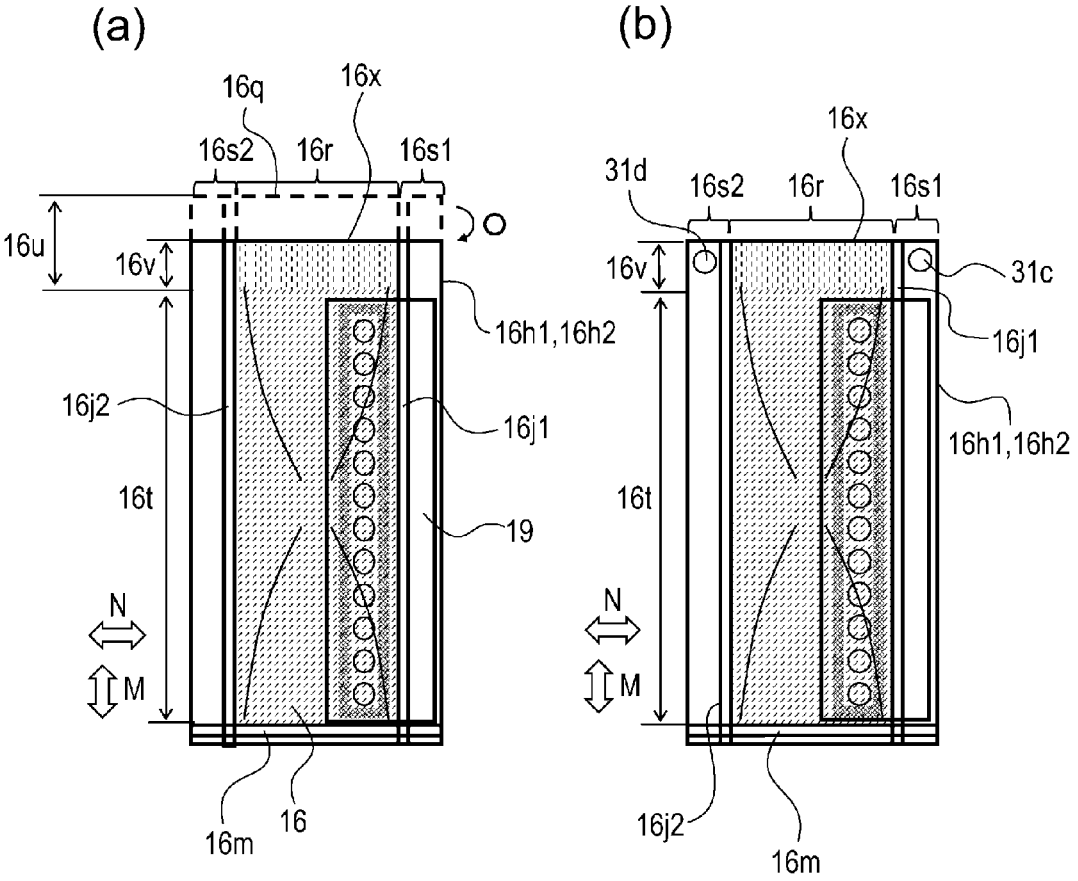
In FIG. 26, (a) and (b) are front illustrations for illustrating a sealing step including a folding step of folding a developer bag of a developer accommodating unit according to the present invention and a fixing step of fixing a fixing member by causing the fixing member to penetrate through a non-filling region of a folded portion in Sixteenth Embodiment.

With reference to FIGS. 11 and 26, the manufacturing method of the developer bag 16 constituted by bonding the two bag members 16*h*1 and 16*h*2 and the sealing method of the develop 16*q* will be described. In FIG. 26, (a) and (b) are toner illustrations for illustrating the filling port sealing step of the developer bag 16. As shown in (a) of FIG. 26, the folding margin portion 16*u* provided at the periphery of the filling port 16*q* of the developer bag 16 is folded along the fold 16*x* in the folding direction shown as the arrow O direction in (a) of FIG. 26, so that the folded portion 16*v* is formed.

Next, as shown in (b) of FIG. 26, fixing members 31*c* and 31*d* are mounted so as to cut and penetrate the non-filling regions 16*s*1 and 16*s*2, respectively, of the folded portion 16*v*. The folded portion 16*v* is folded back about 180 degrees in the arrow O direction in (a) of FIG. 26, so that the sealing by formation of the labyrinth is made. The fixing members 31*c* and 31*d* hold the shape of the folded portion 16*v*, so that the issuing of the toner 22 from the filling portion 16*t* is prevented, and thus the filling port 16*q* is sealed up. By employing also such a constitution, it is possible to prevent the leakage of the toner 22 and to hold the shape of the folded portion 16*v* further reliably without melting the toner 22 similarly as in the above-described embodiments. Other constitutions are similar to those in the above-described embodiments, and a similar effect can be obtained.

Seventh Embodiment

Next, with reference to FIG. 27, a constitution of Seventh Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In this embodiment, an example of a constitution in which the filling port 16*q* of the developer bag 16 formed by bonding the three (plurality of) sheet-shaped bag members 16*h*1, 16*h*2 and 16*h*3 to each other is sealed up using the fixing member 31 will be described. Incidentally, a bonding method of bonding the two sheet-shaped bag members 16*h*1, 16*h*2 and 16*h*3 is substantially similar to that described above with reference to FIG. 12 in Third Embodiment, and therefore will be omitted from redundant description.

Figure 27:
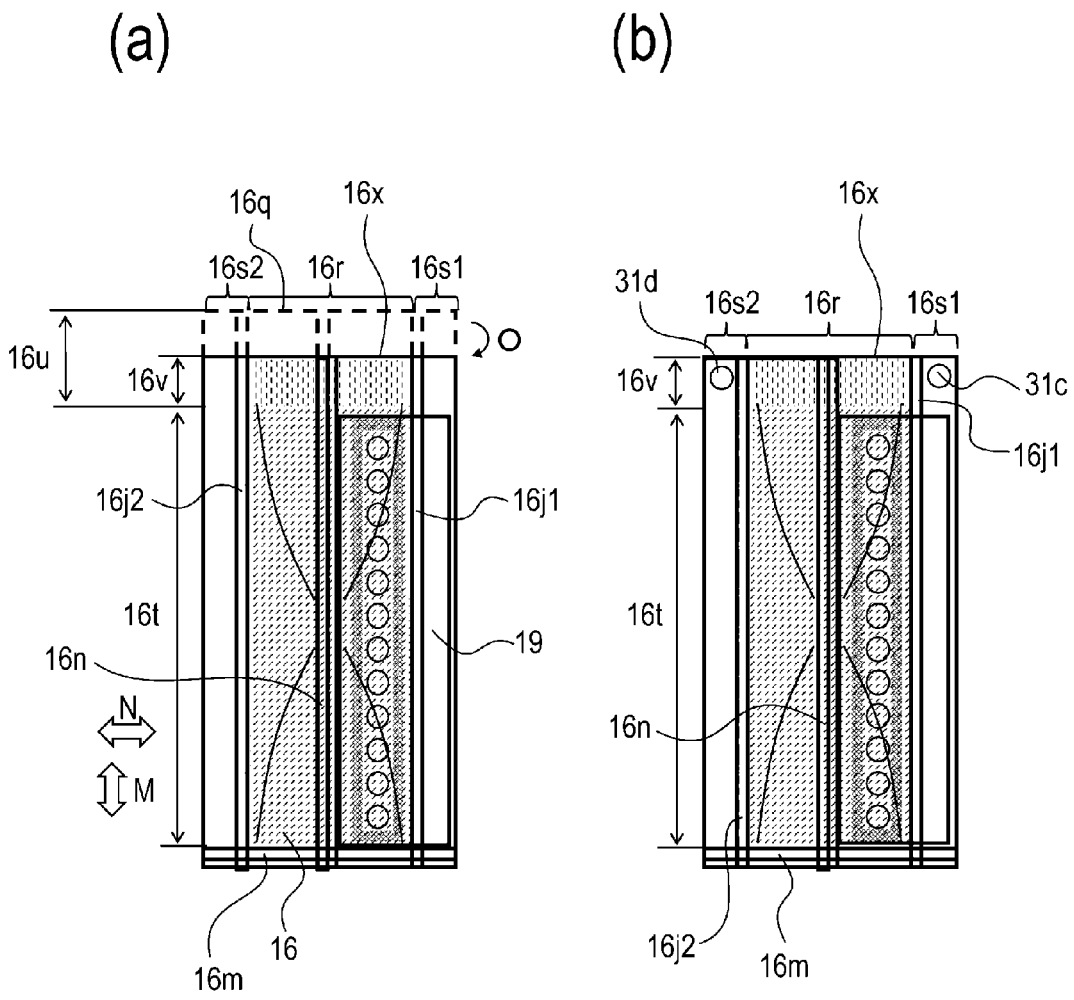
In FIG. 27, (a) and (b) are front illustrations for illustrating a sealing step including a folding step of folding a developer bag of a developer accommodating unit according to the present invention and a fixing step of fixing a fixing member by causing the fixing member to penetrate through a non-filling region of a folded portion in Seventh Embodiment.

With reference to FIGS. 12 and 27, the manufacturing method of the developer bag 16 constituted by bonding the three bag members 16*h*1, 16*h*2 and 16*h*3 and the sealing method of the develop 16*q* will be described. In FIG. 27, (a) and (b) are toner illustrations for illustrating the filling port sealing step of the developer bag 16. As shown in (a) of FIG. 27, the folding margin portion 16*u* provided at the periphery of the filling port 16*q* of the developer bag 16 is folded along the fold 16*x* in the folding direction shown as the arrow O direction in (a) of FIG. 27, so that the folded portion 16*v* is formed.

Next, as shown in (b) of FIG. 27, fixing members 31*c* and 31*d* are mounted by being penetrated through the through hole 32*b* penetrating through the non-filling regions 16*s*1 and 16*s*2, respectively, of the folded portion 16*v*. The folded portion 16*v* is folded back about 180 degrees in the arrow O direction in (a) of FIG. 27, so that the sealing by formation of the labyrinth is made. The fixing members 31*c* and 31*d* hold the shape of the folded portion 16*v*, so that the issuing of the toner 22 from the filling portion 16*t* is prevented, and thus the filling port 16*q* is sealed up. By employing also such a constitution, it is possible to prevent the leakage of the toner 22 and to hold the shape of the folded portion 16*v* further reliably without melting the toner 22 similarly as in the above-described embodiments. Other constitutions are similar to those in the above-described embodiments, and a similar effect can be obtained.

In another example, also in a constitution using a developer bag 16 constituted by four or more (plurality of) bag members 16*h*, the fixing members 31*c* and 31*d* are mounted by being inserted into the through holes 32 penetrating through the non-filling regions 16*s*1 and 16*s*2, respectively, for forming the filling region 16*r*. As a result, an effect similar to those in the above-described embodiments.

Eighteenth Embodiment

Next, with reference to (a) of FIG. 28, a constitution of Eighteenth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In First to Seventeenth Embodiments, an example of the case where the fixing member 16 is mounted so as to penetrate through the through hole 32 formed outside the bonding portion 16*j* for forming the non-filling region 16*s* was described.

In this embodiment, as shown in (a) of FIG. 28, a constitution of the case where the through hole 32 is formed so as to include at least a part of the bonding portion 16*j* for forming the non-filling region 16*s* and then the fixing member 31 is mounted by being penetrated through the through hole 32 will be described. By employing such a constitution, it is possible to narrow the width of the non-filling region 16*s*, so that the filling region 16*r* can be increased in width and thus a filling amount of the toner 22 can be increased. Also in this embodiment, it is possible to prevent the leakage of the toner 22 and to hold the shape of the folded portion 16*v* reliably without melting the toner 22 similarly as in the above-described embodiments. Other constitutions are similar to those in the above-described embodiments, and a similar effect can be obtained.

Nineteenth Embodiment

Next, with reference to (b) of FIG. 28, a constitution of Nineteenth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

Figure 28:
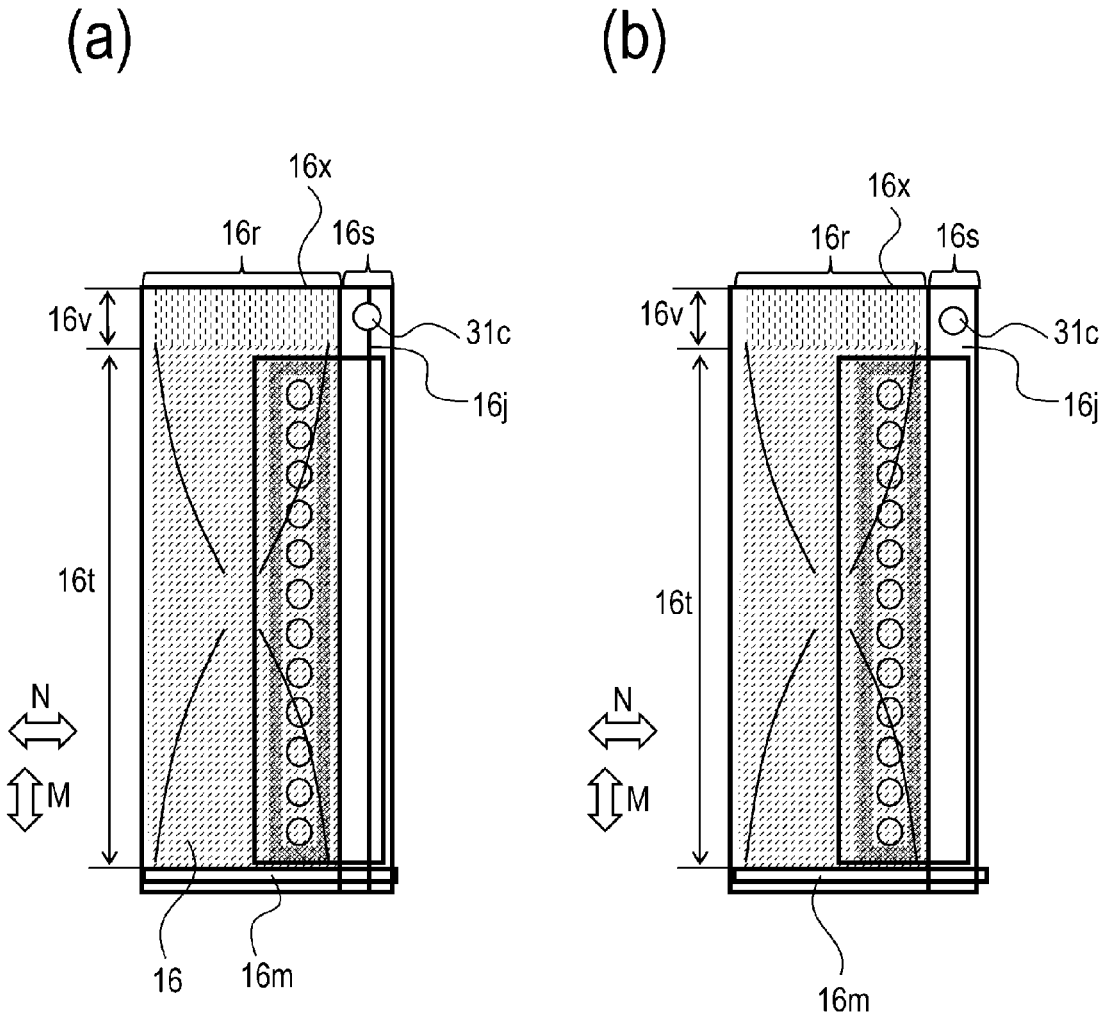
In FIG. 28, (a) is a front illustration for illustrating a sealing step including a folding step of folding a developer bag of a developer accommodating unit according to the present invention and a fixing step of fixing a fixing member by causing the fixing member to penetrate through a non-filling region of a folded portion in Eighteenth Embodiment.

In this embodiment, as shown in (b) of FIG. 28, a constitution in which the non-filling region 16*s* and the bonding portion 16*j* coincide with each other by increasing the welding width is employed. Further, the fixing member 31 is mounted by being penetrated through the through hole 32 formed at the bonding portion 16*j*. By employing such a constitution, it is possible to further narrow the width of the non-filling region 16*s*, so that the filling region 16*r* can be further increased in width and thus a filling amount of the toner 22 can be increased. Also in this embodiment, it is possible to prevent the leakage of the toner 22 and to hold the shape of the folded portion 16*v* reliably without melting the toner 22 similarly as in the above-described embodiments. Other constitutions are similar to those in the above-described embodiments, and a similar effect can be obtained.

Further, similar as in Sixteenth Embodiment, even in the case where the non-filling regions 16*s*1 and 16*s*2 are formed in both sides of the filling region 16*r*, the through hole 32 is formed so as to include at least a part of the bonding portion 16*j*, and then the fixing member 31 is mounted by being penetrated through the through hole 32. Alternatively, the fixing member 31 can also be mounted by being penetrated through the through hole 32 formed at the bonding portion 16*j*.

Twentieth Embodiment

Next, with reference to FIG. 29 and (d) to (f) of FIG. 15, a constitution of Twentieth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Tenth to Nineteenth Embodiments, the example in which the sealing by formation of the labyrinth was made by folding once the folding margin portion 16*e*, along the fold 16*x*, provided at the periphery of the filling port 16*q* of the developer bag 16 was described. In this embodiment, an example in which the sealing by formation of a further complicated labyrinth is made by folding twice the folding margin portion 16*u*, along folds 16*x*1 and 16*x*2, provided at the periphery of the filling port 16*q* of the developer bag 16 will be described. Incidentally, the constitution in which the folding margin portion 16*u* provided at the periphery of the filling port 16*q* of the developer bag 16 is folded back twice along the folds 16*x*1 and 16*x*2 is substantially similar to that described above with reference to FIG. 14 and (a) to (c) of FIG. 15 in Sixth Embodiment, and therefore will be omitted from redundant description.

Figure 29:
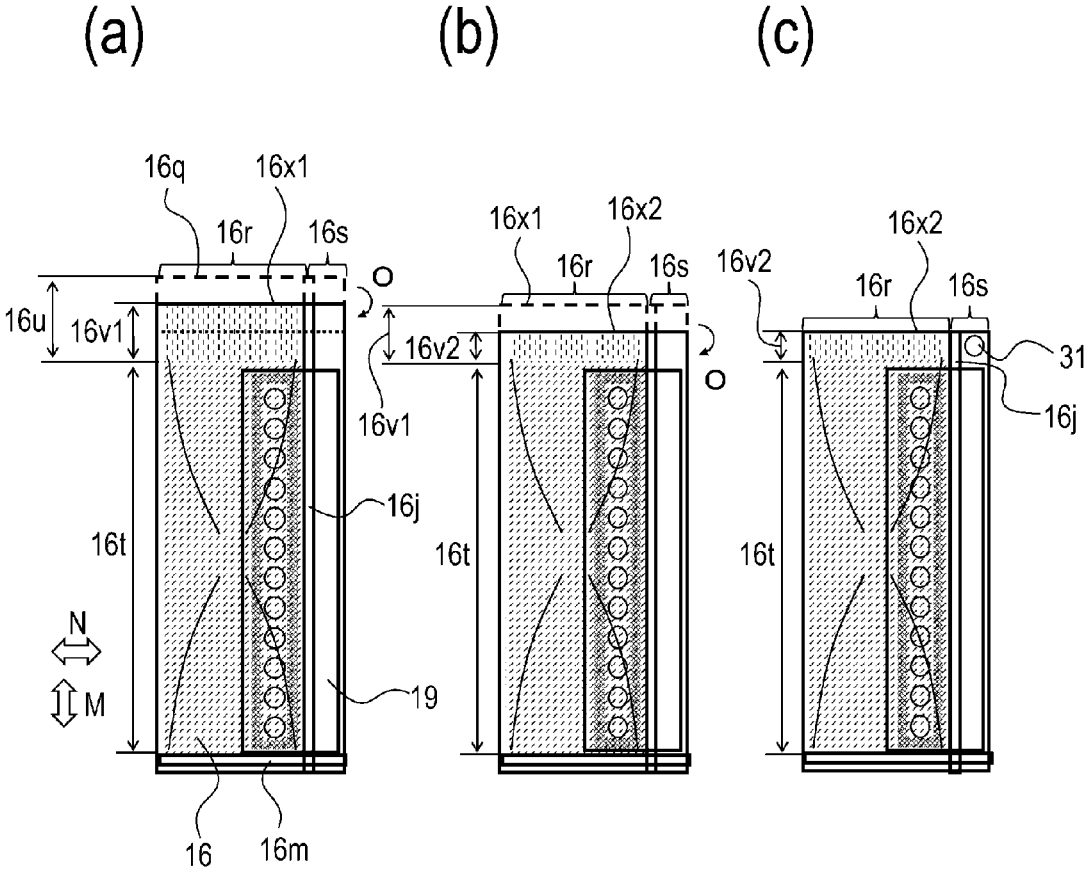
In FIG. 29, (a) to (c) are front illustrations for illustrating a sealing step including a folding step of folding a developer bag of a developer accommodating unit according to the present invention and a fixing step of fixing a fixing member by causing the fixing member to penetrate through a non-filling region of a folded portion in Twentieth Embodiment.

As shown in (a) and (b) of FIG. 29 and (d) and (e) of FIG. 15, substantially similarly as in Sixth Embodiment, the second folded portion 16*v*2 is formed by folding twice the folding margin portion 16*u*, along the folds 16*x*1 and 16*x*2, provided at the periphery of the filling port 16*q* of the developer bag 16. Thereafter, as shown in (c) of FIG. 29 and (f) of FIG. 15, the fixing member 31 is mounted by being penetrated through the through hole 32 formed in the non-filling region 16*s* of the second folded portion 16*v*2.

By employing such a constitution, the shape of the second folded portion 16*v*2 can be held, and similarly as in the above-described embodiments, the leakage of the toner 22 can be prevented, and the shape of the second folded portion 16*v*2 can be held further reliably without melting the toner 22.

In this embodiment, the second folded portion 16*v*2 is formed by folding twice the folding margin portion 16*u*. As a result, the shape folded back about 180 degrees is formed at two positions with respect to the arrow O direction in (a) and (b) of FIG. 29 and (d) and (f) of FIG. 15, and the shape is held. As a result, the sealing by formation of a further complicated labyrinth is made, so that the issuing of the toner 22 from the filling portion 16*t* can be prevented with high reliability. Other constitutions are similar to those in the above-described embodiments, and a similar effect can be obtained.

Twenty-First Embodiment

Next, with reference to (d) and (e) of FIG. 16, a constitution of Twenty-first Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Twentieth Embodiment, the second folded portion 16*v*2 is formed by folding twice the folding margin portion 16*u*, along the first fold 16*x*1 and the second fold 16*x*2 in this order from the filling port 16*q* side, provided at the periphery of the filling port 16*q* of the developer bag 16. Then, the fixing member 31 is mounted by being penetrated through the through hole 32 formed in the non-filling region 16*s* of the second folded portion 16*v*2. Such an example is shown.

In this embodiment, the second folded portion 16*v*2 is formed by folding twice the folding margin portion 16*u*, provided at the periphery of the filling port 16*q* of the developer bag 16, along the first fold 16*x*1 and the second fold 16*x*2 in this order from the filling portion 16*t* side while changing the folding direction. Then, the fixing member 31 is mounted by being penetrated through the through hole 32 formed in the non-filling region 16*s* of the second folded portion 16*v*3. Incidentally, a folding manner in this embodiment is substantially similar to that described above with reference to (a) to (c) of FIG. 16 in Seventh Embodiment, and therefore will be omitted from redundant description.

As shown in (a) and (d) of FIG. 16, substantially similarly as in Seventh Embodiment, the second folded portion 16*v*2 is formed by folding twice the folding margin portion 16*u*, along the folds 16*x*1 and 16*x*2 in this order from the filling portion 16*t* side, provided at the periphery of the filling port 16*q* of the developer bag 16. Thereafter, as shown in (e) of FIG. 16, the fixing member 31 is mounted by being penetrated through the through hole 32 formed in the non-filling region 16*s* of the folded portion 16*v*3.

By employing such a constitution, the shape of the folded portion 16*v*3 can be held, and similarly as in the above-described embodiments, the leakage of the toner 22 can be prevented, and the shape of the folded portion 16*v*3 can be held further reliably without melting the toner 22.

In this embodiment, the folded portion 16*v*3 is formed by folding twice the folding margin portion 16*u*. As a result, the shape folded back about 180 degrees is formed at two positions and is held. As a result, the sealing by formation of a further complicated labyrinth is made, so that the issuing of the toner 22 from the filling portion 16*t* can be prevented with high reliability. Other constitutions are similar to those in the above-described embodiments, and a similar effect can be obtained.

Twenty-Second Embodiment

Next, with reference to (c) of FIG. 17, a constitution of Twenty-second Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Tenth to Twenty-first Embodiment, an example in which the filling port 16*q* of the developer bag 16 was formed at the longitudinal end portion of the developer bag 16 with respect to the arrow M direction in FIG. 8 was described.

In this embodiment, as shown in (a) and (c) of FIG. 17, an elongated filling port 16*q* of the toner 22 is formed, in a length corresponding to a substantially full length of the longitudinal direction of the developer bag 16 with respect to the arrow M direction, at an end portion of the developer bag 16 with respect to the short direction shown as the arrow N direction.

In this embodiment, the non-filling regions 16*s* are constituted by including the bonding portions 16*j*1 and 16*j*2 which are the second welding portion for forming the filling region 16*r*. The fixing members 31*c* and 31*d* are mounted by being penetrated through the through hole 32 formed in the non-filling regions 16*s* provided in both sides of the filling region 16*r* of the folded portion 16*v*.

Even in the case of the developer bag 16 employing also such a constitution, it is possible to prevent the issuing of the toner 22 from the filling portion 16*t* and to seal the filling port 16*q* without melting the toner 22 similarly as in the above-described embodiments. Other constitutions are similar to those in the above-described embodiments, and a similar effect can be obtained.

Twenty-Third Embodiment

Next, with reference to (c) of FIG. 18, a constitution of Twenty-third Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

In Twenty-second Embodiment, the example in which the elongated filling port 16*q* was formed along the longitudinal direction of the developer bag 16 as shown in (c) of FIG. 17 was described. In this embodiment, as shown in (a) and (b) of FIG. 18, a filling port 16*q* is formed, to the extent such that the screw 41 and the casing 43 of the screw filling device 29 described above with reference to FIG. 7 are insertable into the developer bag 16, at a substantially longitudinal central portion of the developer bag 16 as shown in (c) of FIG. 18. The developer bag 16 is formed in a projected shape in cross-section.

As shown in (a) and (c) of FIG. 18, the filling port 16*q* through which the toner 22 is filled is adjusted to have an opening corresponding to a diameter in which the screw 41 and the casing 43 of the screw filling device 29 shown in FIG. 7 is insertable. The filling port 16*q* is partly formed with respect to the longitudinal direction of the developer bag 16 shown as the arrow M direction in FIG. 18. Then, the fixing members 31*c* and 31*d* are mounted by being penetrated through the through hole 32 formed in the non-filling regions 16*s* provided in both sides of the filling region 16*r* of the folded portion 16*v*.

By employing also such a constitution, it is possible to maintain the shape of the folded portion 16*v* with high reliability. Further, it is possible to prevent the issuing of the toner 22 from the filling portion 16*t* and to seal the filling port 16*q* without melting the toner 22 similarly as in the above-described embodiments. Other constitutions are similar to those in the above-described embodiments, and a similar effect can be obtained.

Twenty-Fourth Embodiment

Next, with reference to FIG. 30, a constitution of Twenty-fourth Embodiment of an image forming apparatus to which a process cartridge including a developer accommodating unit according to the present invention is detachably mountable will be described. Constituent elements similar to those in the above-described embodiments will be omitted from illustration by adding the same reference numerals or symbols or adding the same member names even when the reference numerals or symbols are different.

Figure 30:
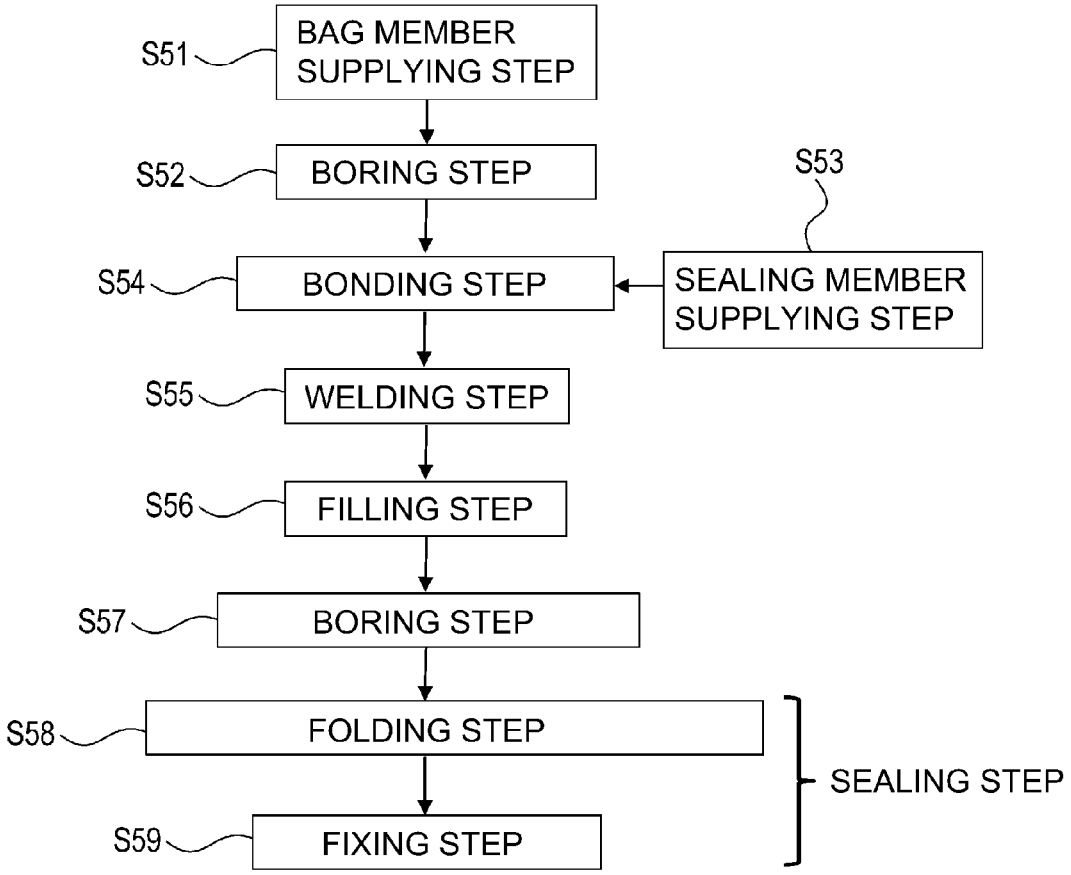
FIG. 30 is a flowchart showing a manufacturing method of a developer accommodating unit according to the present invention in Twenty-fourth Embodiment.

In this embodiment, in steps S51 to S54 shown in FIG. 30, similarly as in the steps S21 to S24 shown in FIG. 20, the bag member supplying step, the opening boring step, the sealing member supplying step and the sealing member bonding step are carried out. Then, in step S55, the bag member welding step is performed. Next, in the developer filling step shown as step S56, the toner 22 is filled in the filling portion 16*t* of the developer bag 16 through the filling port 16*q* of the developer bag 16. Thereafter, in the through hole boring step shown as step S57, the through hole forming step of forming a plurality of through holes 32 penetrating through the non-filling region 16*s* of the developer bag 16 in which the toner 22 is filled is carried out.

Thereafter, in the filling port folding step shown as step S58, the filling region 16*r* and the non-filling region 16*s* of the developer bag 16 are folded along the same fold 16*x* so that a plurality of through holes 32 overlap with each other. Thereafter, in the folded portion fixing step shown as step S59, at least one fixing member 31 is fixed by being penetrated through the plurality of through holes 32 penetrating through the non-filling region 16*s* of the folded portion 16*v*, and thus the developer bag 16 may also be manufactured. Other constitutions are similar to those in the above-described embodiments, and a similar effect can be obtained.

According to the present invention, it is possible to easily perform the sealing even when the developer is scattered over the periphery of the filling port after the developer is filled through the filling port of the developer bag.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 028137/2014 filed Feb. 18, 2014, which is hereby incorporated by reference.

What is claimed is:

1. A developer accommodating unit comprising:
a developer bag in which developer is incorporated,
wherein said developer bag includes:
a filling port for filling the developer;
a filling region where the developer is filled;
a non-filling region, provided outside said filling region, where the developer is not filled, and
a folded portion formed by folding said filling region and said non-filling region,
wherein said folded portion includes a welding portion, and
wherein said welding portion is in said non-filling region.

2. A developer accommodating unit according to claim 1, wherein said folded portion is formed by folding said filling region and said non-filling region along the same fold.

3. A developer accommodating unit according to claim 1, wherein said non-filling region includes a second welding portion for forming said filling region.

4. A developer accommodating unit according to claim 1, wherein said non-filling region is provided at each of end portions of said filling port.

5. A developer accommodating unit according to claim 1, further comprising a sealing member, provided on said developer bag, for covering a discharging opening for permitting discharge of the developer.

6. A manufacturing method of a developer accommodating unit according to claim 1, said manufacturing method comprising:
a developer filling step of filling developer into said developer bag through said filling port;
a folding step of integrally folding said filling region and said non-filling region of said developer bag into which the developer is filled in said developer filling step; and
a welding step of welding a folded portion folded in said folding step.

7. A process cartridge comprising:
a developer accommodating unit according to claim 1; and
an image bearing member for bearing an electrostatic latent image.

8. An image forming apparatus comprising:
a developer accommodating unit according to claim 1.

9. A developer accommodating unit comprising:
a developer bag in which developer is incorporated,
wherein said developer bag includes:
a filling port for filling the developer;
a filling region where the developer is filled;
a non-filling region, provided outside said filling region, where the developer is not filled, and a folded portion formed by folding said filling region and said non-filling region, wherein said developer bag includes at least one fixing member penetrating through said folded portion, and wherein said fixing member is located in said non-filling region.

10. A manufacturing method of a developer accommodating unit according to claim 9, said manufacturing method comprising:

a developer filling step of filling developer into said developer bag through said filling port;

a folding step of integrally folding said filling region and said non-filling region of said developer bag into which the developer is filled in said developer filling step; and a fixing step of fixing said at least one fixing member by causing said at least one fixing member to penetrate through said non-filling region.

11. A manufacturing method according to claim 10, further comprising:

a through hole forming step of forming a through hole penetrating through said non-filling region of said folded portion folded in said folding step, wherein in said fixing step, said at least one fixing member is fixed by being penetrated through the through hole formed in said through hole forming step.

12. A manufacturing method of a developer accommodating unit according to claim 9, said manufacturing method comprising:

a developer filling step of filling developer into said developer bag through said filling port;

a through hole forming step of forming a plurality of through holes penetrating through said non-filling region of said developer bag into which the developer is filled in said developer filling step;

a folding step of integrally folding said filling region and said non-filling region of said developer bag so that the plurality of through holes are aligned with each other; and a fixing step of fixing said non-filling region a folded portion folded in said folding step by causing said at least one fixing member to penetrate through the plurality of through holes penetrating through said non-filling region.

13. A developer accommodating unit according to claim 9, wherein said developer bag includes said at least one fixing member penetrating through said non-filling region of said folded portion.

14. A process cartridge comprising:

a developer accommodating unit according to claim 9; and an image bearing member for bearing electrostatic latent image.

15. An image forming apparatus comprising:

a developer accommodating unit according to claim 9.

* * * * *